US011474442B2

(12) United States Patent
Fukudome et al.

(10) Patent No.: US 11,474,442 B2
(45) Date of Patent: Oct. 18, 2022

(54) ELECTROPHOTOGRAPHIC APPARATUS, PROCESS CARTRIDGE, AND CARTRIDGE SET

(71) Applicant: CANON KABUSHIKI KAISHA, Tokyo (JP)

(72) Inventors: Kosuke Fukudome, Tokyo (JP); Tomohiro Unno, Shizuoka (JP); Dai Nozaki, Shizuoka (JP); Kozue Uratani, Shizuoka (JP); Yuta Komiya, Shizuoka (JP); Masahiro Kurachi, Shizuoka (JP); Kazuhiro Yamauchi, Shizuoka (JP); Motonari Ito, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 202 days.

(21) Appl. No.: 17/071,227

(22) Filed: Oct. 15, 2020

(65) Prior Publication Data

US 2021/0116827 A1 Apr. 22, 2021

(30) Foreign Application Priority Data

Oct. 18, 2019 (JP) ..... JP2019-191584

(51) Int. Cl.
*G03G 15/02* (2006.01)
*G03G 9/08* (2006.01)
(Continued)

(52) U.S. Cl.
CPC ..... *G03G 9/0819* (2013.01); *G03G 9/08755* (2013.01); *G03G 9/08797* (2013.01); *G03G 15/0233* (2013.01); *G03G 15/054* (2013.01)

(58) Field of Classification Search
CPC ..... G03G 15/0233; G03G 9/08797
See application file for complete search history.

(56) References Cited

U.S. PATENT DOCUMENTS 6,697,587 B2 2/2004 Harada
6,864,030 B2 3/2005 Shirai et al.
(Continued)

FOREIGN PATENT DOCUMENTS

JP 2002003651 A 1/2002
JP 2003107781 A 4/2003
(Continued)

OTHER PUBLICATIONS

Translation of JP 2006-030456.*
(Continued)

*Primary Examiner* — Peter L Vajda
(74) *Attorney, Agent, or Firm* — Venable LLP

(57) ABSTRACT

An electrophotographic apparatus having an electrophotographic photosensitive member, a charging unit, and a developing unit for forming a toner image on a surface of the electrophotographic photosensitive member, wherein the charging unit has a conductive member disposed to be contactable with the electrophotographic photosensitive member; a conductive layer at the surface of the conductive member has a matrix and a plurality of domains dispersed in the matrix; at least a portion of the domains is exposed at the outer surface of the conductive member; the outer surface of the conductive member is constituted of at least the matrix and the domains; a volume resistivity R1 of the matrix is greater than $1.00\times10^{12}$ Ω·cm; a volume resistivity R2 of the domains is smaller than R1; the developing unit contains the toner; and a dielectric loss tangent of the toner is at least 0.0027.

15 Claims, 6 Drawing Sheets

(51) Int. Cl.
*G03G 9/087* (2006.01)
*G03G 15/054* (2006.01)

(56) References Cited

U.S. PATENT DOCUMENTS

| | | | |
|---|---|---|---|
| 7,799,398 | B2 | 9/2010 | Nakamura et al. |
| 8,298,670 | B2 | 10/2012 | Muranaka et al. |
| 8,449,975 | B2 | 5/2013 | Hirakoso et al. |
| 8,503,916 | B2 | 8/2013 | Anan et al. |
| 8,628,854 | B2 | 1/2014 | Yamauchi et al. |
| 8,660,472 | B2 | 2/2014 | Kurachi et al. |
| 8,668,987 | B2 | 3/2014 | Yamauchi et al. |
| 8,715,830 | B2 | 5/2014 | Yamada et al. |
| 8,771,818 | B2 | 7/2014 | Nishioka et al. |
| 8,852,743 | B2 | 10/2014 | Kikuchi et al. |
| 9,023,465 | B2 | 5/2015 | Yamada et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 6/2016 | Masu et al. |
| 9,442,408 | B2 | 9/2016 | Yamauchi et al. |
| 9,442,451 | B2 | 9/2016 | Yamauchi et al. |
| 9,541,854 | B2 | 1/2017 | Kikuchi et al. |
| 9,547,250 | B2 | 1/2017 | Kikuchi et al. |
| 9,551,947 | B2 | 1/2017 | Hiroko et al. |
| 9,551,949 | B2 | 1/2017 | Yamauchi et al. |
| 9,556,359 | B2 | 1/2017 | Suzumura et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,897,931 | B2 | 2/2018 | Nishioka et al. |
| 9,958,802 | B2 | 5/2018 | Kikuchi et al. |
| 9,964,874 | B2 | 5/2018 | Suzumura et al. |
| 9,964,881 | B2 | 5/2018 | Ikejiri et al. |
| 9,964,914 | B2 | 5/2018 | Arimura et al. |
| 9,977,353 | B2 | 5/2018 | Nishioka et al. |
| 10,018,927 | B2 | 7/2018 | Yamada et al. |
| 10,018,934 | B2 | 7/2018 | Yamada et al. |
| 10,108,129 | B2 | 10/2018 | Yamaguchi et al. |
| 10,280,148 | B2 | 5/2019 | Nishioka et al. |
| 10,416,588 | B2 | 9/2019 | Masu et al. |
| 10,488,777 | B2 | 11/2019 | Terauchi et al. |
| 10,649,350 | B2 | 5/2020 | Yamaguchi et al. |
| 10,678,154 | B2 | 6/2020 | Takashima et al. |
| 10,678,158 | B2 | 6/2020 | Kikuchi et al. |
| 2012/0251171 | A1 | 10/2012 | Muranaka et al. |
| 2012/0308261 | A1 | 12/2012 | Tsuru et al. |
| 2013/0281276 | A1 | 10/2013 | Watanabe et al. |
| 2013/0310239 | A1* | 11/2013 | Terada ..... G03G 21/1853 428/521 |
| 2014/0072343 | A1 | 3/2014 | Masu et al. |
| 2014/0080691 | A1 | 3/2014 | Kurachi et al. |
| 2015/0331346 | A1 | 11/2015 | Yamauchi et al. |
| 2020/0225593 | A1 | 7/2020 | Yamaguchi et al. |
| 2020/0310264 | A1 | 10/2020 | Kurachi et al. |
| 2020/0310265 | A1 | 10/2020 | Nishioka et al. |
| 2020/0310266 | A1 | 10/2020 | Kikuchi et al. |
| 2021/0026295 | A1 | 1/2021 | Yamada et al. |
| 2021/0033996 | A1 | 2/2021 | Kikuchi et al. |
| 2021/0041796 | A1 | 2/2021 | Nishioka et al. |

FOREIGN PATENT DOCUMENTS

| | | | | |
|---|---|---|---|---|
| JP | 2003280246 | A | 10/2003 | |
| JP | 2005049630 | A | 2/2005 | |
| JP | 2006-030456 | * | 2/2006 | ..... G03G 15/08 |
| JP | 2012068623 | A | 4/2012 | |
| JP | 2017107169 | A | 6/2017 | |
| JP | 2017207680 | A | 11/2017 | |
| JP | 2017211648 | A | 11/2017 | |
| JP | 2018077385 | A | 5/2018 | |
| JP | 2019045578 | A | 3/2019 | |

OTHER PUBLICATIONS

U.S. Appl. No. 17/065,258, Kohei Makisumi, filed Oct. 7, 2020.
U.S. Appl. No. 17/069,919, Tsutomu Nishida, filed Oct. 14, 2020.
U.S. Appl. No. 17/070,054, Yuka Ishiduka, filed Oct. 14, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.
U.S. Appl. No. 17/071,103, Noriyoshi Umeda, filed Oct. 15, 2020.
U.S. Appl. No. 17/071,109, Shohei Kototani, filed Oct. 15, 2020.
U.S. Appl. No. 17/071,246, Tomohiro Unno, filed Oct. 15, 2020.
U.S. Appl. No. 17/071,283, Yoshitaka Suzumura, filed Oct. 15, 2020.
U.S. Appl. No. 17/071,535, Hiroyuki Tomono, filed Oct. 15, 2020.
U.S. Appl. No. 17/071,540, Tsuneyoshi Tominaga, filed Oct. 15, 2020.

* cited by examiner

ELECTROPHOTOGRAPHIC APPARATUS, PROCESS CARTRIDGE, AND CARTRIDGE SET

BACKGROUND OF THE INVENTION

Field of the Invention

The present disclosure relates to an electrophotographic apparatus, a process cartridge, and a cartridge set that are used in an electrophotographic system.

Description of the Related Art

User demand for higher speed, higher image quality, and longer life of electrophotographic image-forming apparatuses has been growing even more. The ability to satisfy these capabilities stably is also required by users in diverse operating environments and media to be used throughout the world. The demands for higher speed and higher image quality of printers are long-standing and persistent, hence, it is necessary to implement charging, development, and transfer processes precisely in ever shorter period of time while achieving both higher speed and higher image quality.

Moreover, with environmental awareness being enhanced among users and operating environments being diversifying, a greater number of rough paper having a larger surface unevenness than heretofore, i.e., recycled paper and thin paper, have begun to be used. When rough paper is used, the quality of halftone images thereon tends to be lower than that on smooth paper, thus additional enhancement in image quality is required.

In addition, modern printers are also frequently used in small offices that lack air conditioning, and there is thus demand for the ability also of exhibiting a stable performance over a broad range of operating environments, i.e., from low-temperature, low-humidity environments to high-temperature, high-humidity environments.

To cope with these demands, a sensor, e.g., an environmental sensor, media sensor, and so forth, may be disposed as a system in the main body to execute control to provide optimal settings for each electrophotographic process in accordance with operating environment, number of prints in an extended run, and media. This may elicit a certain improvement. However, the increase in the number of components may affect the size of the main body, power consumption, and wait times.

As a consequence, there is demand for an electrophotographic apparatus that is able to implement both higher printer speeds and higher image qualities, cope with a wide range of environments, and stabilize image quality throughout long-term use. An electrophotographic apparatus has at least a charging unit for charging the surface of an electrophotographic photosensitive member and a developing unit for forming a toner image on the surface of the electrophotographic photosensitive member by developing with a toner an electrostatic latent image formed on the surface of the electrophotographic photosensitive member.

In order to improve the capabilities of electrophotographic apparatuses, technical developments with regard to a toner, as well as technical developments with regard to charging members that improve the charging unit, have been carried out.

Japanese Patent Application Laid-open No. 2002-3651 discloses a rubber composition having a sea-island structure and a charging member having an elastic layer formed from this rubber composition. The rubber composition contains a polymer continuous phase including an ionically conductive rubber material having as a main component a starting rubber A having a volume resistivity of not more than $1.0\times10^{12}$ Ω·cm, and contains a polymer particulate phase including an electronic conductive rubber material rendered conductive by the incorporation of conductive particles in a starting rubber B.

Japanese Patent Application Laid-open No. 2012-68623 discloses a toner for which an improvement in the durability in high-temperature, high-humidity environments is cited, with the improvement being achieved by having a dielectric loss tangent of the toner be in a prescribed range.

SUMMARY OF THE INVENTION

According to the results of investigations by the present inventors, the image quality of halftone images was lowered, with the halftone images having been obtained when the charging member according to Japanese Patent Application Laid-open No. 2002-3651 was employed in an electrophotographic image-forming apparatus having a fast process speed (also described hereafter simply as a "high-speed process") to form halftone images continuously on rough paper in a low-temperature, low-humidity (temperature=15° C., relative humidity=10%) environment.

Specifically, image density nonuniformity in the form of white speckling (white spots) was produced in a portion of the halftone image and the density uniformity of the halftone image (halftone density uniformity) was reduced.

An embodiment of the present disclosure is directed to providing an electrophotographic apparatus that can form a high-quality halftone image in a stable manner even in a low-temperature, low-humidity environment. Another embodiment of the present disclosure is directed to providing a process cartridge and cartridge set that contribute to the stable formation of a high-quality halftone image.

At least one embodiment of the present disclosure provides an electrophotographic apparatus comprising:

an electrophotographic photosensitive member, a charging unit for charging a surface of the electrophotographic photosensitive member, and a developing unit for developing an electrostatic latent image formed on the surface of the electrophotographic photosensitive member with a toner to form a toner image on the surface of the electrophotographic photosensitive member, wherein the charging unit comprises a conductive member arranged to be capable of contacting the electrophotographic photosensitive member, the conductive member comprises a support having a conductive outer surface, and a conductive layer disposed on the outer surface of the support, the conductive layer comprises a matrix and a plurality of domains dispersed in the matrix, the matrix contains a first rubber, each of the domains contains a second rubber and an electronic conductive agent, at least some of the domains is exposed at the outer surface of the conductive member, the outer surface of the conductive member is composed of at least the matrix and the domains exposed at the outer surface of the conductive member, the matrix has a volume resistivity R1 of larger than $1.00\times10^{12}$ Ω·cm, the domains have a volume resistivity R2 of smaller than the volume resistivity R1 of the matrix, the developing unit comprises the toner, and the toner has a dielectric loss tangent of at least 0.0027.

Also, at least one embodiment of the present disclosure provides a process cartridge detachably provided to a main body of an electrophotographic apparatus, wherein the process cartridge comprises a charging unit for charging a surface of an electrophotographic photosensitive member, and a developing unit for developing an electrostatic latent image formed on the surface of the electrophotographic photosensitive member with a toner to form a toner image on the surface of the electrophotographic photosensitive member, the charging unit comprises a conductive member arranged to be capable of contacting the electrophotographic photosensitive member, the conductive member comprises a support having a conductive outer surface, and a conductive layer disposed on the outer surface of the support, the conductive layer comprises a matrix and a plurality of domains dispersed in the matrix, the matrix contains a first rubber, each of the domains contains a second rubber and an electronic conductive agent, at least some of the domains is exposed at the outer surface of the conductive member, the outer surface of the conductive member is composed of at least the matrix and the domains exposed at the outer surface of the conductive member, the matrix has a volume resistivity R1 of larger than $1.00\times10^{12}$ Ω·cm, the domains have a volume resistivity R2 of smaller than the volume resistivity R1 of the matrix, the developing unit has the toner, and the toner has a dielectric loss tangent of at least 0.0027.

Also, at least one embodiment of the present disclosure provides a cartridge set having a first cartridge and a second cartridge detachably provided to a main body of an electrophotographic apparatus, wherein the first cartridge comprises a charging unit for charging a surface of an electrophotographic photosensitive member, and comprises a first frame for supporting the charging unit, the second cartridge comprises a toner container that accommodates a toner for forming a toner image on the surface of the electrophotographic photosensitive member by developing an electrostatic latent image formed on the surface of the electrophotographic photosensitive member, the charging unit comprises a conductive member arranged to be capable of contacting the electrophotographic photosensitive member, the conductive member comprises a support having a conductive outer surface and, a conductive layer disposed on the outer surface of the support, the conductive layer comprises a matrix and a plurality of domains dispersed in the matrix, the matrix contains a first rubber;

each of the domains contains a second rubber and an electronic conductive agent, at least some of the domains is exposed at the outer surface of the conductive member;

the outer surface of the conductive member is composed of at least the matrix and the domains exposed at the outer surface of the conductive member, the matrix has a volume resistivity R1 of larger than $1.00\times10^{12}$ Ω·cm, the domains have a volume resistivity R2 of smaller than the volume resistivity R1 of the matrix; and the toner has a dielectric loss tangent of at least 0.0027.

An embodiment of the present disclosure can provide an electrophotographic apparatus that can form a high-quality halftone image in a stable manner even in a low-temperature, low-humidity environment. Another embodiment of the present disclosure can provide a process cartridge and cartridge set that contribute to the stable formation of a high-quality halftone image.

Further features of the present invention will become apparent from the following description of exemplary embodiments with reference to the attached drawings.

DESCRIPTION OF THE EMBODIMENTS

Figure 1:
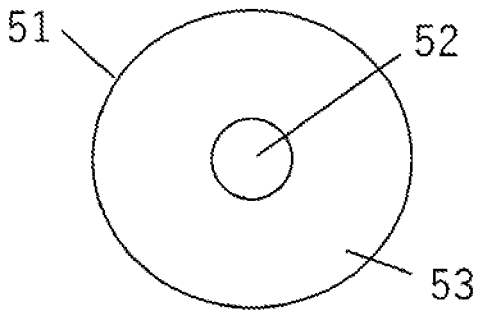
FIG. 1 is a cross-sectional diagram of a charging roller for the direction orthogonal to the longitudinal direction.

Unless specifically indicated otherwise, the expressions "from XX to YY" and "XX to YY" that show numerical value ranges refer to numerical value ranges that include the lower limit and upper limit that are the end points.

When numerical value ranges are provided in stages, the upper limits and lower limits of the individual numerical value ranges may be combined in any combination.

The electrophotographic apparatus according to at least one embodiment according to the present disclosure is provided with a charging unit having a conductive member and with a developing unit having a toner.

In addition, the conductive member has a support having a conductive outer surface and has a conductive layer disposed on this outer surface of the support;

the conductive layer has a matrix and a plurality of domains dispersed in this matrix, the matrix contains a first rubber and each of the domains contains a second rubber and an electronic conductive agent;

at least some of the domains is exposed at the outer surface of the conductive member;

the outer surface of the conductive member is constituted of at least the matrix and the domains that are exposed at the outer surface of the conductive member;

the volume resistivity R1 of the matrix is greater than $1.00\times10^{12}$ Ω·cm; and the volume resistivity R2 of the domains is smaller than the volume resistivity R1 of the matrix.

The toner, on the other hand, has a dielectric loss tangent of at least 0.0027.

The outer surface of the conductive member is the surface in contact with the toner at the conductive member.

This electrophotographic apparatus can effectively prevent the occurrence of white spots in halftone images in high-speed processes and then even when halftone image formation is carried out, for example, in a low-temperature, low-humidity environment with a temperature of 15° C. and a relative humidity of 10%. The reasons for this are as follows.

The present inventors carried out intensive investigations in pursuit of providing a good halftone image density uniformity in the case of the continuous printing of a halftone image in a low-temperature, low-humidity environment with a high-speed electrophotographic apparatus using rough paper.

During this effort, investigations were first carried out into the causes of the occurrence in the halftone image of image density nonuniformity in the form of white speckling (white spots) when halftone images were continuously printed in a low-temperature, low-humidity environment using a high-speed electrophotographic apparatus equipped with the charging member according to Japanese Patent Application Laid-open No. 2002-3651.

It was recognized as a result that the white spots in this halftone image are produced by the attachment of untransferred toner to the surface of this charging member, the local accumulation of excess charge by the attached untransferred toner, and the generation of an abnormal electrical discharge, although small, from the untransferred toner to the electrophotographic photosensitive member.

This is more specifically described in the following.

First, the toner cleaning performance readily declines in a low-temperature, low-humidity environment. As a consequence, untransferred toner then readily slips past the cleaning blade and attaches to the surface of the conductive member present in the charging unit. In addition, in high-speed processes, a nonuniform electrical discharge is readily produced in the electrical discharge that occurs between the electrophotographic photosensitive member and charging unit, as described below, and due to this the untransferred toner attached to the conductive member surface can acquire excess charge.

Particularly in a low-temperature, low-humidity environment, it is difficult for charge to escape and charge accumulation is facilitated, and as a consequence the untransferred toner accumulates excess charge at locations on its surface. In addition, an abnormal electrical discharge toward the electrophotographic photosensitive member is produced from the excessively charged areas of the untransferred toner.

Moreover, those regions on the surface of the electrophotographic photosensitive member supplied with charge by abnormal electrical discharge from the untransferred toner take on a state in which the absolute value of the surface potential is much higher than in regions where charge is supplied by a normal electrical discharge. As a consequence, the potential is not reduced to the desired potential even upon exposure by irradiation with laser light, and toner development at such regions is impeded. It is thought that this results in the generation of white spots in the halftone image and thus a reduction in the quality of the halftone image.

When, in particular, rough paper is used as the recording medium, nonuniformity in the transfer field strength is produced in the transfer process at the unevenness present in the paper and there is a tendency for the toner transfer efficiency at the depressed portions of the paper to be reduced from that at the protruded portions of the paper. As a consequence, when a depressed portion on the paper is overlaid with a region on the electrophotographic photosensitive member where toner development has been impeded, as produced by the abnormal electrical discharge, it is thought that a condition is established in which almost no toner is present on the paper and the occurrence of white spots in the halftone image is then particularly facilitated.

A description follows of the electrical discharge phenomenon between the electrophotographic photosensitive member and the charging member in the charging unit.

At the microgap in the vicinity of the abutment between the charging member and the electrophotographic photosensitive member, an electrical discharge is produced in the region where the relationship between the strength of the electric field and the microgap distance satisfies Paschel's Law.

When following a single point on the charging member surface with elapsed time during the electrophotographic process in which an electrical discharge is produced while the electrophotographic photosensitive member is being rotated, it is known that, from the electrical discharge starting point to end point, a plurality of electrical discharges are repeatedly produced rather than an electrical discharge being continuously produced.

With the charging member according to Japanese Patent Application Laid-open No. 2002-3651, it is thought that conduction paths capable of transporting charge are formed reaching from the outer surface of the support for the conductive member to the outer surface of the conductive member. As a consequence, the majority of the charge accumulated in the conductive layer is emitted by a single electrical discharge toward the body being charged, e.g., the photosensitive member or toner.

Here, the present inventors carried out detailed measurement and analysis, using an oscilloscope, of the circumstances of electrical discharge by the charging member according to Japanese Patent Application Laid-open No. 2002-3651. As a result, with the charging member according to Japanese Patent Application Laid-open No. 2002-3651, it was recognized that, as the process speed becomes faster, a so-called electrical discharge omission is produced, in which electrical discharge does not occur in a timing where electrical discharge should properly occur. With regard to the reason for the occurrence of the electrical discharge omission, it is thought to be due to a failure to achieve—after the consumption of the majority of charge accumulated within the conductive layer by an electrical discharge from the conductive member the accumulation of charge in the conductive layer for the next electric discharge.

In this regard, the present inventors examined the idea that the electrical discharge omission could be abolished if a large amount of charge could be accumulated in the conductive layer and the accumulated charge were not consumed all at once by one electrical discharge. As a result of additional extensive investigations based on this consideration, the discovery was made that a conductive member provided with the constitution according to the present disclosure can respond well to the aforementioned requirements.

Moreover, localized segregation of the charge is impeded by having at least 0.0027 of the dielectric loss tangent of the toner. As a consequence, the electrical discharge from the conductive member is stabilized and in combination with this the occurrence of abnormal electrical discharge from the untransferred toner to the electrophotographic photosensitive member is suppressed. As a result, the production of white spots in the halftone image is inhibited even in the case of halftone image formation at a fast process speed in a low-temperature, low-humidity environment.

The conductive member for the electrophotographic apparatus, process cartridge, and cartridge set is first described in the following in its role as the charging member contained by the charging unit; this is followed by a description of the toner.

Conductive Member

A conductive member having a roller configuration (also referred to herebelow as a "conductive roller") will be described with reference to FIG. 1 as an example of the conductive member. FIG. 1 is a diagram of a cross section orthogonal to the direction along the axis of the conductive roller (also referred to herebelow as the "longitudinal direction"). The conductive roller 51 has a cylindrical conductive support 52 and has a conductive layer 53 formed on the circumference of the support 52, i.e., on the outer surface of the support.

The Support

The material constituting the support can be a suitable selection from materials known in the field of conductive members for electrophotographic applications and materials that can be utilized as a conductive member. Examples here are metals and alloys such as aluminum, stainless steel, conductive synthetic resins, iron, copper alloys, and so forth.

An oxidation treatment or a plating treatment, e.g., with chromium, nickel, and so forth, may be executed on the preceding. Electroplating or electroless plating may be used as the plating mode. Electroless plating is preferred from the standpoint of dimensional stability. The type of electroless plating used here can be exemplified by nickel plating, copper plating, gold plating, and plating with various alloys.

The plating thickness is preferably at least 0.05 μm, and a plating thickness from 0.10 μm to 30.00 μm is preferred based on a consideration of the balance between production efficiency and anti-corrosion performance. The cylindrical shape of the support may be a solid cylindrical shape or a hollow cylindrical shape (tubular shape). The outer diameter of the support is preferably in the range from 3 mm to 10 mm.

When a medium-resistance layer or insulating layer is present between the support and the conductive layer, it may then not be possible to rapidly supply charge after charge has been consumed by electrical discharge. Thus, preferably either the conductive layer is directly disposed on the support or the conductive layer is disposed on the outer periphery of the support with only an interposed intermediate layer including a conductive thin-film resin layer, e.g., a primer.

A selection from known primers, in conformity with, e.g., the material of the support and the rubber material used to form the conductive layer, can be used as this primer. The material of the primer can be exemplified by thermosetting resins and thermoplastic resins, and known materials such as phenolic resins, urethane resins, acrylic resins, polyester resins, polyether resins, and epoxy resins can specifically be used.

The Conductive Layer

The conductive layer includes a matrix and a plurality of domains dispersed in the matrix. In addition, the matrix contains a first rubber and the domains contain a second rubber and an electronic conducting agent. The matrix and the domains satisfy the following component factors (i) and (ii).

component factor (i): The volume resistivity R1 of the matrix is greater than $1.00\times10^{12}$ Ω·cm.

component factor (ii): The volume resistivity R2 of the domains is smaller than the volume resistivity R1 of the matrix.

A conductive member provided with a conductive layer that satisfies component factors (i) and (ii) can accumulate satisfactory charge at the individual domains when a bias is applied with the photosensitive member, and in addition can inhibit simultaneous charge transfer between domains. As a consequence of this, the emission in a single electrical discharge of the majority of the charge accumulated within the conductive layer can be prevented.

As a result, a state can be set up within the conductive layer in which charge for the next electrical discharge is still accumulated, and due to this a stable electrical discharge can be produced on a short cycle. Such an electrical discharge achieved by the conductive member according to the present disclosure is also referred to as a "microdischarge" in the following.

When a charging bias is applied between the support in the conductive member having the conductive layer that satisfies component factors (i) and (ii), and the electrophotographic photosensitive member, it is thought that within the conductive layer the charge migrates, proceeding as described in the following, to the side of the conductive layer opposite from the support side, i.e., to the outer surface side of the conductive member. That is, the charge accumulates in the neighborhood of the matrix/domain interface.

In addition, this charge successively transfers from the domains located on the side of the conductive support to the domains on the side opposite from the side of the conductive support, to reach the conductive layer surface (also referred to hereafter as the "outer surface of the conductive layer") on the side opposite from the side of the conductive support. When this occurs, and when, in a first charging process, the charge on all the domains has transferred to the outer surface side of the conductive layer, time is required for charge to accumulate in the conductive layer for the next charging process. It is thus difficult for a stable electrical discharge to be achieved in a high-speed electrophotographic image-forming process.

Accordingly, even when a charging bias has been applied, preferably charge transfer between domains does not occur simultaneously. In addition, since, in a high-speed electrophotographic image-forming process, charge movement is limited, preferably a satisfactory amount of charge is accumulated at each domain to bring about the discharge of a satisfactory amount of charge in a single electrical discharge.

A conductive layer provided with a matrix-domain structure that fulfills these component factors (i) and (ii) can suppress the occurrence of simultaneous charge transfer between domains during the application of a bias and can accumulate adequate charge within the domains.

Component Factor (i): Matrix Volume Resistivity

By having the volume resistivity R1 of the matrix be greater than $1.00\times10^{12}$ Ω·cm, the movement of charge in the matrix while circumventing the domains can be suppressed. In addition, consumption of the majority of accumulated charge by a single electrical discharge can be suppressed. Moreover, this can prevent the charge accumulated in the domains, through its leakage into the matrix, from providing a condition as if conduction pathways that communicate within the conduction layer were to be formed.

The volume resistivity R1 is preferably at least $2.00\times10^{12}$ Ω·cm. The upper limit on R1, on the other hand, is not particularly limited, but as a guide not more than $1.00\times10^{17}$ Ω·cm is preferred and not more than $8.00\times10^{16}$ Ω·cm is more preferred.

The present inventors believe that a structure in which regions where charge is satisfactorily accumulated (domains) are partitioned off by an electrically insulating region (matrix), is effective for bringing about charge transfer via the domains in the conductive layer and achieving microdischarge. In addition, by having the matrix volume resistivity be in the range of a high-resistance region as indicated above, adequate charge can be kept at the interface with each domain and charge leakage from the domains can also be suppressed.

In addition, in order for the electrical discharge to achieve a level of electrical discharge that is necessary and sufficient and a microdischarge, it is very effective to limit the charge transfer pathways to domain-mediated pathways. By suppressing charge leakage from the domains into the matrix and limiting the charge transport pathways to pathways that proceed via a plurality of domains, the density of the charge present on the domains can be boosted and due to this the amount of charge loaded at each domain can be further increased.

It is thought that this supports an increase, at the surface of the domains in their role as a conductive phase that is the source of the electrical discharge, in the overall charge population able to participate in electrical discharge, and that as a result the ease of electrical discharge elaboration from the surface of the conductive member can be enhanced.

Method for Measuring the Volume Resistivity of the Matrix:

The volume resistivity of the matrix can be measured with microprobes on thin sections prepared from the conductive layer. A means that can produce a very thin sample, such as a microtome, can be used as the means for preparing the thin sections. The specific procedure is described below.

Component Factor (ii): Domain Volume Resistivity

The volume resistivity R2 of the domains is less than the volume resistivity R1 of the matrix. This facilitates restricting the charge transport pathways to pathways via a plurality of domains, while suppressing unwanted charge transport by the matrix.

The volume resistivity R1 is preferably at least $1.0\times10^{5}$-times the volume resistivity R2. R1 is more preferably $1.0\times10^{5}$-times to $1.0\times10^{20}$-times R2, still more preferably $1.0\times10^{6}$-times to $1.0\times10^{18}$-times R2, and even more preferably $9.0\times10^{6}$-times to $1.0\times10^{16}$-times R2.

In addition, R2 is preferably from $1.00\times10^{1}$ Ω·cm to $1.00\times10^{4}$ Ω·cm and more preferably from $1.00\times10^{1}$ Ω·cm to $1.00\times10^{2}$ Ω·cm.

By satisfying the preceding, the charge transport paths within the conductive layer can be controlled and a microdischarge is more easily achieved. Due to this, not only can an improvement be brought about in the uniformity of the halftone image in low-temperature, low-humidity environments, but the halftone image uniformity can also be improved in the case of use in a very low-temperature, low-humidity environment (temperature of 7° C., humidity of 30% RH), which is an even more demanding environment.

The volume resistivity of the domains is adjusted, for example, by bringing the conductivity of the rubber component of the domains to a prescribed value by changing the type and amount of the electronic conductive agent.

A rubber composition containing a rubber component for use for the matrix can be used as the rubber material for the domains. In order to form a matrix-domain structure, the difference in the solubility parameter (SP value) from the rubber material forming the matrix is preferably brought into a prescribed range. That is, the absolute value of the difference between the SP value of the first rubber and the SP value of the second rubber is preferably from 0.4 $(J/cm^3)^{0.5}$ to 5.0 $(J/cm^3)^{0.5}$ and more preferably from 0.4 $(J/cm^3)^{0.5}$ to 2.2 $(J/cm^3)^{0.5}$.

The domain volume resistivity can be adjusted through judicious selection of the type of electronic conducting agent and its amount of addition. With regard to the electronic conducting agent used to control the domain volume resistivity to from $1.00\times10^{1}$ Ω·cm to $1.00\times10^{4}$ Ω·cm, preferred electronic conducting agents are those that can bring about large variations in the volume resistivity, from a high resistance to a low resistance, as a function of the amount that is dispersed.

The electronic conducting agent blended in the domains can be exemplified by carbon black; graphite; oxides such as titanium oxide, tin oxide, and so forth; metals such as Cu, Ag, and so forth; and particles rendered conductive by coating the surface with an oxide or metal. As necessary, a blend of suitable quantities of two or more of these conducting agents may be used.

Among these electronic conducting agents, the use is preferred of conductive carbon black, which has a high affinity for rubber and supports facile control of the electronic conducting agent-to-electronic conducting agent distance. There are no particular limits on the type of carbon black blended into the domains. Specific examples are gas furnace black, oil furnace black, thermal black, lamp black, acetylene black, and Ketjenblack.

Among the preceding, a conductive carbon black having a DBP absorption from 40 $cm^3$/100 g to 170 $cm^3$/100 g, which can impart a high conductivity to the domains, can be favorably used.

The content of the electronic conducting agent, e.g., conductive carbon black, is preferably from 20 mass parts to 150 mass parts per 100 mass parts of the second rubber contained in the domains. From 50 mass parts to 100 mass parts is more preferred.

The conducting agent is preferably blended in larger amounts than for ordinary electrophotographic conductive members. Doing this makes it possible to easily control the volume resistivity of the domains into the range from $1.00\times10^{1}$ Ω·cm to $1.00\times10^{4}$ Ω·cm.

The fillers, processing aids, co-crosslinking agents, crosslinking accelerators, ageing inhibitors, crosslinking co-accelerators, crosslinking retarders, softeners, dispersing agents, colorants, and so forth that are ordinarily used as rubber blending agents may as necessary be added to the rubber composition for the domains within a range in which the effects according to the present disclosure are not impaired.

Method for Measuring the Volume Resistivity of the Domains:

Measurement of the volume resistivity of the domains may be carried out using the same method as the method for measuring the volume resistivity of the matrix, but changing the measurement location to a location corresponding to a domain and changing the voltage applied during measurement of the current value to 1 V. The specific procedure is described below.

Component Factor (iii): Distance Between Adjacent Walls of the Domains>

From the standpoint of bringing about charge transfer between domains, the arithmetic-mean value Dm of the distance between adjacent walls of the domains (also referred to herebelow simply as the "interdomain distance Dm"), in observation of the cross section in the thickness direction of the conductive layer, is preferably not more than 2.00 μm and more preferably not more than 1.00 μm.

In addition, in order for the domains to be securely electrically partitioned from one another by an insulating region (matrix) and enable charge to be readily accumulated by the domains, the interdomain distance Dm is preferably at least 0.15 μm and more preferably at least 0.20 μm.

Method for Measuring the Interdomain Distance Dm:

Measurement of the interdomain distance Dm may be carried out using the following method.

First, a section is prepared using the same method as the method used in measurement of the volume resistivity of the matrix, supra. In order to favorably carry out observation of the matrix-domain structure, a pretreatment that provides good contrast between the conductive phase and insulating phase may be carried out, e.g., a staining treatment, vapor deposition treatment, and so forth.

The presence of a matrix-domain structure is checked by observation using a scanning electron microscope (SEM) of the section after formation of a fracture surface and platinum vapor deposition. The SEM observation is preferably carried out at 5,000× from the standpoint of the accuracy of quantification of the domain area. The specific procedure is described below.

Uniformity of the Interdomain Distance Dm:

The interdomain distance Dm preferably has a uniform distribution in order to enable the formation of a more stable microdischarge. Having a uniform distribution for the interdomain distance Dm makes it possible to reduce phenomena that impair the ease of electrical discharge elaboration, e.g., the occurrence of locations where charge supply is delayed relative to the surroundings due to the presence to some degree of locations within the conductive layer where the interdomain distance is locally longer.

Figure 3A:
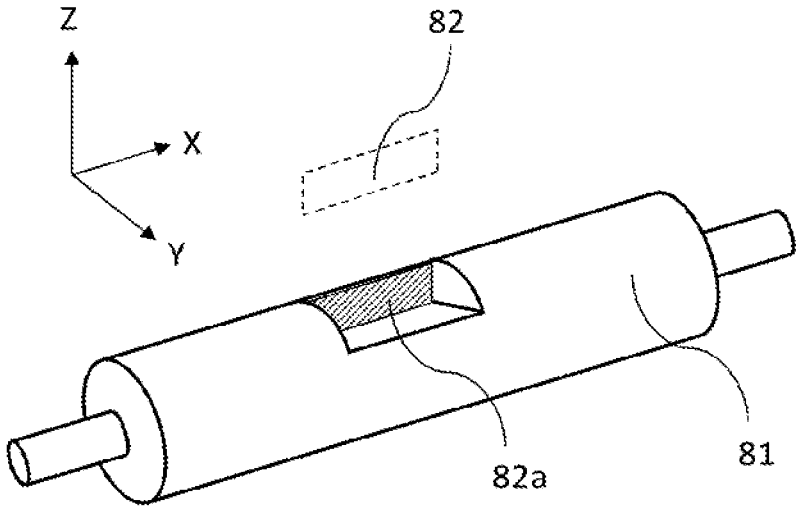
FIGS. 3A and 3B are explanatory diagrams of a charging roller for the direction of cross section excision from the conductive layer.
Figure 3B:
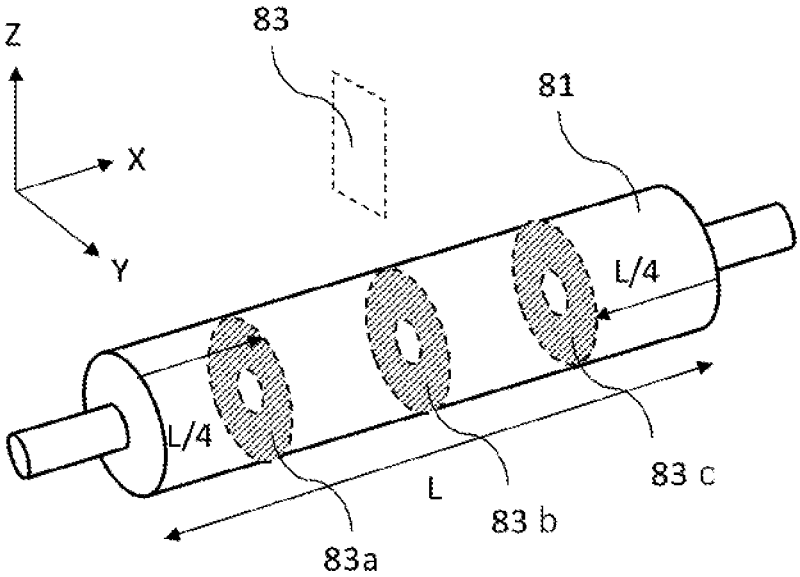

Operating in the charge transport cross section, i.e., the cross section in the thickness direction of the conductive layer as shown in FIG. 3B, a 50 μm-square region of observation is taken at three randomly selected locations in the thickness region at a depth of 0.1 T to 0.9 T from the outer surface of the conductive layer in the direction of the support. In this case, and using the interdomain distance Dm within these regions of observation and the standard deviation σm of the distribution of the interdomain distance, the variation coefficient σm/Dm for the interdomain distance is preferably from 0 to 0.40 and is more preferably from 0.10 to 0.30.

Method for Measuring the Uniformity of the Interdomain Distance Dm:

The uniformity of the interdomain distance can be measured by quantification of the image obtained by direct observation of the fracture surface as in the measurement of the interdomain distance. The specific procedure is described below.

The conductive member can be formed, for example, via a method including the following steps (i) to (iv):

step (i): a step of preparing a domain-forming rubber mixture (also referred to hereafter as "CMB") containing carbon black and a second rubber;

step (ii): a step of preparing a matrix-forming rubber mixture (also referred to hereafter as "MRC") containing a first rubber;

step (iii): a step of preparing a rubber mixture having a matrix-domain structure by kneading the CMB with the MRC; and step (iv): a step of forming a conductive layer by forming a layer of the rubber mixture prepared in step (iii) on a conductive support, either directly thereon or via another layer, and curing the rubber mixture layer.

Component factors (i) to (iii) can be controlled, for example, through the selection of the materials used in the individual steps described above and through adjustment of the production conditions. This is described in the following.

First, with regard to component factor (i), the volume resistivity of the matrix is governed by the composition of the MRC.

Low-conductivity rubbers are preferred for the first rubber that is used in the MRC. At least one selection from the group consisting of natural rubber, butadiene rubber, butyl rubber, acrylonitrile-butadiene rubber, urethane rubber, silicone rubber, fluorocarbon rubber, isoprene rubber, chloroprene rubber, styrene-butadiene rubber, ethylene-propylene rubber, ethylene-propylene-diene rubber, and polynorbornene rubber is preferred.

The first rubber is more preferably at least one selection from the group consisting of butyl rubber, styrene-butadiene rubber, and ethylene-propylene-diene rubber.

The following may be added to the MRC on an optional basis as long as the volume resistivity of the matrix is in the range given above: fillers, processing aids, crosslinking agents, co-crosslinking agents, crosslinking accelerators, crosslinking co-accelerators, crosslinking retarders, ageing inhibitors, softeners, dispersing agents, colorants, and so forth. On the other hand, in order to bring the matrix volume resistivity into the range indicated above, an electronic conducting agent, e.g., carbon black, is preferably not incorporated in the MRC.

In relation to component factor (ii), the domain volume resistivity R2 can be adjusted using the amount of the electronic conducting agent in the CMB. For example, considering the example of the use as the electronic conducting agent of a conductive carbon black having a DBP absorption of from 40 $cm^3$/100 g to 170 $cm^3$/100 g, the desired range can be achieved by preparing a CMB that contains from 40 mass parts to 200 mass parts of the conductive carbon black per 100 mass parts of the second rubber in the CMB.

In addition, controlling the following (a) to (d) is effective with regard to the state of domain dispersion in relation to component factor (iii):

(a) the difference between the interfacial tensions σ of the CMB and the MRC;

(b) the ratio between the viscosity of the MRC (ηm) and the viscosity of the CMB (ηd) (ηm/ηd);

(c) the shear rate (γ) and the amount of energy during shear (EDK) when the CMB and the MRC are kneaded in step (iii); and (d) the volume fraction of the CMB relative to the MRC in step (iii).

(a) The Difference in Interfacial Tension Between the CMB and the MRC

Phase separation generally occurs when two species of incompatible rubbers are mixed. This occurs because the interaction between the same species of polymer molecules is stronger than the interaction between different species of polymer molecules, resulting in aggregation between the same species of polymer molecules, a reduction in free energy, and stabilization.

The interface in a phase-separated structure, due to contact with a different species of polymer molecules, assumes a higher free energy than the interior, which is stabilized by the interaction between polymer molecules of the same species. As a result, in order to lower the interfacial free energy, an interfacial tension occurs directed to reducing the area of contact with the different species of polymer molecules. When this interfacial tension is small, this moves in the direction of a more uniform mixing, even by different species of polymer molecules, to increase the entropy. A uniformly mixed state is dissolution, and there is a tendency for the interfacial tension to correlate with the SP value (solubility parameter), which is a metric for solubility.

Thus, the difference in interfacial tension between the CMB and the MRC is thought to correlate with the difference in the SP values of the rubbers contained by each. Rubbers are preferably selected whereby the absolute value of the difference between the solubility parameter SP value of the first rubber in the MRC and the SP value of the second rubber in the CMB is preferably from 0.4 $(J/cm^3)^{0.5}$ to 5.0 $(J/cm^3)^{0.5}$ and is more preferably from 0.4 $(J/cm^3)^{0.5}$ to 2.2 $(J/cm^3)^{0.5}$. Within this range, a stable phase-separated structure can be formed and a small CMB domain diameter can be established.

Specific preferred examples of second rubbers that can be used in the CMB here are, for example, at least one selection from the group consisting of natural rubber (NR), isoprene rubber (IR), butadiene rubber (BR), acrylonitrile-butadiene rubber (NBR), styrene-butadiene rubber (SBR), butyl rubber (IIR), ethylene-propylene rubber (EPM), ethylene-propylene-diene rubber (EPDM), chloroprene rubber (CR), nitrile rubber (NBR), hydrogenated nitrile rubber (H-NBR), silicone rubber, and urethane rubber (U).

The second rubber is more preferably at least one selection from the group consisting of styrene-butadiene rubber (SBR), butyl rubber (IIR), and acrylonitrile-butadiene rubber (NBR) and is still more preferably at least one selection from the group consisting of styrene-butadiene rubber (SBR), and butyl rubber (IIR).

The thickness of the conductive layer is not particularly limited as long as the desired functions and effects are obtained for the conductive member. The thickness of the conductive layer is preferably from 1.0 mm to 4.5 mm.

The mass ratio between the domains and the matrix (domain:matrix) is preferably 5:95 to 40:60, more preferably 10:90 to 30:70, and still more preferably 13:87 to 25:75.

Method for Measuring the SP Value

The SP value can be determined with good accuracy by constructing a calibration curve using materials having already known SP values. Catalogue values provided by the material manufacturers may also be used as these already known SP values. For example, for NBR and SBR, the SP value is almost entirely determined by the content ratio for the acrylonitrile and styrene independently of the molecular weight.

Accordingly, the content ratio for acrylonitrile or styrene for the rubber constituting the matrix and domains is analyzed using an analytic procedure, e.g., pyrolysis gas chromatography (Py-GC) and solid-state NMR. By doing this, the SP value can be determined from a calibration curve obtained from materials for which the SP value is already known.

In addition, with an isoprene rubber, the SP value is governed by the isomer structure, e.g., 1,2-polyisoprene, 1,3-polyisoprene, 3,4-polyisoprene, cis-1,4-polyisoprene, trans-1,4-polyisoprene, and so forth. Thus, the isomer content ratio is analyzed using, e.g., Py-GC and solid-state NMR, as for SBR and NBR and the SP value can be determined from materials for which the SP value is already known.

The SP values of materials having already known SP values are determined using the Hansen sphere method.

(b) Viscosity Ratio Between the CMB and the MRC

The domain diameter declines as the viscosity ratio between the CMB and the MRC (CMB/MRC) ($\eta d/\eta m$) approaches 1. Specifically, this viscosity ratio is preferably from 1.0 to 2.0. The viscosity ratio between the CMB and the MRC can be adjusted through selection of the Mooney viscosity of the starting rubbers used for the CMB and the MRC and through the filler type and its amount of incorporation.

A plasticizer, e.g., paraffin oil, may also be added to the extent this does not hinder the formation of a phase-separated structure. The viscosity ratio may also be adjusted by adjusting the temperature during kneading.

The viscosity of the rubber mixture for domain formation and the viscosity of the rubber mixture for matrix formation are obtained by measurement of the Mooney viscosity $ML_{(1+4)}$ based on JIS K 6300-1: 2013; the measurement is performed at the temperature of the rubber during kneading.

(c) The Shear Rate and the Amount of Energy During Shear when the CMB is Kneaded with the MRC The interdomain distance Dm and Dms become smaller as the shear rate during kneading of the CMB with the MRC becomes faster and as the amount of energy during shear becomes larger.

The shear rate can be increased by increasing the inner diameter of the stirring members of the kneader, i.e., the blades and screw, to reduce the gap between the end face of the stirring members and the inner wall of the kneader, and by raising the rotation rate. An increase in the energy during shear can be achieved by raising the rotation rate of the stirring members and raising the viscosity of the first rubber in the CMB and the second rubber in the MRC.

(d) Volume Fraction of the CMB Relative to the MRC

The volume fraction of the CMB relative to the MRC correlates with the collisional coalescence probability for the domain-forming rubber mixture relative to the matrix-forming rubber mixture. Specifically, when the volume fraction of the domain-forming rubber mixture relative to the matrix-forming rubber mixture is reduced, the collisional coalescence probability for the domain-forming rubber mixture and matrix-forming rubber mixture declines. Thus, the interdomain distance Dm and Dms can be made smaller by lowering the volume fraction of the domains in the matrix in the range in which the required conductivity is obtained.

The volume ratio of the CMB relative to the MRC (that is, the volume ratio of the domains to the matrix) is preferably from 15% to 40%.

Using L for the length in the longitudinal direction of the conductive layer in the conductive member and using T for the thickness of this conductive layer, cross sections in the thickness direction of the conductive layer are acquired, as shown in FIG. 3B, at three locations, i.e., at the center in the longitudinal direction of the conductive layer and at L/4 toward the center from both ends of the conductive layer. The following are preferably satisfied at each of the thickness direction cross sections in the conductive layer.

At each of these cross sections, a 15 μm-square region of observation is set up at three randomly selected locations in the thickness region at a depth of 0.1 T to 0.9 T from the outer surface of the conductive layer, and preferably at least 80 number % of the domains observed at each of all nine regions of observation satisfies the following component factors (iv) and (v).

Component Factor (iv)

The percentage gr for the cross-sectional area of the electronic conducting agent present in a domain with respect to the cross-sectional area of the domain is at least 20%.

Component Factor (v)

A/B is from 1.00 to 1.10 where A is the periphery length of the domain and B is the envelope periphery length of the domain.

Component factors (iv) and (v) can be regarded as specifications related to domain shape. This "domain shape" is defined as the cross-sectional shape of the domain visualized in the cross section in the thickness direction of the conductive layer.

The domain shape is preferably a shape that lacks unevenness in its peripheral surface, i.e., is a shape approximating a sphere. Reducing the number of uneven structures associated with the shape can reduce nonuniformity of the electric field between domains, i.e., can reduce locations where electric field concentration is produced and can reduce the phenomenon of the occurrence of unwanted charge transport in the matrix.

The present inventors have found that the amount of electronic conducting agent contained in one domain exercises an effect on the external shape of that domain. That is, it was found that, as the amount of loading of one domain with the electronic conducting agent increases, the external shape of that domain becomes closer to that of a sphere. A larger number of near-spherical domains results in ever fewer concentration points for electron transfer between domains.

Moreover, according to investigations by the present inventors, a near-spherical shape is better assumed by domains for which the total percentage μr, with reference to the area of the cross section of one domain, for the cross-sectional area of the electronic conducting agent observed in that cross section is at least 20%.

As a result, an external shape can be assumed that can significantly relax the concentration of electron transfer between domains, and this is thus preferred. Specifically, the percentage μr, with reference to the area of the cross section of a domain, for the cross-sectional area of the electronic conducting agent present in that domain is preferably at least 20%. 25% to 30% is more preferred.

A satisfactory amount of charge supply is made possible, even in high-speed processes, by satisfying the aforementioned range.

The present inventors discovered that the following formula (5) is preferably satisfied in relation to a shape that lacks unevenness on the peripheral surface of the domain.

$$1.00 \leq A/B \leq 1.10 \quad (5)$$

(A: periphery length of domain, B: envelope periphery length of domain)

Figure 6:
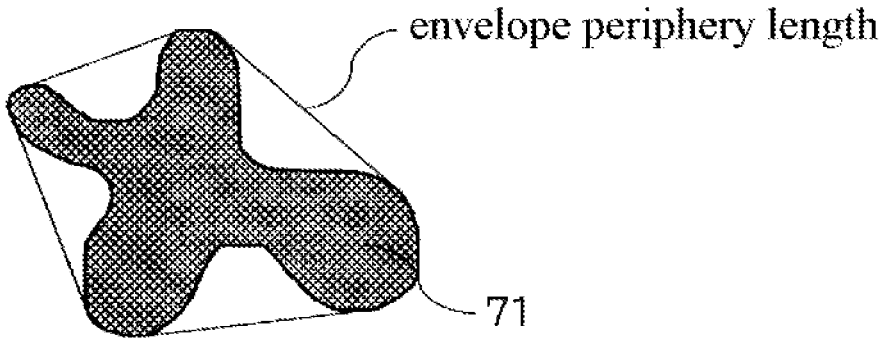
FIG. 6 is an explanatory diagram of the envelope periphery length of a domain.

Formula (5) indicates the ratio between the domain periphery length A and the domain envelope periphery length B. The envelope periphery length here is the periphery length, as shown in FIG. 6, when the protruded portions of a domain 71 observed in a region of observation are connected.

The ratio between the domain periphery length and domain envelope periphery length has a minimum value of 1, and a value of 1 indicates that the domain has a shape that lacks depressed portions in its cross-sectional shape, e.g., a perfect circle, ellipse, and so forth. When this ratio is equal to or less than 1.1, this indicates that large uneven shapes are not present in the domain and the expression of electric field anisotropy is suppressed.

Method for Measuring Each of the Parameters Related to Domain Shape

An ultrathin section having a thickness of 1 μm is sectioned out at an excision temperature of −100° C. from the conductive layer of the conductive member (conductive roller) using a microtome (product name: Leica EMFCS, Leica Microsystems GmbH). However, as indicated in the following, evaluation of the domain shape must be carried out on the fracture surface of a section prepared using a cross section orthogonal to the longitudinal direction of the conductive member. The reason for this is as follows.

FIG. 3A and FIG. 3B give diagrams that show the shape of a conductive member 81 using three axes and specifically the X, Y, and Z axes in three dimensions. The X axis in FIG. 3A and FIG. 3B shows the direction parallel to the longitudinal direction (axial direction) of the conductive member, and the Y axis and Z axis show the directions orthogonal to the axial direction of the conductive member.

FIG. 3A shows an image diagram for a conductive member, in which the conductive member has been cut out at a cross section 82*a* that is parallel to the XZ plane 82. The XZ plane can be rotated 360° centered on the axis of the conductive member. Considering that the conductive member rotates abutting a photosensitive drum and discharges upon the passage of a gap with the photosensitive drum, the cross section 82*a* parallel to the XZ plane 82 thus indicates a plane where discharge occurs simultaneously with a certain timing. The surface potential of the photosensitive drum is formed by the passage of a plane corresponding to a certain portion of the cross section 82*a*.

Accordingly, in order to evaluate the domain shape, which correlates with concentration of the electric field within the conductive member, rather than analysis of a cross section where discharge occurs simultaneously in a certain instant such as the cross section 82*a*, evaluation is required at a cross section parallel to the YZ plane 83 orthogonal to the axial direction of the conductive member, which enables evaluation of a domain shape that contains a certain portion of the cross section 82*a*.

Using L for the length of the conductive layer in the longitudinal direction, a total of three locations are selected for this evaluation, i.e., the cross section 83*b* at the center in the longitudinal direction of the conductive layer and cross sections (83*a* and 83*c*) at two positions that are L/4 toward the center from either end of the conductive layer.

In addition, in relation to the location of observation in cross sections 83*a* to 83*c* and using T for the thickness of the conductive layer, the measurement should be carried out at a total of nine regions of observation wherein a 15 μm-square region of observation is taken at three randomly selected locations in the thickness region at a depth of 0.1 T to 0.9 T from the outer surface of each section.

Vapor-deposited sections are obtained by executing platinum vapor deposition on the obtained sections. The surface of the vapor-deposited section is then magnified 1,000× or 5,000× using a scanning electron microscope (SEM) (product name: S-4800, Hitachi High-Technologies Corporation) and an observation image is acquired.

In order to quantify the domain shapes in this analysis image, a 256-gradation monochrome image is then obtained by carrying out 8-bit grey scale conversion using image processing software (product name: Image-Pro Plus, Media Cybernetics, Inc.). White/black reversal processing is subsequently carried out on the image so the domains in the fracture surface become white and a binarized image is obtained.

Method for Measuring the Cross-Sectional Area Percentage μr for the Electronic Conducting Agent in the Domain The cross-sectional area percentage for the electronic conducting agent in a domain can be measured by quantification of the binarized image of the aforementioned observation image that has been magnified 5,000×.

A 256-gradation monochrome image is obtained by carrying out 8-bit grey scale conversion using image processing software (product name: Image-Pro Plus, Media Cybernetics, Inc.). A binarized image is obtained by binarizing the observation image so as to enable differentiation of the carbon black particles. The following are determined using the count function on the obtained image: the cross-sectional area S of the domains within the analysis image and the total cross-sectional area Sc of the carbon black particles, i.e., the electronic conducting agent, present in the domains.

The arithmetic-mean value gr of Sc/S at the nine locations is calculated to give the cross-sectional area percentage for the electronic conductive material in the domains.

Method for Measuring the Periphery Length a and the Envelope Periphery Length B of the Domains Using the count function of the image processing software, the following items are determined on the domain population present in the binarized image of the aforementioned observation image that had been magnified 1,000×.

periphery length A (μm)

envelope periphery length B (μm)

These values are substituted into the following formula (5), and the arithmetic-mean value for the evaluation images at the nine locations is used.

$$1.00 \leq A/B \leq 1.10 \quad (5)$$

(A: periphery length of domain, B: envelope periphery length of domain)

Method for Measuring the Domain Shape Index

The domain shape index may be determined as the number percentage, with reference to the total number of domains, for the domain population that has a μr (area %) of at least 20% and a domain periphery length ratio AB that satisfies the preceding formula (5). The domain shape index is preferably from 80 number % to 100 number %.

Using the count function of the image processing software (product name: Image-Pro Plus, Media Cybernetics, Inc.) on the binarized image described above, the size of the domain population within the binarized image is determined and the number percentage of the domains that satisfy μr≥20 and the preceding formula (5) may also be acquired.

By implementing a high density loading by the electronic conducting agent in a domain, as stipulated by component factor (iv), the external shape of the domain can be brought close to that of a sphere, and a low unevenness as stipulated in component factor (v) can also be established.

In order to obtain domains densely loaded with the electronic conducting agent, as stipulated by component factor (iv), the electronic conducting agent preferably has carbon black having a DBP absorption from 40 $cm^3$/100 g to 80 $cm^3$/100 g.

The DBP absorption ($cm^3$/100 g) is the volume of dibutyl phthalate (DBP) that can be absorbed by 100 g of a carbon black and is measured in accordance with Japanese Industrial Standard (JIS) K 6217-4: 2017 (Carbon black for rubber industry—Fundamental characteristics—Part 4: Determination of oil absorption number (including compressed samples)).

Carbon blacks generally have a floc-like higher-order structure in which primary particles having an average particle diameter from 10 nm to 50 nm are aggregated. This floc-like higher-order structure is referred to as "structure", and its extent is quantified by the DBP absorption ($cm^3$/100 g).

A conductive carbon black having a DBP absorption in the indicated range has an undeveloped level of structure, and due to this there is little aggregation of the carbon black and the dispersibility in rubber is excellent. As a consequence, a high loading level in the domains can be achieved, and as a result domains having an external shape more nearly approaching spherical are readily obtained.

In addition, a conductive carbon black having a DBP absorption in the indicated range is resistant to aggregate formation, and as a consequence the formation of domains according to factor (v) is facilitated.

The Domain Diameter D

The arithmetic-mean value of the circle-equivalent diameter D (also referred to herebelow simply as the "domain diameter D") of the domains observed in the cross section of the conductive layer is preferably from 0.10 μm to 5.00 μm.

When this range is adopted, the surfacemost domains assume a size equal to or less than that of the toner, and as a result a fine electrical discharge is made possible and achieving a uniform electrical discharge is facilitated.

By having the average value of the domain diameter D be at least 0.10 μm, the charge movement pathways in the conductive layer can be more effectively limited to the desired pathways. At least 0.15 μm is more preferred, and at least 0.20 μm is still more preferred.

By having the average value of the domain diameter D be not more than 5.00 μm, the proportion of the domain surface area to its total volume, i.e., the domain specific surface area, can be exponentially increased and the efficiency of charge discharge from the domains can be very substantially increased. For this reason, the average value of the domain diameter D is preferably not more than 2.00 μm and is more preferably not more than 1.00 μm.

By having the average value of the domain diameter D be not more than 2.00 μm, the electrical resistance of the domain itself can be reduced and due to this the amount of the single-event electrical discharge is brought to the necessary and sufficient amount and a more efficient microdischarge is made possible. Therefore, a halftone uniformity in low-temperature, low-humidity environments can be improved.

Viewed from the standpoint of pursuing further reductions in electric field concentration between domains, the external shape of the domains preferably more nearly approaches that of a sphere. Due to this, smaller domain diameters within the aforementioned range are preferred. The method for this can be exemplified by kneading the MRC with the CMB in step (iv) to induce phase separation between the MRC and the CMB. Another exemplary method is to exercise control, in the step of preparing a rubber mixture in which CMB domains are formed in the MRC matrix, so as to provide a small CMB domain diameter.

By providing a small CMB domain diameter, the specific surface area of the CMB is increased and the interface with the matrix is enlarged, and due to this a tension acts directed to reducing the tension at the interface of the CMB domain. As a result, the external shape of the CMB domain more nearly approaches that of a sphere.

Taylor's formula (formula (6)), Wu's empirical formulas (formulas (7) and (8)), and Tokita's formula (formula (9)) are known with regard to the factors that govern the domain diameter in a matrix-domain structure formed when two species of incompatible polymers are melt-kneaded.

Taylor's formula $$D=[C\cdot\sigma/\eta m\cdot\gamma]\cdot f(\eta m/\eta d) \quad (6)$$

Wu's empirical formulas $$\gamma\cdot D\cdot\eta m/\sigma=4(\eta d/\eta m)0.84\cdot\eta d/\eta m>1 \quad (7)$$

$$\gamma\cdot D\cdot\eta m/\sigma=4(\eta d/\eta m)-0.84\cdot\eta d/\eta m<1 \quad (8)$$

Tokita's formula $$D=12\cdot P\cdot\sigma\cdot\phi/(\pi\cdot\eta\cdot\gamma)\cdot(1+4\cdot P\cdot\phi\cdot EDK/(\pi\cdot\eta\cdot\gamma)) \quad (9)$$

In formulas (6) to (9), D represents the maximum Feret diameter of the CMB domains; C represents a constant; σ represents interfacial tension; ηm represents the viscosity of the matrix; ηd represents the viscosity of the domains; γ represents the shear rate; η represents the viscosity of the mixed system; P represents the collisional coalescence probability; ϕ represents the domain phase volume; and EDK represents the domain phase severance energy.

In order, in relation to component factor (iii), to provide a uniform interdomain distance, it is effective to provide a small domain diameter in accordance with formulas (6) to (9). In addition, in the process, during the step of kneading the MRC with the CMB, of dividing up the starting rubber for the domains and gradually reducing the particle diameter thereof, the interdomain distance also varies depending on when the kneading step is halted.

Accordingly, the uniformity of the interdomain distance can be controlled using the kneading time in the kneading step and using the kneading rotation rate, which is an index for the intensity of this kneading, and the uniformity of the interdomain distance can be enhanced using a longer kneading time and a larger kneading rotation rate.

Uniformity of the Domain Diameter D:

The domain diameter D is preferably uniform and thus the particle size distribution is preferably narrow. By having a uniform distribution for the domain diameter D traversed by the charge in the conductive layer, charge concentration within the matrix-domain structure is suppressed and the ease of emanation of the electric discharge over the entire surface of the conductive member can be effectively increased.

When, operating in the charge transport cross section, i.e., the cross section in the thickness direction of the conductive layer as shown in FIG. 3B, a 50 μm-square region of observation is taken at three randomly selected locations in the thickness region at a depth of 0.1 T to 0.9 T from the outer surface of the conductive layer in the direction of the support, the σd/D ratio for the standard deviation ad of the domain diameter and the arithmetic-mean value D of the domain diameter (variation coefficient σd/D) is preferably from 0 to 0.40 and is more preferably from 0.10 to 0.30.

To bring about a better uniformity of the domain diameter, the uniformity of the domain diameter is also enhanced when a small domain diameter is established in accordance with formulas (6) to (9), which is equivalent to the aforementioned procedure for enhancing the uniformity of the interdomain distance. Moreover, in the process, during the step of kneading the MRC with the CMB, of dividing up the starting rubber for the domains and gradually reducing the particle diameter thereof, the uniformity of the domain diameter also varies depending on when the kneading step is halted.

Accordingly, the uniformity of the domain diameter can be controlled using the kneading time in the kneading step and using the kneading rotation rate, which is an index for the intensity of this kneading, and the uniformity of the domain diameter can be enhanced using a longer kneading time and a larger kneading rotation rate.

Method for Measuring the Uniformity of the Domain Diameter

The uniformity of the domain diameter can be measured by quantification of the image obtained by direct observation of the fracture surface, which is obtained by the same method for measurement of the uniformity of the interdomain distance as described above. The specific procedure is described below.

Method for Confirming the Matrix-Domain Structure

The presence of a matrix-domain structure in the conductive layer can be confirmed by preparing a thin section of the conductive layer and carrying out a detailed observation of the fracture surface formed on the thin section. The specific procedure is described below.

Toner

The toner is described in the following.

Dielectric Loss Tangent of Toner

The toner has a dielectric loss tangent tan δ of at least 0.0027. The dielectric loss tangent tan δ is an indicator that shows the degree of electrical energy loss in a dielectric, and has the property that charge flows and escapes more easily at larger values.

When the dielectric loss tangent of the toner is at least 0.0027 and the conductive member has the prescribed constitution as described in the preceding, the toner attached to the conductive member does not locally accumulate charge even when subjected to an electrical discharge. Due to this, the occurrence of abnormal electrical discharge from untransferred toner to the electrophotographic photosensitive member can be suppressed and the occurrence of white spots in the halftone image can be prevented.

The dielectric loss tangent of the toner is preferably at least 0.0035, more preferably at least 0.0037, and still more preferably at least 0.0040. The upper limit on the dielectric loss tangent is not particularly limited, but is preferably not more than 0.0100 and more preferably not more than 0.0080.

The dielectric loss tangent of the toner is the value measured at a frequency of $1.0\times10^3$ Hz. As a result of intensive investigations, the present inventors discovered that the dielectric loss tangent in this frequency band is a parameter that correlates with the uniformity of the halftone density in a high-speed process in a low-temperature, low-humidity environment.

It is thought that this is due—in view of the process speed used in a high-speed process being at least 300 mm/sec and the nip width where the charging member is in contact with the electrophotographic photosensitive member being around 1 mm—to the focus on charge transfer that occurs on a time scale of about 1/1000 sec.

There are no particular limitations on how to bring the dielectric loss tangent of the toner to at least 0.0027, but, for example, the means indicated in the following is preferably adopted.

Specifically, a particle A, having a lower resistance than the binder resin in the toner particle, is incorporated in the interior of the toner particle and this particle A is caused to segregate, or undergo a partial aggregation, in the interior of the toner particle.

Doing this makes it possible to form conduction paths via the particle A in the interior of the toner particle, and charge may then flow without localized accumulation, thus facilitating uniformity and as a result facilitating the production of toner having a dielectric loss tangent of at least 0.0027.

The styrene-acrylic resins and polyester resins typically used as binder resins have volume resistivity values that exceed $1.0\times10^{12}$ Ω·cm and thus behave as insulators.

In order to increase the dielectric loss tangent of the toner, the volume resistivity of particle A is preferably not more than $1.0\times10^{12}$ Ω·cm and is more preferably not more than $1.0\times10^{11}$ Ω·cm.

On the other hand, from the standpoint of facilitating maintenance of the charging performance of the toner in the development step and transfer step, the volume resistivity of particle A is preferably at least $1.0\times10^2$ Ω·cm and is more preferably at least $1.0\times10^5$ Ω·cm.

Particle A can be exemplified by a particle in which the base material is a magnetic body, carbon black, silica, alumina, titania, or strontium titanate. An organic or inorganic surface treatment may be executed on particle A.

Among the preceding, particle A is preferably a magnetic body from the standpoints of enabling particle A to also function as a colorant for the toner, facilitating an increase in the dielectric loss tangent through segregation in the vicinity of the toner particle surface, and also facilitating an increase in the relative permittivity, infra. That is, the toner particle preferably contains magnetic bodies.

In addition, with regard to the toner particle, there are no particular limitations on the method for causing particle A to undergo segregation or aggregation in the interior of the toner particle.

From the standpoint of more readily inducing the segregation or aggregation of particle A in the interior of the toner particle, the suspension polymerization method or emulsion aggregation method is preferably selected for the method for producing the toner particle. The suspension polymerization method is more preferably selected from the standpoint of facilitating control of the state of occurrence of particle A in the vicinity of the toner particle surface.

Specifically, the suspension polymerization method is preferred because—upon establishing preferred modes for the surface treatment agent for particle A and the amount of treatment and the treated state—the suspension polymerization method enables control of the hydrophilic/hydrophobic balance and enables control of the location of occurrence of particle A in the toner particle. The suspension polymerization method is also preferred because the collection of particle A in the vicinity of the toner particle surface is facilitated in this case by increasing the shear force applied to the granulated droplets in the granulation step.

Relative Permittivity of Toner

The relative permittivity εr of the toner is preferably at least 2.00. From 2.05 to 3.00 is more preferred and from 2.10 to 2.80 is still more preferred. When this range is observed, the toner exhibits strong behavior as a dielectric and the charging performance of the toner is readily maintained through polarization actions in the interior of the toner particle.

This is preferred due to the following: the charging performance can as a consequence be maintained even in the case of extended standing after the completion of a print job, which as a result enables suppression of the occurrence of fogging after standing. The relative permittivity can be measured using the method described in the examples.

The particle A is preferably incorporated in the toner particle in order for the toner to have a high relative permittivity. The volume resistivity of the particle A is preferably controlled to a favorable value. The volume resistivity of the particle A is preferably from $1.0\times10^{2}$ Ω·cm to $1.0\times10^{12}$ Ω·cm and is more preferably from $1.0\times10^{5}$ Ω·cm to $1.0\times10^{11}$ Ω·cm.

Particle A is more preferably a magnetic body from the standpoint of realizing the resistance values indicated above. In addition, in order to increase the relative permittivity, preferably the content of particle A in the toner particle interior is increased to increase the polarization sites. The content of particle A is preferably at least 45 mass parts per 100 mass parts of the binder resin.

The toner particle in the toner preferably incorporates a magnetic body as particle A.

E2/E1

The ratio (E2/E1) for the toner of the abundance (E2) of the iron element to the abundance (E1) of the carbon element, in each case present at the surface of the toner particle and as measured by x-ray photoelectron spectroscopic analysis, is preferably not more than 0.00100. E2/E1 is more preferably not more than 0.000100 and is, still more preferably, not more than 0.0000100.

The lower limit is not particularly limited, but is preferably at least 0.0000000100 and is more preferably at least 0.000000100.

When the toner particle contains magnetic bodies, E2/E1 indicates the degree to which magnetic bodies are exposed from the toner particle surface. When E2/E1 is not more than 0.00100, this can be regarded as indicating more or less no exposure, and maintenance of the charging performance of the toner is facilitated. The charging performance of the toner can be maintained even in the case of extended standing after the completion of a print job, which as a result enables suppression of the occurrence of fogging after standing.

E2/E1 can be controlled, for example, by adopting the suspension polymerization method or emulsion aggregation method for the toner production method and/or through a surface treatment agent for the magnetic body. Specific means are, for example, bringing the number of carbons in an alkyltrialkoxysilane coupling agent (the value of p below) into a preferred range and establishing preferred modes for the surface treatment agent for the magnetic body and the amount of treatment and the treated state.

The magnetic body content is preferably controlled, and the toner particle preferably contains from 35 mass parts to 100 mass parts of the magnetic bodies per 100 mass parts of the binder resin.

Occurrence Percentage of Magnetic Bodies in 10% Region

In observation of the cross section of the toner with a transmission electron microscope, from 60 area % to 100 area % of the magnetic bodies is preferably present in the region that is, from the contour of the cross section of the toner particle, equal to or less than 10% of the distance from said contour to the geometric center of said cross section.

This value is also referred to in the following simply as the "magnetic body occurrence percentage in the 10% region". The method for measuring the magnetic body occurrence percentage in the 10% region is described below.

By having the magnetic bodies be in such a state of occurrence, the toner particle interior has a structure in which the magnetic bodies are segregated and suitably aggregated in the toner particle interior and due to this the dielectric loss constant and relative permittivity of the toner may be easily controlled into the preferred ranges indicated above.

In addition, by having the magnetic body occurrence percentage in the 10% region be from 60 area % to 100 area %, the toner particle surface assumes a pseudo-hardness due to the filler effect due to the magnetic bodies, and toner cracking and external additive burial during use in a durability test can be suppressed. Due to this, a good halftone density retention percentage is provided in high-temperature, high-humidity environments and a good toner durability is also provided.

In order to provide an even better halftone density uniformity in low-temperature, low-humidity environments and an even better halftone density retention percentage in high-temperature, high-humidity environments, the magnetic body occurrence percentage in the 10% region is more preferably from 65 area % to 100 area %, still more preferably from 70 area % to 100 area %, and even more preferably from 70 area % to 99 area %.

The magnetic body occurrence percentage in the 10% region can be controlled through selection of the suspension polymerization method for the toner production method, through the particle diameter and content of the magnetic bodies, through the type and amount of addition of the hydrophobic treatment agent for treating the magnetic bodies, and through the treatment method with the hydrophobic treatment agent.

A1 Value

In observation of the cross section of the toner with a transmission electron microscope, and defining A1 as the area percentage occupied by the magnetic bodies in the region not more than 200 nm from the contour of the cross section of the toner particle toward the geometric center of the cross section, the area percentage A1 is preferably from 35% to 85%.

When the A1 value is from 35% to 85%, the magnetic bodies in the vicinity of the toner surface are then distributed at an appropriate distance, and as a consequence charge transfer in the vicinity of the surface proceeds more smoothly. Thus, even in very low-temperature, low-humidity environments, which are more demanding environments with regard to the occurrence of white spots, the occurrence of an abnormal electrical discharge can be inhibited and a good halftone density uniformity is provided. The A1 value is more preferably from 38% to 85%.

The A1 value can be controlled, for example, by adopting the suspension polymerization method for the toner production method and/or by a surface treatment agent for the magnetic body. Specific methods are, for example, bringing the number of carbons in an alkyltrialkoxysilane coupling agent into a preferred range and establishing preferred modes, described below, for the surface treatment agent for the magnetic body and the amount of treatment and the treated state and for the particle diameter of the magnetic body.

The presence state of the magnetic bodies inside the toner particle is observed using a TEM after processing the toner particle into slices. In the cross-sectional image of the toner obtained by TEM observation, a region of not more than 200 nm from the contour of the cross section of the toner particle to the geometric center of the cross section is a range obtained as follows.

That is, the length per unit pixel is calculated from the magnification and resolution of the TEM, and the number of pixels corresponding to 200 nm is calculated based thereon. Next, a boundary line is drawn at a distance of the number of pixels corresponding to 200 nm from the contour of the cross section of the toner particle in the direction toward the geometric center of the cross section. A region from the boundary line to the toner particle surface is defined as a region (hereinafter, referred to as a region A) of not more than 200 nm from the contour of the cross section of the toner particle to the geometric center of the cross section. The specific procedure is described below.

A2/A1

In observation of the toner cross section with a transmission electron microscope, and defining A1 as the area percentage occupied by the magnetic bodies in the region not more than 200 nm from the contour of the cross section of the toner particle toward the geometric center of the cross section and defining A2 as the area percentage occupied by the magnetic bodies in the region from 200 nm to 400 nm from the contour of the cross section of the toner particle toward the geometric center of the cross section, the ratio (A2/A1) of the area percentage A2 to the area percentage A1 is preferably from 0 to 0.75, more preferably from 0.10 to 0.65, and still more preferably from 0.20 to 0.60.

By having A2/A1 be in the indicated range, a good rubbing-resistant fixing performance is provided for the halftone image even in the case of the use of rough paper in a high-speed process.

When particles, e.g., magnetic bodies, are present within a toner particle, a filler effect due to the magnetic bodies is exhibited when the toner particle is melted in the fixing nip and the viscosity of the binder resin undergoes an apparent increase. The wetting/spreadability of the binder resin is then impaired, and as a result the rubbing resistance of the fixed image may be reduced.

As a result of investigations by the present inventors, it was found that the fixing performance more readily declines as more magnetic bodies are present in the region that is not more than 400 nm from the contour of the toner particle cross section toward the geometric center of the cross section.

This was thought to occur because toner undergoes fixing by melting from the vicinity of the surface and as a consequence an inhibition of melting more readily occurs as the magnetic bodies are present to a greater degree in the vicinity of the toner surface.

However, as a result of more detailed investigations by the present inventors, it was found that in fact the fixing performance tends to be more readily influenced by the magnetic bodies present in the region from 200 nm to 400 nm from the contour of the cross section of the toner particle toward the geometric center of the cross section, than by the magnetic bodies in the region not more than 200 nm from the contour of the cross section of the toner particle toward the geometric center of the cross section.

It was thus discovered that the fixing performance in terms of rubbing could be improved, with reference to the occurrence percentages for the magnetic bodies as described above, by having A2/A1 be not more than 0.75, i.e., by having A1 be larger than A2.

This is thought to presumably be due to the following reasons.

It was found that in the case of the fixing of a halftone image onto highly uneven paper, such as rough paper, the melt-wetting/spreading deformation of the toner particle in the uncompressed state after passage through the fixing nip due to the heat stored in the paper has a greater influence on the fixing of magnetic body-containing toner than does the melt-wetting/spreading deformation that occurs within the fixing nip.

The region not more than 200 nm from the contour of the cross section of the toner particle toward the geometric center of the cross section is a region very close to the toner particle surface and due to this is subject in the fixing nip to deformation through the application of heat and pressure directly from the fixing unit. At this point, the binder resin in this region rapidly melts and the positional relationship with the magnetic bodies is also disturbed by the pressure; it is thought that as a result the expression of the filler effect by the magnetic bodies is impaired.

With the region from 200 nm to 400 nm from the contour of the cross section of the toner particle toward the geometric center of the cross section, on the other hand, there is a time lag in the transmission of heat and pressure from the fixing unit in the fixing nip, and it is thought that as a result a large influence is exercised by the deformation that occurs after passage through the fixing nip.

As a consequence, this becomes a deformation in the absence of pressurization and at relatively low temperatures due to the residual heat from fixing, and it is thought that due to this the filler effect from particles such as the magnetic bodies readily exercises an influence and a reduction in the fixing performance is readily induced.

From the standpoint of providing an even better fixing performance in terms of rubbing, A2 is preferably low and is preferably from 0% to 37% and is more preferably from 0% to 34%.

The A2 value can be controlled by adopting the suspension polymerization method for the toner production method, through the surface treatment agent for the magnetic body, through the content of the magnetic body, and so forth.

Relationship Between Interdomain Distance Dms and Toner Particle Diameter Dt

In observation of the external surface of the conductive member, in the present disclosure the relationship between the arithmetic average value Dms (μm) of the distances between adjacent walls of the domains in the conductive layer (also referred to hereafter simply as the "interdomain distance Dms") and the weight-average particle diameter Dt (μm) of the toner is preferably Dt>Dms. Dt−Dms is more preferably 0.10 to 10.00.

When Dt>Dms, this facilitates contact by a toner particle attached to the surface of the conductive member with a plurality of domains present at the surface of the conductive member and as a consequence enables a further reduction in charge segregation at the toner surface layer and enables a further suppression of the occurrence of an abnormal electrical discharge.

This can therefore provide a good halftone image uniformity even in the more demanding very low-temperature, low-humidity environment, and is thus preferred.

The interdomain distance Dms is preferably from 0.20 μm to 5.00 μm and is more preferably from 0.30 μm to 1.50 μm.

Relationship Between Interdomain Distance Dms and Number-Average Primary Particle Diameter Dmg of Magnetic Bodies The relationship between the interdomain distance Dms (μm) and the number-average primary particle diameter Dmg (μm) of the magnetic bodies is preferably Dms>Dmg. Dms−Dmg is more preferably 0.001 to 2.500, and Dms−Dmg is still more preferably 0.010 to 2.000.

By having Dms>Dmg, even when a toner particle has become attached to the surface of the conductive member, it is difficult for the mode of the microdischarge produced from the surface of the conductive member to be disturbed by the toner particle, and this is thus preferred.

More specifically, the magnetic bodies incorporated in the toner particle can suppress any eventual formation of conduction paths between adjacent domains. Due to this, the generation, through the merger of electrical discharges between domains, of an electrical discharge having a large local single electrical discharge amount can be suppressed and a microdischarge mode can be stably expressed.

As a consequence, the occurrence of an abnormal electrical discharge in the more demanding very low-temperature, low-humidity environment can be suppressed and a good halftone image uniformity is provided, and this embodiment is thus preferred.

The toner preferably contains a magnetic body-containing toner particle.

Examples of the magnetic bodies include magnetic iron oxides such as magnetite, maghemite, and ferrite, and magnetic iron oxides including other metal oxides; metals such as Fe, Co, and Ni, or alloys of these metals and metals such as Al, Co, Cu, Pb, Mg, Ni, Sn, Zn, Sb, Be, Bi, Cd, Ca, Mn, Se, Ti, W, V, and mixtures thereof.

Among them, magnetite is preferable, and the shape thereof may be polyhedron, octahedron, hexahedron, sphere, needle, flake, and the like. From the viewpoint of increasing the image density, the shape with small anisotropy, such as polyhedron, octahedron, hexahedron, and sphere is preferable.

The number-average primary particle diameter of the magnetic bodies is preferably from 50 nm to 500 nm, more preferably from 100 nm to 300 nm, and still more preferably from 150 nm to 250 nm.

The number-average primary particle diameter of the magnetic bodies present in the toner particle can be measured using a transmission electron microscope. The measurement method is described below.

The content of the magnetic bodies, per 100 mass parts of the binder resin, is preferably from 35 mass parts to 100 mass parts and is more preferably from 45 mass parts to 95 mass parts. By having the magnetic body content be in this range, the aforementioned magnetic body occurrence percentage in the 10% region is easily brought into the preferred range and, in addition, the toner is provided with good coverage characteristics and good magnetic characteristics.

The amount of the magnetic bodies in the toner can be measured using a thermal analyzer TGA Q5000IR manufactured by Perkin Elmer Corp. In the measurement, a toner is heated from normal temperature to 900° C. at a temperature rise rate of 25° C./min in a nitrogen atmosphere, the mass loss from 100° C. to 750° C. is taken as the mass of the components after excluding the magnetic bodies from the toner, and the remaining mass is taken as the mass of the magnetic bodes.

The following can be exemplified as a method for manufacturing the magnetic bodies.

An alkali such as sodium hydroxide is added to the aqueous ferrous salt solution in an amount equivalent to or more than the iron component to prepare an aqueous solution including ferrous hydroxide. Air is blown while maintaining the pH of the prepared aqueous solution at pH 7 or more, and an oxidation reaction of ferrous hydroxide is performed while heating the aqueous solution to 70° C. or more, to generate seed crystals serving as cores of the magnetic bodies.

Next, an aqueous solution including one equivalent of ferrous sulfate based on the amount of the alkali previously added is added to the slurry-like liquid including the seed crystals. The reaction of ferrous hydroxide is advanced while blowing air while maintaining the pH of the liquid at 5 to 10, and magnetic iron oxide particles are grown with the seed crystals as cores. At this time, the shape and magnetic properties of the magnetic bodies can be controlled by selecting arbitrary pH, reaction temperature, and stirring conditions. As the oxidation reaction proceeds, the pH of the liquid shifts to the acidic side, but it is preferable that the pH of the liquid be not less than 5. The magnetic body can be obtained by filtering, washing and drying the obtained magnetic iron oxide particles by a conventional method.

In order to have the magnetic bodies exhibit the aforementioned moisture adsorption/desorption characteristics, the magnetic body particle surface is preferably treated with a hydrophobic treatment agent with control so as to provide a certain moisture adsorptivity while increasing the hydrophobicity. There are no particular limitations for achieving this, but preferably the magnetic body is subjected to a surface treatment using the treatment apparatus described below and using a hydrophobic treatment agent having a relatively large number of carbons as represented by formula (I), see below.

By doing this, the hydrophobic treatment agent is uniformly reacted with the magnetic body particle surface and a high hydrophobicity can be expressed, while in the absence of a complete hydrophobing a portion of the hydroxyl groups on the magnetic body particle surface remain present at the same time and a certain moisture adsorptivity can be provided.

The magnetic body is preferably a hydrophobically treated magnetic body as provided by the execution of a hydrophobic treatment using the alkyltrialkoxysilane coupling agent represented by the following formula (I) as the hydrophobic treatment agent. The hydrophobically treated magnetic body has the magnetic body and the hydrophobic treatment agent on the surface of this magnetic body.

$$C_pP_{2p+1}—Si—(OC_qH_{2q+1})_3 \quad (I)$$

In formula (I), p represents an integer from 6 to 20 (preferably from 8 to 16 and more preferably from 10 to 14), and q represents an integer from 1 to 3 (preferably 1 or 2 and more preferably 1).

A satisfactory hydrophobicity can be provided by having p in this formula be at least 6, which is thus preferred. On the other hand, by having p be not more than 20, the magnetic body surface can be uniformly treated and coalescence of the magnetic bodies can be suppressed, and this is thus preferred.

Treatment with the aforementioned hydrophobic treatment agent using the preferred treatment method described below facilitates increasing the hydrophobicity while in a state in which a portion of the hydroxyl groups remain present on the magnetic body surface. This is preferred because it facilitates causing the magnetic bodies to be present in the vicinity of the toner particle surface and thereby facilitates increasing the magnetic body occurrence percentage in the 10% region. In addition, this facilitates bringing the dielectric loss tangent and relative permittivity of the toner into the desired ranges, and is thus preferred.

p is preferably an integer from 8 to 14 and is more preferably an integer from 8 to 12. q is preferably the integer 1 or 2.

The amount of addition of the hydrophobic treatment agent is preferably from 0.3 mass parts to 2.0 mass parts per 100 mass parts of the untreated magnetic bodies.

The use of at least 0.3 mass parts is preferred because this raises the hydrophobicity of the magnetic bodies and thereby enables the internal inclusion of the magnetic bodies and the generation of a small E2/E1. At least 0.5 mass parts is more preferred.

The use of not more than 2.0 mass parts is preferred because this enables a suitable residual hydroxyl value to be present at the surface of the magnetic body particle and facilitates the presence of the magnetic body in the vicinity of the toner particle surface. Not more than 1.5 mass parts is more preferred and not more than 1.3 mass parts is still more preferred.

When using the above silane coupling agents, the treatment can be performed with a single agent or with a combination of a plurality thereof. When using a plurality of agents in combination, the treatment may be performed individually with each coupling agent, or simultaneously. In addition, a titanium coupling agent or the like may be used in combination.

The method of the hydrophobic treatment is not particularly limited, but the following method is preferred.

For the purpose of uniformly reacting the hydrophobic treatment agent on the particle surface of the magnetic body to express high hydrophobicity, and at the same time, partially leaving the hydroxyl groups on the particle surface of the magnetic body without complete hydrophobization, it is preferable that the surface treatment be performed in a dry manner using a wheel-type kneader or a grinder.

Here, a Mix-Muller, a Multi-Mul, a Stotts mill, a backflow kneader, an Erich-mill, or the like can be adopted as the wheel-type kneader, and it is preferable to use the Mix-Muller.

When a wheel-type kneader or a grinder is used, three functions of a compression action, a shearing action, and a spatula action can be exhibited.

The hydrophobic treatment agent present between the particles of the magnetic bodies is pressed against the surface of the magnetic bodies by the compression action, so that the adhesion and the reactivity with the particle surface can be enhanced. By applying a shear force to each of the hydrophobic treatment agent and the magnetic body by a shearing action, the hydrophobic treatment agent can be stretched and the particles of the magnetic body can be broken apart to release aggregates. Further, with the spatula action, the hydrophobic treatment agent present on the surface of the magnetic body particles can be spread evenly as if by a spatula.

As a result of continuously and repeatedly demonstrating the above three actions, the surface of each magnetic body particle can be uniformly treated while breaking apart the particle aggregates and separating into individual particles without re-aggregation.

Usually, the hydrophobic treatment agent represented by the formula (I) and having a relatively large number of carbon atoms is unlikely to treat the particle surface of the magnetic body uniformly at the molecular level because the molecule of the agent is large and bulky, but the treatment by the above method is preferable because the treatment can be performed stably.

When the surface treatment of the magnetic body is performed by a wheel-type kneader or a grinder by using a hydrophobic treatment agent represented by the formula (I), the particle surface of the magnetic body on which portions that have reacted with the hydrophobic treatment agent and hydroxyl groups that remained unreacted are alternately present and co-present can be achieved.

By setting the particle surface of the magnetic body in such a state, it is possible to impart a certain water absorbing property while increasing the hydrophobicity, and it is possible to facilitate causing the magnetic bodies to be present in the vicinity of the toner particle surface.

The toner particle may contain a binder resin.

The binder resin can be exemplified by the following:

vinyl resins, styrene resins, styrenic copolymer resins, polyester resins, polyol resins, polyvinyl chloride resins, phenolic resins, natural resin-modified phenolic resins, natural resin-modified maleic acid resins, acrylic resins, methacrylic resins, polyvinyl acetate, silicone resins, polyurethane resins, polyamide resins, furan resins, epoxy resins, xylene resins, polyvinyl butyral, terpene resins, coumarone-indene resins, and petroleum resins.

The following are preferred: vinyl resins, styrenic copolymer resins, polyester resins, and hybrid resins provided by mixing a polyester resin with a vinyl resin or by partially reacting the two.

The toner particle may contain a release agent.

The release agent can be exemplified by the following: waxes in which the main component is a fatty acid ester, e.g., carnauba wax and montanic acid ester wax; waxes provided by the partial or complete deacidification of the acid component from a fatty acid ester, e.g., deacidified carnauba wax; hydroxyl group-containing methyl ester compounds obtained by, e.g., the hydrogenation of plant oils; saturated fatty acid monoesters, e.g., stearyl stearate and behenyl behenate; diesters between a saturated aliphatic dicarboxylic acid and a saturated aliphatic alcohol, e.g., dibehenyl sebacate, distearyl dodecanedioate, and distearyl octadecanedioate; diesters between a saturated aliphatic diol and a saturated fatty acid, e.g., nonanediol dibehenate and dodecanediol distearate; aliphatic hydrocarbon waxes such as low molecular weight polyethylene, low molecular weight polypropylene, microcrystalline wax, paraffin wax, and Fischer-Tropsch wax; the oxides of aliphatic hydrocarbon waxes, e.g., oxidized polyethylene wax, and their block copolymers; waxes provided by grafting an aliphatic hydrocarbon wax using a vinyl monomer such as styrene or acrylic acid; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; and long-chain alkyl alcohols or long-chain alkylcarboxylic acids having at least 12 carbons.

The following are preferred among these release agents: monofunctional and difunctional ester waxes such as, for example, saturated fatty acid monoesters and diesters, and hydrocarbon waxes such as paraffin waxes and Fischer-Tropsch waxes.

In addition, the melting point of the release agent, defined as the peak temperature of the maximum endothermic peak during temperature ramp up in measurement by differential scanning calorimetry (DSC), is preferably 60° C. to 140° C. It is more preferably 60° C. to 90° C. The storability of the toner is enhanced when the melting point is at least 60° C. On the other hand, a melting point of not more than 140° C. facilitates enhancement of the low-temperature fixability.

The content of the release agent is preferably from 3 mass parts to 40 mass parts per 100 mass parts of the binder resin.

The toner particle may contain a charge control agent.

Organometal complex compounds and chelate compounds are effective as charge control agents for negative charging and can be exemplified by monoazo metal complex compounds, acetylacetone-metal complex compounds, and metal complex compounds of aromatic hydroxycarboxylic acids or aromatic dicarboxylic acids.

Specific examples of commercial products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used by itself or two or more may be used in combination. Viewed from the standpoint of the charge quantity on the toner, the amount of use of the charge control agent is, per 100 mass parts of the binder resin, from 0.1 mass parts to 10.0 mass parts and more preferably from 0.1 mass parts to 5.0 mass parts.

The toner can use a magnetic body as a colorant, but heretofore known colorants may also be used in combination. For example, carbon black or graphitized carbon may be used as a black colorant, while a black colorant may also be used as provided by color matching, using a yellow, magenta, and cyan colorant as described below, to provide a black color.

Yellow colorants can be exemplified by compounds as represented by condensed azo compounds, isoindolinone compounds, anthraquinone compounds, azo-metal complexes, methine compounds, and allylamide compounds.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Cyan colorants can be exemplified by copper phthalocyanine compounds and derivatives thereof, anthraquinone compounds, and basic dye lake compounds. A single one or a mixture of these colorants can be used, and these may also be used in the form of solid solutions.

The content of the colorant (colorant other than a magnetic body), per 100 mass parts of the binder resin, is preferably from 1 mass parts to 20 mass parts and is more preferably from 2 mass parts to 15 mass parts.

The toner particle may contain a crosslinking agent as follows:

divinylbenzene, 1,6-hexanediol diacrylate, polyethylene glycol #200 diacrylate (A200), polyethylene glycol #400 diacrylate (A400), polyethylene glycol #600 diacrylate (A600), and polyethylene glycol #1000 diacrylate (A1000); and dipropylene glycol diacrylate (APG100), tripropylene glycol diacrylate (APG200), polypropylene glycol #400 diacrylate (APG400), polypropylene glycol #700 diacrylate (APG700), and polytetrapropylene glycol #650 diacrylate (A-PTMG-65).

The toner may have a toner particle and an external additive.

Examples of the external additive include metal oxide fine particles (inorganic fine particles) such as silica fine particles, alumina fine particles, titania fine particles, zinc oxide fine particles, strontium titanate fine particles, cerium oxide fine particles, and calcium carbonate fine particles. Further, composite oxide fine particles using two or more kinds of metals can be used, and two or more kinds selected from an arbitrary combination among these fine particle groups can also be used.

In addition, resin fine particles or organic-inorganic composite fine particles of resin fine particles and inorganic fine particles can also be used.

The external additive more preferably has at least one kind of particles selected from the group consisting of silica fine particles and organic-inorganic composite fine particles.

Silica fine particles can be exemplified by sol-gel silica fine particles prepared by a sol-gel method, aqueous colloidal silica fine particles, alcoholic silica fine particles, fumed silica fine particles obtained by a gas phase method, and fused silica fine particles.

Examples of the resin fine particles include resin particles of vinyl resin, polyester resin, and silicone resin.

Examples of the organic-inorganic composite fine particles include organic-inorganic composite fine particles composed of resin fine particles and inorganic fine particles.

In the case of organic-inorganic composite fine particles, a good durability and charging performance are maintained through behavior as an inorganic fine particle, while an inhibition of toner particle unification and the appearance of an inhibition of fixing are impeded during fixing by the resin component with its low heat capacity. As a consequence, establishing co-existence between the durability and fixing performance is facilitated.

The organic-inorganic composite fine particle is preferably a composite fine particle that has protruded portions, constituted of inorganic fine particles, that are embedded in the surface of a resin fine particle (preferably a vinyl resin fine particle) that is the resin component. It is more preferably a composite fine particle having a structure in which inorganic fine particles are exposed at the surface of a vinyl resin fine particle. It is even more preferably a composite fine particle having a structure that has inorganic fine particle-derived protruded portions on the surface of a vinyl resin fine particle.

The inorganic fine particle constituting the organic-inorganic composite fine particle can be exemplified by fine particles such as silica fine particles, alumina fine particles, titania fine particles, zinc oxide fine particles, strontium titanate fine particles, cerium oxide fine particles, and calcium carbonate fine particles.

The content of the external additive is preferably from 0.1 mass parts to 20.0 mass parts per 100 mass parts of the toner particle.

The external additive may be subjected to a hydrophobizing treatment with a hydrophobic treatment agent.

Examples of the hydrophobic treatment agent include chlorosilanes such as methyltrichlorosilane, dimethyldichlorosilane, trimethylchlorosilane, phenyltrichlorosilane, diphenyldichlorosilane, t-butyldimethylchlorosilane, vinyltrichlorosilane, and the like; alkoxysilanes such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxisilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane, γ-(2-aminoethyl) aminopropylmethyldimethoxysilane, and the like; silazanes such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, dimethyltetravinyldisilazane, and the like;

silicone oils such as dimethyl silicone oil, methyl hydrogen silicone oil, methyl phenyl silicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil, terminally reactive silicone oil, and the like; siloxanes such as hexamethylcyclotrisiloxane, octamethylcyclotetrasiloxane, decamethylcyclopentasiloxane, hexamethyldisiloxane, octamethyltrisiloxane, and the like;

fatty acids and metal salts thereof such as long-chain fatty acids such as undecylic acid, lauric acid, tridecylic acid, dodecylic acid, myristic acid, palmitic acid, pentadecylic acid, stearic acid, heptadecylic acid, arachiic acid, montanic acid, oleic acid, linoleic acid, arachidonic acid, and salts of the above fatty acids with metals such as zinc, iron, magnesium, aluminum, calcium, sodium, lithium, and the like.

Among these, alkoxysilanes, silazanes, and silicone oil are preferably used because hydrophobization can be easily performed. One of these hydrophobic treatment agents may be used alone, or two or more thereof may be used in combination.

The toner may include a plurality of types of external additives in order to improve the flowability and charging performance of the toner.

Examples of methods for producing the toner are provided in the following.

From the standpoint of controlling the state of occurrence of the magnetic bodies, toner particle production is preferably carried out in an aqueous medium, e.g., a dispersion polymerization method, association aggregation method, dissolution suspension method, suspension polymerization method, emulsion aggregation method, and so forth.

The suspension polymerization method is preferred because it facilitates the presence of the magnetic bodies in the vicinity of the toner particle surface.

In the suspension polymerization method, for example, a polymerizable monomer capable of forming a binder resin, the magnetic bodies and, if necessary, a colorant, a polymerization initiator, a crosslinking agent, a charge control agent and other additives are uniformly dispersed to obtain a polymerizable monomer composition. Then, the obtained polymerizable monomer composition is dispersed and granulated in a continuous layer (for example, an aqueous phase) including a dispersion stabilizer by using a suitable stirrer, and then a polymerization reaction is performed using a polymerization initiator to obtain toner particles having a desired particle size.

The polymerizable monomer is listed hereinbelow.

Styrene monomers such as styrene, o-methylstyrene, m-methylstyrene, p-methylstyrene, p-methoxystyrene, p-ethylstyrene and the like.

Acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, phenyl acrylate, and the like.

Methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, and the like.

Other monomers such as acrylonitrile, methacrylonitrile, and acrylamide. These monomers can be used alone or as a mixture.

Among the monomers indicated above, the use of a styrenic monomer, by itself or mixed with another monomer such as an acrylate ester or methacrylate ester, is preferred from the standpoint of control of the toner structure and facilitating enhancements in the developing characteristics and durability of the toner. In particular, the use of styrene+acrylate ester or styrene+methacrylate ester as the main component is more preferred. That is, the binder resin preferably contains at least 50 mass % styrene-acrylic resin.

A polymer of styrene and at least one selected from the group consisting of acrylate esters and methacrylate esters is preferred.

As the polymerization initiator to be used in the production of the toner particles by the polymerization method, those having a half-life at the time of the polymerization reaction of from 0.5 h to 30 h are preferable. In addition, it is preferable that the polymerization initiator be used in an amount of from 0.5 parts by mass to 20 parts by mass based on 100 parts by mass of the polymerizable monomer. In such a case, a polymer having a maximum molecular weight of from 5000 to 50000 can be obtained, and the toner can have preferable strength and appropriate melting characteristics.

Specific examples of polymerization initiators include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and the like; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxypivalate, di(2-ethylhexyl) peroxydicarbonate, di(secondary butyl) peroxydicarbonate, and the like.

Among them, t-butyl peroxypivalate is preferred.

A crosslinking agent may be added when the toner is produced by a polymerization method.

The amount of addition, per 100 mass parts of the polymerizable monomer, is preferably from 0.05 mass parts to 15.0 mass parts, more preferably from 0.10 mass parts to 10.0 mass parts, still more preferably from 0.20 mass parts to 5.0 mass parts, even more preferably from 0.10 mass parts to 3.00 mass parts, and particularly preferably from 0.20 mass parts to 2.50 mass parts.

The aforementioned polymerizable monomer composition may contain a polar resin.

The polar resin can be exemplified by the homopolymers of styrene or a derivative thereof, e.g., polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; as well as polymethyl methacrylate, polybutyl methacrylate, polyvinyl acetate, polyethylene, polypropylene, polyvinyl butyral, silicone resins, polyester resins, styrene-polyester copolymer, polyacrylate-polyester copolymer, polymethacrylate-polyester copolymer, polyamide resins, epoxy resins, polyacrylic acid resins, terpene resins, and phenolic resins.

A single one of these may be used or a mixture of two or more may be used. A functional group, e.g., the amino group, carboxy group, hydroxyl group, sulfonic acid group, glycidyl group, nitrile group, and so forth, may be introduced into these polymers. Polyester resins are preferred among these resins.

An appropriate selection from saturated polyester resins and unsaturated polyester resins or from both may be used as the polyester resin.

Common polyester resins constituted of an alcohol component and an acid component can be used as the polyester resin, and examples of these two components are provided in the following.

Dihydric alcohol components can be exemplified by ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, bisphenol derivatives represented by formula (A), hydrogenates of compounds represented by the following formula (A), diols represented by the following formula (B), and hydrogenates of diols represented by the following formula (B).

(A)

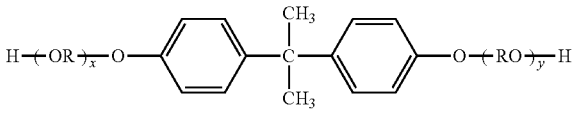

In formula (A), R is an ethylene group or propylene group, x and y are each integers equal to or greater than 1, and the average value of x+y is 2 to 10.

(B)

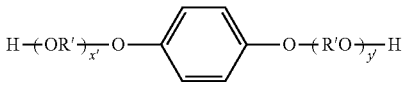

(In the formula, R' is

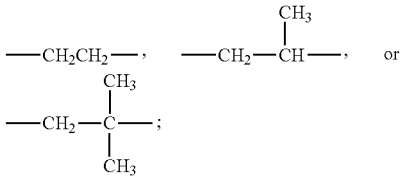

x' and y' are each integers of at least 0; and the average value of x'+y' is 0 to 10.)

The aforementioned alkylene oxide adducts on bisphenol A, which provide excellent charging characteristics and an excellent environmental stability, and which achieve a balance for the other electrophotographic properties, are particularly preferred for the dihydric alcohol component.

From the standpoint of the fixing performance and toner durability, the average number of moles of addition of the alkylene oxide with these compounds is preferably from 2 to 10.

The dibasic acid component can be exemplified by benzenedicarboxylic acids and their anhydrides, such as phthalic acid, terephthalic acid, isophthalic acid, and phthalic anhydride; alkyl dicarboxylic acids such as succinic acid, adipic acid, sebacic acid, and azelaic acid, and their anhydrides; succinic acid substituted by an alkyl group having from 6 to 18 carbons or by an alkenyl group having from 6 to 18 carbons, and their anhydrides; and unsaturated dicarboxylic acids such as fumaric acid, maleic acid, citraconic acid, and itaconic acid, and their anhydrides.

The at least trihydric alcohol component can be exemplified by glycerol, pentaerythritol, sorbitol, sorbitan, and oxyalkylene ethers of novolac-type phenolic resins, and the at least tribasic acid component can be exemplified by trimellitic acid, pyromellitic acid, 1,2,3,4-butanetetracarboxylic acid, benzophenonetetracarboxylic acid, and their anhydrides.

Using 100 mol % for the total of the alcohol component and acid component, from 45 mol % to 55 mol % of the polyester resin is the alcohol component.

The polyester resin can be produced using any catalyst, e.g., a tin catalyst, antimony catalyst, titanium catalyst, and so forth, wherein the use of a titanium catalyst is preferred.

From the standpoint of the developing performance, blocking resistance, and durability, the number-average molecular weight of the polar resin is preferably from 2500 to 25000.

The acid value of the polar resin is preferably from 1.0 mg KOH/g to 15.0 mg KOH/g and is more preferably from 2.0 mg KOH/g to 10.0 mg KOH/g.

The content of the polar resin is preferably from 2 mass parts to 20 mass parts per 100 mass parts of the binder resin.

The aqueous medium in which the polymerizable monomer composition is to be dispersed may include a dispersion stabilizer. As the dispersion stabilizer, known surfactants, organic dispersants and inorganic dispersants can be used. Among them, inorganic dispersants are preferred because they have dispersion stability owing to their steric hindrance, so that even if the reaction temperature is changed, the stability is hardly lost, the washing is easy, and the toner is hardly adversely affected thereby.

Examples of such inorganic dispersants include polyvalent metal phosphates such as tricalcium phosphate, magnesium phosphate, aluminum phosphate, zinc phosphate, hydroxyapatite, and the like; carbonates such as calcium carbonate, magnesium carbonate, and the like; inorganic salts such as calcium metasilicate, calcium sulfate, barium sulfate, and the like; and inorganic compounds such as calcium hydroxide, magnesium hydroxide, aluminum hydroxide, and the like.

The amount of the inorganic dispersant added is preferably from 0.2 parts by mass to 20 parts by mass based on 100 parts by mass of the polymerizable monomer. The dispersion stabilizers may be used alone or in combination of two or more. Further, from 0.001 parts by mass to 0.1 parts by mass of a surfactant may be used in combination.

When an inorganic dispersant is used, it may be used as it is, but in order to generate finer particles, fine particles of the inorganic dispersant can be generated and used in an aqueous medium.

For example, in the case of tricalcium phosphate, an aqueous solution of sodium phosphate and an aqueous solution of calcium chloride can be mixed under high-speed stirring to generate fine particles of water-insoluble calcium phosphate, which enables more uniform and fine dispersion.

Examples of the surfactant include sodium dodecylbenzenesulfate, sodium tetradecylsulfate, sodium pentadecylsulfate, sodium octylsulfate, sodium oleate, sodium laurate, sodium stearate, potassium stearate, and the like.

In the step of polymerizing the polymerizable monomer, the polymerization temperature should be set to a temperature generally of at least 40° C. and preferably to a temperature from 50° C. to 90° C. When polymerization is carried out in this temperature range, for example, the release agent and so forth added on an optional basis undergoes precipitation through phase separation and a more complete internal inclusion is established.

This is followed by a cooling step in which the polymerization reaction step is brought to an end by cooling from the reaction temperature of approximately 50° C. to 90° C. At this point, cooling should be carried out gradually so as to maintain the state of compatibility between the release agent and binder resin.

After the completion of polymerization of the polymerizable monomer, the obtained polymer particle is filtered, washed, and dried by known methods to obtain a toner particle. This toner particle may be used as such as a toner. Toner may also be obtained by mixing the toner particle with an external additive to attach same to the toner particle surface. In addition, a classification step may also be introduced into the production process in order to cut the coarse particles and fines present in the toner particle.

The Process Cartridge

The process cartridge has the following features.

A process cartridge detachably provided to a main body of an electrophotographic apparatus, the process cartridge including a charging unit for charging the surface of an electrophotographic photosensitive member, and a developing unit for forming a toner image on the surface of the electrophotographic photosensitive member by developing an electrostatic latent image formed on the surface of the electrophotographic photosensitive member with a toner, wherein the developing unit includes a toner; and the charging unit includes a conductive member disposed to be contactable with the electrophotographic photosensitive member.

The toner and the conductive member that have been described above can be used in this process cartridge.

The process cartridge may include a frame in order to support the charging unit and the developing unit.

Figure 4:
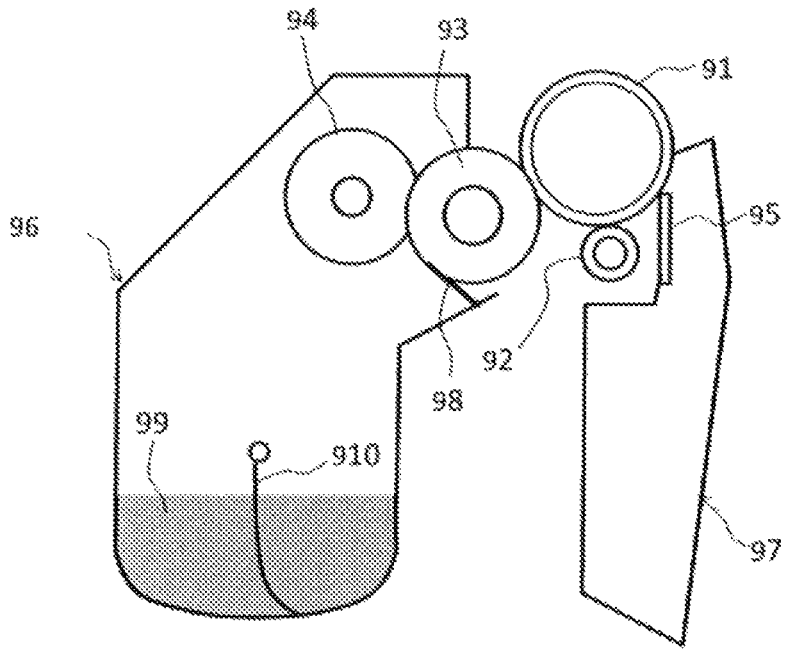
FIG. 4 is a schematic diagram of a process cartridge.

FIG. 4 is a schematic cross-sectional diagram of an electrophotographic process cartridge equipped with a conductive member as a charging roller. This process cartridge includes a developing unit and charging unit formed into a single article and is configured to be detachable from and attachable to the main body of an electrophotographic apparatus.

The developing unit is provided with at least a developing roller 93, and includes a toner 99. The developing unit may optionally include a toner supply roller 94, a toner container 96, a developing blade 98, and a stirring blade 910 formed into a single article.

The charging unit should be provided with at least a charging roller 92 and may be provided with a cleaning blade 95 and a waste toner container 97. The conductive member should be disposed to be contactable with the electrophotographic photosensitive member, and due to this the electrophotographic photosensitive member (photosensitive drum 91) may be integrated with the charging unit as a constituent element of the process cartridge or may be fixed in the main body as a constituent element of the electrophotographic apparatus.

A voltage may be applied to each of the charging roller 92, developing roller 93, toner supply roller 94, and developing blade 98.

The Electrophotographic Apparatus

The electrophotographic apparatus has the following features.

An electrophotographic apparatus including an electrophotographic photosensitive member, a charging unit for charging a surface of the electrophotographic photosensitive member, and a developing unit for forming a toner image on the surface of the electrophotographic photosensitive member by developing an electrostatic latent image formed on the surface of the electrophotographic photosensitive member with a toner, wherein the charging unit includes a conductive member disposed to be contactable with the electrophotographic photosensitive member.

The toner and the conductive member that have been described above can be used in this electrophotographic apparatus.

The electrophotographic apparatus may include an image-wise exposure unit for irradiating the surface of the electrophotographic photosensitive member with image-wise exposure light to form an electrostatic latent image on the electrophotographic photosensitive member;

a transfer unit for transferring a toner image formed on the surface of the electrophotographic photosensitive member to a recording medium; and a fixing unit for fixing, to the recording medium, the toner that has been transferred to the recording medium.

Figure 5:
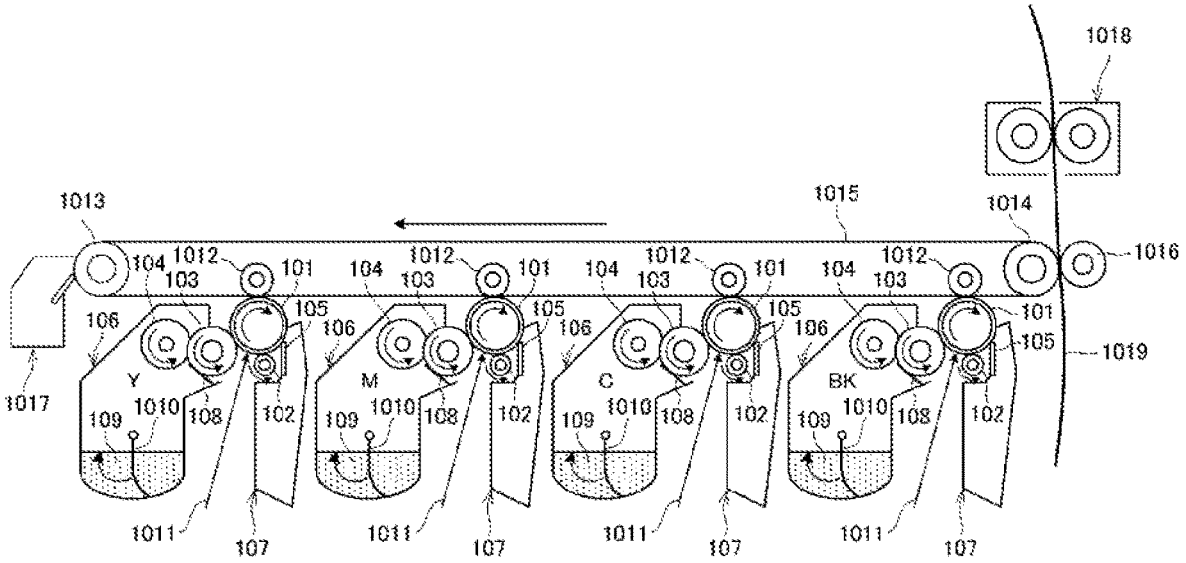
FIG. 5 is a schematic cross-sectional diagram of an electrophotographic apparatus.

FIG. 5 is a schematic component diagram of an electrophotographic apparatus that uses a conductive member as a charging roller. This electrophotographic apparatus is a color electrophotographic apparatus in which four process cartridges are detachably mounted. Toners in each of the following colors are used in the respective process cartridges: black, magenta, yellow, and cyan.

A photosensitive drum 101 rotates in the direction of the arrow and is uniformly charged by a charging roller 102, to which a voltage has been applied from a charging bias power source, and an electrostatic latent image is formed on the surface of the photosensitive drum 101 by exposure light 1011. On the other hand, a toner 109, which is stored in a toner container 106, is supplied by a stirring blade 1010 to a toner supply roller 104 and is transported onto a developing roller 103.

The toner 109 is uniformly coated onto the surface of the developing roller 103 by a developing blade 108 disposed in contact with the developing roller 103, and in combination with this charge is imparted to the toner 109 by triboelectric charging. The electrostatic latent image is visualized as a toner image by development by the application of the toner 109 transported by the developing roller 103 disposed in contact with the photosensitive drum 101.

The visualized toner image on the photosensitive drum is transferred, by a primary transfer roller 1012 to which a voltage has been applied from a primary transfer bias power source, to an intermediate transfer belt 1015, which is supported and driven by a tension roller 1013 and an intermediate transfer belt driver roller 1014. The toner image for each color is sequentially stacked to form a color image on the intermediate transfer belt.

A transfer material 1019 is fed into the apparatus by a paper feed roller and is transported to between the intermediate transfer belt 1015 and a secondary transfer roller 1016. Under the application of a voltage from a secondary transfer bias power source, the secondary transfer roller 1016 transfers the color image on the intermediate transfer belt 1015 to the transfer material 1019. The transfer material 1019 to which the color image has been transferred is subjected to a fixing process by a fixing unit 1018 and is discharged from the apparatus to complete the printing operation.

Otherwise, the untransferred toner remaining on the photosensitive drum is scraped off by a cleaning blade 105 and is held in a waste toner collection container 107, and the cleaned photosensitive drum 101 repeats the aforementioned process. In addition, untransferred toner remaining on the primary transfer belt is also scraped off by a cleaning unit 1017.

The Cartridge Set

The cartridge set has the following features.

A cartridge set including a first cartridge and a second cartridge detachably provided to a main body of an electrophotographic apparatus, wherein the first cartridge includes a charging unit for charging a surface of an electrophotographic photosensitive member and a first frame for supporting the charging unit;

the second cartridge includes a toner container that holds a toner for forming a toner image on the surface of the electrophotographic photosensitive member by developing an electrostatic latent image formed on the surface of the electrophotographic photosensitive member; and the charging unit includes a conductive member disposed to be contactable with the electrophotographic photosensitive member.

The toner and the conductive member that have been described above can be used in this cartridge set.

Since the conductive member should be disposed to be contactable with the electrophotographic photosensitive member, the first cartridge may be provided with the electrophotographic photosensitive member or the electrophotographic photosensitive member may be fixed in the main body of the electrophotographic apparatus. For example, the first cartridge may have an electrophotographic photosensitive member, a charging unit for charging the surface of the electrophotographic photosensitive member, and a first frame for supporting the electrophotographic photosensitive member and the charging unit. However, the second cartridge may be provided with the electrophotographic photosensitive member.

The first cartridge or the second cartridge may be provided with a developing unit for forming a toner image on the surface of the electrophotographic photosensitive member. The developing unit may be fixed in the main body of the electrophotographic apparatus.

EXAMPLES

The constitution according to the present disclosure is described in greater detail through the examples and comparative examples provided below; however, the constitution according to the present disclosure is not limited to the constitutions that are specifically realized in the examples. In addition, the "parts" used in the examples and comparative examples are on a mass basis unless specifically indicated otherwise.

Conductive Member 1 Production Example

[1-1. Preparation of Domain-Forming Rubber Mixture (CMB)]

A CMB was obtained by mixing the materials indicated in Table 1 at the amounts of incorporation given in Table 1, using a 6-liter pressure kneader (product name: TD6-15MDX, Toshin Co., Ltd.). The mixing conditions were a fill ratio of 70 volume %, a blade rotation rate of 30 rpm, and 30 minutes.

TABLE 1

| | Ingredient name | Amount of incorporation (parts) |
|---|---|---|
| Starting rubber | Styrene-butadiene rubber (product name: TUFDENE 1000, Asahi Kasei Corporation) | 100 |
| Electronic conducting agent | Carbon black (product name: TOKABLACK #5500, Tokai Carbon Co., Ltd.) | 60 |
| Vulcanization co-accelerator | Zinc oxide (product name: Zinc Oxide No. 2 (JIS), Sakai Chemical Industry Co., Ltd.) | 5 |
| Processing aid | Zinc stearate (product name: SZ-2000, Sakai Chemical Industry Co., Ltd.) | 2 |

1-2. Preparation of Matrix-Forming Rubber Mixture (MRC)

An MRC was obtained by mixing the materials indicated in Table 2 at the amounts of incorporation given in Table 2, using a 6-liter pressure kneader (product name: TD6-15MDX, Toshin Co., Ltd.). The mixing conditions were a fill ratio of 70 volume %, a blade rotation rate of 30 rpm, and 16 minutes.

TABLE 2

| | Ingredient name | Amount of incorporation (parts) |
|---|---|---|
| Starting rubber | Butyl rubber (product name: JSR Butyl 065, JSR Corporation) | 100 |
| Filler | Calcium carbonate (product name: NANOX #30, Maruo Calcium Co., Ltd.) | 70 |
| Vulcanization co-accelerator | Zinc oxide (product name: Zinc Oxide No. 2 (JIS), Sakai Chemical Industry Co., Ltd.) | 7 |
| Processing aid | Zinc stearate (product name: SZ-2000, Sakai Chemical Industry Co., Ltd.) | 2.8 |

1-3. Preparation of Unvulcanized Rubber Mixture for Conductive Layer Formation

The CMB and the MRC obtained as described above were mixed at the amounts of incorporation given in Table 3 using a 6-liter pressure kneader (product name: TD6-15MDX, Toshin Co., Ltd.). The mixing conditions were a fill ratio of 70 volume %, a blade rotation rate of 30 rpm, and 20 minutes.

TABLE 3

| | Ingredient name | Amount of incorporation (parts) |
|---|---|---|
| Starting rubber | Domain-forming rubber mixture | 25 |
| Starting rubber | Matrix-forming rubber mixture | 75 |

The vulcanizing agent and vulcanization accelerator indicated in Table 4 were then added in the amounts of incorporation indicated in Table 4 to 100 parts of the CMB+MRC mixture, and mixing was carried out using an open roll with a 12-inch roll diameter to prepare a rubber mixture for conductive layer formation.

With regard to the mixing conditions, the front roll rotation rate was 10 rpm, the back roll rotation rate was 8 rpm, the roll gap was 2 mm, and turn buck was performed right and left a total of 20 times; this was followed by 10 thin passes on a roll gap of 0.5 mm.

TABLE 4

| | Ingredient name | Amount of incorporation (parts) |
|---|---|---|
| Vulcanizing agent | Sulfur (product name: SULFAX PMC, Tsurumi Chemical Industry Co., Ltd.) | 3 |
| Vulcanization accelerator | Tetramethylthiuram disulfide (product name: TT, Ouchi Shinko Chemical Industrial Co., Ltd.) | 3 |

2. Production of the Conductive Member 2-1. Preparation of a Support Having a Conductive Outer Surface A round bar having a total length of 252 mm and an outer diameter of 6 mm, and having an electroless nickel plating treatment executed on a stainless steel (SUS) surface, was prepared as the support having a conductive outer surface.

2-2. Molding the Conductive Layer

A die with an inner diameter of 10.0 mm was mounted at the tip of a crosshead extruder having a feed mechanism for the support and a discharge mechanism for the unvulcanized rubber roller, and the temperature of the extruder and crosshead was adjusted to 80° C. and the support transport speed was adjusted to 60 mm/sec. Operating under these conditions, the rubber mixture for conductive layer formation was fed from the extruder and the outer circumference of the support was coated in the crosshead with this rubber mixture for conductive layer formation to yield an unvulcanized rubber roller.

The unvulcanized rubber roller was then introduced into a 160° C. convection vulcanization oven and the rubber mixture for conductive layer formation was vulcanized by heating for 60 minutes to obtain a roller having a conductive layer formed on the outer circumference of the support. 10 mm was then cut off from each of the two ends of the conductive layer to provide a length of 232 mm for the longitudinal direction of the conductive layer portion.

Finally, the surface of the conductive layer was ground using a rotary grinder. This yielded a crowned conductive member 1 having a diameter at the center of 8.5 mm and a diameter of 8.40 mm at each of the positions 90 mm toward each of the ends from the center.

TABLE 5A-1

| Conductive member No. | Conductive base Type | Conductive base Conductive surface | Unvulcanized domain rubber mixture: Rubber starting material Material abbreviation | SP value | Mooney viscosity | Conductive agent Type | Conductive agent Parts | Conductive agent DBP | Dispersing time min | Mooney viscosity |
|---|---|---|---|---|---|---|---|---|---|---|
| 1 | SUS | Ni plating | SBR T1000 | 16.8 | 45 | #5500 | 60 | 155 | 30 | 84 |
| 2 | SUS | Ni plating | Butyl JSR Butyl 065 | 15.8 | 32 | #5500 | 65 | 155 | 30 | 93 |
| 3 | SUS | Ni plating | Butyl JSR Butyl 065 | 15.8 | 32 | #7360 | 45 | 87 | 30 | 65 |
| 4 | SUS | Ni plating | Butyl JSR Butyl 065 | 15.8 | 32 | #7360 | 42 | 87 | 40 | 60 |
| 5 | SUS | Ni plating | Butyl JSR Butyl 065 | 15.8 | 32 | #5500 | 65 | 155 | 30 | 93 |
| 6 | SUS | Ni plating | SBR T2100 | 17.0 | 78 | #5500 | 80 | 155 | 30 | 105 |
| 7 | SUS | Ni plating | NBR N230SV | 20.0 | 32 | #7360 | 70 | 87 | 30 | 90 |
| 8 | SUS | Ni plating | NBR N220S | 20.4 | 57 | #7360 | 60 | 87 | 30 | 86 |
| 9 | SUS | Ni plating | NBR N230SV | 19.2 | 32 | #7360 | 60 | 87 | 30 | 36 |
| 10 | SUS | Ni plating | NBR N230SV | 19.2 | 32 | LV | 3 | — | 30 | 35 |
| 11 | SUS | Ni plating | BR JSR T0700 | 17.1 | 43 | #7360 | 80 | 87 | 30 | 85 |
| 12 | SUS | Ni plating | SBR T2003 | 17.0 | 45 | — | — | — | — | 45 |
| 13 | SUS | Ni plating | SBR T1000 | 16.8 | 45 | #5500 | 60 | 155 | 30 | 75 |

With regard to the Mooney viscosity in the table, the values for the starting rubbers are the catalogue values provided by the particular manufacturer. The values of the Mooney viscosity for the unvulcanized domain rubber compositions are the Mooney viscosity $ML_{(1+4)}$ based on JIS K 6300-1: 2013 and were measured at the rubber temperature when all the materials constituting the unvulcanized domain rubber composition were being kneaded.

The unit for the SP value is $(J/cm^3)^{0.5}$, and DBP represents the DBP oil absorption ($cm^3$/100 g). The individual materials are given in Tables 5B-1 to 5B-3.

TABLE 5A-2

| Conductive member No. | Unvulcanized matrix-forming rubber composition: Starting material rubber Material abbreviation | SP value | Mooney viscosity | Conductive agent Type | Conductive agent Parts | Mooney viscosity | Unvulcanized rubber composition Domain Parts | Unvulcanized rubber composition Matrix Parts | Unvulcanized rubber dispersion Rotation rate rpm | Kneading time min | Vulcanizing agent Material | Vulcanizing agent Parts | Vulcanization accelerator Material | Vulcanization accelerator Parts |
|---|---|---|---|---|---|---|---|---|---|---|---|---|---|---|
| 1 | Butyl JSR Butyl 065 | 15.8 | 32 | — | — | 40 | 25 | 75 | 30 | 20 | Sulfur | 3 | TT | 3 |
| 2 | SBR T2003 | 17.0 | 33 | — | — | 52 | 24 | 76 | 30 | 20 | Sulfur | 2 | TT | 2 |
| 3 | SBR A303 | 17.0 | 46 | — | — | 52 | 15 | 85 | 30 | 20 | Sulfur | 3 | TBZTD | 1 |
| 4 | SBR A303 | 17.0 | 46 | — | — | 52 | 15 | 85 | 30 | 20 | Sulfur | 3 | TBZTD | 1 |
| 5 | BR T0700 | 17.1 | 43 | — | — | 53 | 21 | 79 | 30 | 20 | Sulfur | 3 | TT | 3 |
| 6 | EPDM Esplene301A | 17.0 | 44 | — | — | 48 | 15 | 85 | 30 | 20 | Sulfur | 3 | TET | 3 |
| 7 | EPDM Esplene505A | 16.0 | 47 | — | — | 52 | 25 | 75 | 30 | 20 | Sulfur | 3 | TET | 1 |
| 8 | EPDM Esprene505A | 16.0 | 47 | — | — | 52 | 25 | 75 | 30 | 5 | Sulfur | 3 | TET | 3 |
| 9 | SBR T1000 | 16.8 | 45 | — | — | 51 | 25 | 75 | 40 | 20 | Sulfur | 3 | TBZTD | 1 |
| 10 | — — | — | — | — | — | — | 100 | 0 | — | — | Sulfur | 3 | TBZTD | 1 |
| 11 | NBR N230SV | 19.2 | 32 | — | — | 37 | 25 | 75 | 30 | 20 | Sulfur | 3 | TBZTD | 1 |
| 12 | NBR N230SV | 19.2 | 32 | #7360 | 60 | 74 | 75 | 25 | 30 | 20 | Sulfur | 3 | TBZTD | 1 |
| 13 | NBR N260S | 17.2 | 46 | — | — | 51 | 25 | 75 | 30 | 20 | Sulfur | 3 | TBZTD | 1 |

With regard to the Mooney viscosity in the table, the values for the starting rubbers are the catalogue values provided by the particular manufacturer. The values of the Mooney viscosity for the unvulcanized matrix-forming rubber compositions are the Mooney viscosity $ML_{(1+4)}$ based on JIS K 6300-1: 2013 and were measured at the rubber temperature when all the materials constituting the unvulcanized matrix-forming rubber composition were being kneaded.

TABLE 5B-1

| Material abbreviation | | Material name | Product name | Manufacturer |
|---|---|---|---|---|
| Butyl | Butyl065 | Butyl rubber | JSR Butyl 065 | JSR Corporation |
| BR | T0700 | polybutadiene rubber | JSR T0700 | JSR Corporation |
| EPDM | Esprene301A | ethylene-propylene-diene rubber | Esprene 301A | Sumitomo Chemical Co., Ltd. |
| EPDM | Esprene505A | ethylene-propylene-diene rubber | Esprene 505A | Sumitomo Chemical Co., Ltd. |
| NBR | N260S | acrylonltrile-butadiene rubber | JSR N260S | JSR Corporation |
| NBR | N230SV | acrylonltrile-butadiene rubber | JSR N230SV | JSR Corporation |
| NBR | N230S | acrylonltrile-butadiene rubber | JSR N230S | JSR Corporation |
| NBR | N202S | acrylonltrile-butadiene rubber | JSR N220S | JSR Corporation |
| SBR | T2003 | styrene-butadiene rubber | TUFDENE 2003 | Asahi Kasei Corporation |
| SBR | T1000 | styrene-butadiene rubber | TUFDENE 1000 | Asahi Kasei Corporation |
| SBR | T2100 | styrene-butadiene rubber | TUFDENE 2100R | Asahi Kasei Corporation |
| SBR | A303 | styrene-butadiene rubber | ASAPREN 303 | Asahi Kasei Corporation |

TABLE 5B-2

| Material abbreviation | Material name | Product name | Manufacturer |
|---|---|---|---|
| #7360 | conductive carbon black | TOKABLACK #7360SB | Tokai Carbon Co., Ltd. |
| #5500 | conductive carbon black | TOKABLACK #5500 | Tokai Carbon Co., Ltd. |
| LV | ionic conductive agent | Adeka Cizer LV70 | ADEKA Corporation |

TABLE 5B-3

| Vulcanizing Agents and Vulcanization Accelerators | | | |
|---|---|---|---|
| Material abbreviation | Material name | Product name | Manufacturer |
| sulfur | sulfur | SULFAX PMC | Tsurumi Chemical Industry Co., Ltd. |
| TT | tetramethylthiuram disulfide | NOCCELER TT-P | Ouchi Shinko Chemical Industrial Co., Ltd. |
| TBZTD | tetrabenzylthiuram disulfide | Sanceler TBZTD | Sanshin Chemical Industry Co., Ltd. |
| TET | tetraethylthiuram disulfide | Sanceler TET-G | Sanshin Chemical Industry Co., Ltd. |

The methods for measuring the properties pertaining to the conductive member are as follows.

Confirmation of a Matrix-Domain Structure

The presence/absence of the formation of a matrix-domain structure in the conductive layer is checked using the following method.

Using a razor, a section (thickness=500 μm) is cut out so as to enable the cross section orthogonal to the longitudinal direction of the conductive layer of the conductive member to be observed. Platinum vapor deposition is then carried out and a cross-sectional image is photographed using a scanning electron microscope (SEM) (product name: S-4800, Hitachi High-Technologies Corporation) and a magnification of 1,000×.

Figure 2:
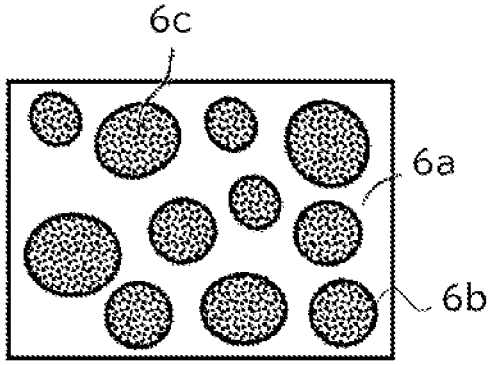
FIG. 2 is an enlarged cross-sectional diagram of a conductive layer.

A matrix-domain structure observed in the section from the conductive layer presents a morphology in which, in the cross-sectional image, a plurality of domains 6*b* are dispersed in a matrix 6*a* and the domains are present in an independent state without connection to each other, as in FIG. 2. 6*c* is an electronic conducting agent. The matrix, on the other hand, resides in a state that is continuous within the image with the domains being partitioned off by the matrix.

In order to quantify the obtained photographed image, a 256-gradation monochrome image is obtained by carrying out 8-bit grey scale conversion using image processing software (product name: Image-Pro Plus, Media Cybernetics, Inc.) on the fracture surface image yielded by the SEM observation. White/black reversal processing is then carried out on the image so the domains in the fracture surface become white, followed by generation of the binarized image with the binarization threshold being set based on the algorithm of Otsu's adaptive thresholding method for the brightness distribution of images.

Using the count function on this binarized image, and operating in a 50 μm-square region, the number percentage K is calculated for the domains that, as noted above, are isolated without connection between domains, with reference to the total number of domains that do not have a contact point with the enclosure lines for the binarized image.

Specifically, the count function of the image processing software is set to not count domains that have a contact point with the enclosure lines for the edges in the four directions of the binarized image.

The arithmetic-mean value (number %) for K is calculated by carrying out this measurement on the aforementioned sections prepared at a total of 20 points, as provided by randomly selecting 1 point from each of the regions obtained by dividing the conductive layer of the conductive member into 5 equal portions in the longitudinal direction and dividing the circumferential direction into 4 equal portions.

A matrix-domain structure is scored as being "present" when the arithmetic-mean value of K (number %) is equal to or greater than 80, and is scored as being "absent" when the arithmetic-mean value of K (number %) is less than 80.

Measurement of the Volume Resistivity R1 of the Matrix

The volume resistivity R1 of the matrix can be measured, for example, by excising, from the conductive layer, a thin section of prescribed thickness (for example, 1 μm) that contains the matrix-domain structure and bringing the microprobe of a scanning probe microscope (SPM) or atomic force microscope (AFM) into contact with the matrix in this thin section.

With regard to the excision of the thin section from the elastic layer, and, for example, as shown in FIG. 3B letting the X axis be the longitudinal direction of the conductive member, the Z axis be the thickness direction of the conductive layer, and the Y axis be its circumferential direction, the thin section is excised so as to contain at least a portion of a plane parallel to the YZ plane (for example, 83*a*, 83*b*, 83*c*), which is orthogonal to the axial direction of the conductive member. Excision can be carried out, for example, using a sharp razor, a microtome, or a focused ion beam technique (FIB).

The volume resistivity is measured by grounding one side of the thin section that has been excised from the conductive layer. The microprobe of a scanning probe microscope (SPM) or atomic force microscope (AFM) is brought into contact with the matrix part on the surface of the side opposite from the ground side of the thin section; a 50 V DC voltage is applied for 5 seconds; the arithmetic-mean value is calculated from the values measured for the ground current value for the 5 seconds; and the electrical resistance value is calculated by dividing the applied voltage by this calculated value. Finally, the resistance value is converted to the volume resistivity using the film thickness of the thin section. The SPM or AFM can also be used to measure the film thickness of the thin section at the same time as measurement of the resistance value.

For a column-shaped charging member, the value of the volume resistivity R1 of the matrix is determined, for example, by excising one thin section sample from each of the regions obtained by dividing the conductive layer into four parts in the circumferential and 5 parts in the longitudinal direction; obtaining the measurement values described above; and calculating the arithmetic-mean value of the volume resistivities for the total of 20 samples.

In the present examples, first a 1 μm-thick thin section was excised from the conductive layer of the conductive member at a slicing temperature of −100° C. using a microtome (product name: Leica EMFCS, Leica Microsystems GmbH). Using the X axis for the longitudinal direction of the conductive member, the Z axis for the thickness direction of the conductive layer, and the Y axis for its circumferential direction, as shown in FIG. 3B, excision was performed such that the thin section contained at least a portion of the YZ plane (for example, 83*a*, 83*b*, 83*c*), which is orthogonal with respect to the axial direction of the conductive member.

Operating in an environment having a temperature of 23° C. and a humidity of 50%, one side of the thin section (also referred to hereafter as the "ground side") was grounded on a metal plate, and the cantilever of a scanning probe microscope (SPM) (product name: Q-Scope 250, Quesant Instrument Corporation) was brought into contact at a location corresponding to the matrix on the side (also referred to hereafter as the "measurement side") opposite from the ground side of the thin section, and where domains were not present between the measurement side and ground side. A voltage of 50 V was then applied to the cantilever for 5 seconds; the current value was measured; and the 5-second arithmetic-mean value was calculated.

The surface profile of the section subjected to measurement was observed with the SPM and the thickness of the measurement location was calculated from the obtained height profile. In addition, the depressed portion area of the cantilever contact region was calculated from the results of observation of the surface profile. The volume resistivity was calculated from this thickness and this depressed portion area.

With regard to the thin sections, the aforementioned measurement was performed on sections prepared at a total of 20 points, as provided by randomly selecting 1 point from each of the regions obtained by dividing the conductive layer of the conductive member into 5 equal portions in the longitudinal direction and dividing the circumferential direction into 4 equal portions. The average value was used as the volume resistivity R1 of the matrix.

The scanning probe microscope (SPM) (product name: Q-Scope 250, Quesant Instrument Corporation) was operated in contact mode.

Measurement of the Volume Resistivity R2 of the Domains

The volume resistivity R2 of the domains is measured by the same method as for measurement of the matrix volume resistivity R1 as described above, but carrying out the measurement at a location corresponding to a domain in the ultrathin section and changing the measurement voltage to 1 V.

In the present examples, R2 was calculated using the same method as above (measurement of the matrix volume resistivity R1), but changing the voltage applied during measurement of the current value to 1 V and changing the location of cantilever contact on the measurement side to a location corresponding to a domain, and where the matrix was not present between the measurement side and ground side.

Measurement of the Circle-Equivalent Diameter D of Domains Observed from the Cross Section of the Conductive Layer The circle-equivalent diameter D of the domains is determined as follows.

Using L for the length in the longitudinal direction of the conductive layer and T for the thickness of the conductive layer, 1 μm-thick samples, having sides as represented by cross sections in the thickness direction (83*a*, 83*b*, 83*c*) of the conductive layer as shown in FIG. 3B, are sliced using a microtome (product name: Leica EMFCS, Leica Microsystems GmbH) from three locations, i.e., the center in the longitudinal direction of the conductive layer and at L/4 toward the center from either end of the conductive layer.

For each of the obtained three samples, platinum vapor deposition is performed on the cross section of the thickness direction of the conductive layer. Operating on the platinum vapor-deposited surface of each sample, a photograph is taken at 5,000× using a scanning electron microscope (SEM) (product name: S-4800, Hitachi High-Technologies Corporation) at three randomly selected locations within the thickness region that is a depth of 0.1 T to 0.9 T from the outer surface of the conductive layer.

Using image processing software (product name: Image-Pro Plus, Media Cybernetics, Inc.), each of the obtained nine photographed images is subjected to binarization and quantification using the count function and the arithmetic-mean value S of the area of the domains contained in each of the photographed images is calculated.

The circle-equivalent domain diameter ($=(4S/\pi)^{0.5}$) is then calculated from the calculated arithmetic-mean value S of the domain area for each of the photographed images. The arithmetic-mean value of the circle-equivalent domain diameter for each photographed image is subsequently calculated to obtain the circle-equivalent diameter D of the domains observed from the cross section of the conductive layer of the conductive member that is the measurement target.

Measurement of the Particle Size Distribution of the Domains

In order to evaluate the uniformity of the circle-equivalent diameter D of the domains, the particle size distribution of the domains is measured proceeding as follows. First, binarized images are obtained using image processing software (product name: Image-Pro Plus, Media Cybernetics, Inc.) from the 5,000× observed images obtained using a scanning electron microscope (product name: S-4800, Hitachi High-Technologies Corporation) in the above-described measurement of the circle-equivalent diameter D of the domains. Then, using the count function of the image processing software, the average value D and the standard deviation ad are calculated for the domain population in the binarized image, and σd/D, which is a metric of the particle size distribution, is subsequently calculated.

For the measurement of the σd/D particle size distribution of the domain diameters, and using L for the length in the longitudinal direction of the conductive layer and T for the thickness of the conductive layer, cross sections in the thickness direction of the conductive layer, as shown in FIG. 3B, are taken at three locations, i.e., the center in the longitudinal direction of the conductive layer and at L/4 toward the center from either end of the conductive layer. Operating at a total of 9 locations, i.e., 3 randomly selected locations in the thickness region at a depth of 0.1 T to 0.9 T from the outer surface of the conductive layer, in each of the 3 sections obtained at the aforementioned 3 measurement locations, a 50 μm-square region is extracted as the analysis image; the measurement is performed; and the arithmetic-mean value for the 9 locations is calculated.

Measurement of the Circle-Equivalent Diameter Ds of the Domains Observed from the Outer Surface of the Conductive Layer The circle-equivalent diameter Ds of the domains observed from the outer surface of the conductive layer is measured as follows.

A sample containing the outer surface of the conductive layer is excised using a microtome (product name: Leica EMFCS, Leica Microsystems GmbH) at three locations, i.e., the center in the longitudinal direction of the conductive layer and at L/4 toward the center from either end of the conductive layer where L is the length in the longitudinal direction of the conductive layer. The sample thickness is 1 μm.

Platinum vapor deposition is performed on the sample surface that corresponds to the outer surface of the conductive layer. Three locations are randomly selected on the platinum vapor-deposited surface of the sample and are photographed at 5,000× using a scanning electron microscope (SEM) (product name: S-4800, Hitachi High-Technologies Corporation). Using image processing software (product name: Image-Pro Plus, Media Cybernetics, Inc.), each of the obtained total of 9 photographed images is subjected to binarization and quantification using the count function, and the arithmetic-mean value Ss of the planar area of the domains present in each of the photographed images is calculated.

The circle-equivalent domain diameter ($=(4S/\pi)^{0.5}$) is then calculated from the calculated arithmetic-mean value Ss of the domain planar area for each of the photographed images. The arithmetic-mean value of the circle-equivalent domain diameter for each photographed image is then calculated to obtain the circle-equivalent diameter Ds of the domains in observation of the conductive member that is the measurement target from the outer surface.

Measurement of the Interdomain Distance Dm Observed from the Cross Section of the Conductive Layer Using L for the length in the longitudinal direction of the conductive layer and T for the thickness of the conductive layer, samples, having sides as represented by the cross sections in the thickness direction (83*a*, 83*b*, 83*c*) of the conductive layer as shown in FIG. 3B, are taken from three locations, i.e., the center in the longitudinal direction of the conductive layer and at L/4 toward the center from either end of the conductive layer.

For each of the obtained three samples, a 50 μm-square analysis region is placed, on the surface presenting the cross section in the thickness direction of the conductive layer, at three randomly selected locations in the thickness region from a depth of 0.1 T to 0.9 T from the outer surface of the conductive layer. These three analysis regions are photographed at a magnification of 5,000× using a scanning electron microscope (product name: S-4800, Hitachi High-Technologies Corporation). Each of the obtained total of 9 photographed images is binarized using image processing software (product name: LUZEX, Nireco Corporation).

The binarization procedure is carried out as follows. 8-bit grey scale conversion is performed on the photographed image to obtain a 256-gradation monochrome image. White/black reversal processing is carried out on the image so the domains in the photographed image become white, and binarization is performed to obtain a binarized image of the photographed image. For each of the 9 binarized images, the distances between the domain wall surfaces are then calculated, and the arithmetic-mean value of these is calculated. This is designated Dm. The distance between the wall surfaces is the distance between the wall surfaces of domains that are nearest to each other (shortest distance), and can be determined by setting the measurement parameters in the image processing software to the distance between adjacent wall surfaces.

Measurement of the Uniformity of the Interdomain Distance Dm

The standard deviation σm of the interdomain distance is calculated from the distribution of the distance between the domain wall surfaces obtained in the procedure described above for measuring the interdomain distance Dm, and the variation coefficient σm/Dm, with is a metric of the uniformity of the interdomain distance, is calculated.

Measurement of Distance Dms between Adjacent Walls of Domains Observed from Outer Surface of Conductive Member Defining L as the length of the conductive layer in the longitudinal direction and T as the thickness of the conductive layer, a sample is excised using a razor so as to contain the outer surface of the conductive member, at three locations, i.e., the center of the conductive layer in the longitudinal direction and at L/4 toward the center from each end of the conductive layer. The sample size is 2 mm in the circumferential direction of the conductive member and 2 mm in the longitudinal direction of the conductive member, and the thickness T of the conductive member is used for the thickness.

For each of the obtained three samples, a 50 μm-square analysis region is placed at three randomly selected locations on the side corresponding to the outer surface of the conductive member, and these three analysis regions are photographed at a magnification of 5,000× using a scanning electron microscope (product name: S-4800, Hitachi High-Technologies Corporation). Each of the obtained total of 9 photographed images is binarized using image processing software (product name: LUZEX, Nireco Corporation).

The binarization procedure is the same binarization procedure as in the determination of the interdomain distance Dm as described above. For each of the binarized images from the nine photographed images, the distance between the walls of the domains is determined and the arithmetic average value of these values is calculated. This value is designated Dms.

TABLE 6

| Conductive member No. | MD structure | Volume resistivity R1 [Ω · cm] | Volume resistivity R2 [Ω · cm] | Domain diameter D [μm] (cross section) | Domain diameter Ds [μm] (surface) | σd/D | Interdomain distance Dm [μm] | σm/Dm | R1 > R2 | R1/R2 (times) |
|---|---|---|---|---|---|---|---|---|---|---|
| 1 | present | 5.83 × 10^16 | 1.66 × 10^1 | 0.20 | 0.20 | 0.25 | 0.22 | 0.24 | Y | 3.51E+15 |
| 2 | present | 2.62 × 10^12 | 6.23 × 10^1 | 1.20 | 1.20 | 0.24 | 1.22 | 0.22 | Y | 4.21E+10 |
| 3 | present | 2.08 × 10^12 | 2.14 × 10^5 | 1.84 | 1.85 | 0.22 | 0.44 | 0.26 | Y | 9.72E+06 |
| 4 | present | 2.09 × 10^12 | 2.08 × 10^6 | 1.78 | 1.79 | 0.22 | 0.44 | 0.25 | Y | 1.00E+06 |
| 5 | present | 7.00 × 10^15 | 2.17 × 10^1 | 1.12 | 1.12 | 0.22 | 1.12 | 0.23 | Y | 3.23E+14 |
| 6 | present | 4.81 × 10^15 | 9.03 × 10^3 | 2.35 | 2.35 | 0.22 | 2.35 | 0.22 | Y | 5.33E+11 |
| 7 | present | 2.01 × 10^15 | 5.47 × 10^1 | 4.55 | 4.55 | 0.22 | 4.55 | 0.22 | Y | 3.67E+13 |
| 8 | present | 6.21 × 10^15 | 5.87 × 10^1 | 5.65 | 5.67 | 0.38 | 6.80 | 0.30 | Y | 1.06E+14 |
| 9 | present | 1.08 × 10^14 | 2.59 × 10^1 | 0.18 | 0.19 | 0.28 | 0.10 | 0.29 | Y | 4.17E+12 |
| 10 | absent | — | — | — | — | — | — | — | — | — |
| 11 | present | 2.58 × 10^9 | 5.21 × 10^1 | 2.30 | 2.33 | 0.21 | 0.23 | 0.26 | Y | 4.95E+07 |
| 12 | present | 9.18 × 10^2 | 2.56 × 10^15 | 2.50 | 2.53 | 0.26 | 2.20 | 0.22 | N | 3.59E−13 |
| 13 | present | 9.8 × 10^10 | 1.10 × 10^3 | 0.20 | 0.22 | 0.24 | 0.24 | 0.25 | Y | 8.91E+07 |

In the table, a term such as, for example, 10^16 indicates $10^{16}$. In addition, for example, "2.75E+15" indicates "$2.75\times10^{15}$", and "3.59E-13" indicates "$3.59\times10^{-13}$". The "MD structure" refers to the presence/absence of a matrix-domain structure. In the R1>R2 column, a Y indicates that R1>R2 has been established, while an N indicates that R1>R2 has not been established.

Conductive Members 2 to 13 Production Example

Conductive members 2 to 13 were produced proceeding as for conductive member 1, but using the materials and conditions indicated in Table 5A-1 and Table 5A-2 with regard to the starting rubber, conductive agent, vulcanizing agent, and vulcanization accelerator.

The details for the materials indicated in Table 5A-1 and Table 5A-2 are given in Table 5B-1 for the rubber materials, Table 5B-2 for the conductive agents, and Table 5B-3 for the vulcanizing agents and vulcanization accelerators.

The properties of the obtained conductive members 2 to 13 are given in Table 6.

The methods used to measure the various properties of the toners are described here below.

Separation of Magnetic Bodies from Toner

Measurement of the properties can also be carried out using magnetic bodies separated from the toner using the following method.

1 g of the toner is first added to a 50-mL vial.

20 g tetrahydrofuran (THF) is then added and thorough stirring is performed. A neodymium magnet is subsequently applied to the bottom of the vial from the outside, and the THF solution in the vial is discarded while retaining the magnetic bodies.

The process of adding THF, stirring, and discarding the THF solution is carried out 100 times, and, after isolation of the magnetic bodies, vacuum drying is carried out for 48 hours at 40° C. to isolate the magnetic bodies.

Method for Measuring Number-Average Primary Particle Diameter Dmg of Magnetic Bodies The number-average primary particle diameter Dmg of the magnetic bodies is measured using an "S-4800" scanning electron microscope (product name, Hitachi, Ltd.). The toner to be observed is thoroughly dispersed in an epoxy resin, followed by curing for 2 days in an atmosphere with a temperature of 40° C. to obtain a cured material. Thin section samples are made from the obtained cured material using a microtome; images are photographed using the S-4800 at magnifications from 10,000× to 40,000×; and the projected area of 100 magnetic body primary particles in this image is measured. Using the circle-equivalent diameter equal to this projected area as the primary particle diameter for the magnetic bodies, the average value of the 100 is used as the number-average primary particle diameter of the magnetic bodies.

The observation magnification is adjusted as appropriate depending on the size of the magnetic bodies. When the magnetic bodies can be acquired as such, the magnetic bodies can be measured alone using the aforementioned method.

Method for Measuring Occurrence Percentage of Magnetic Bodies in 10% Region

The following method is used to measure the degree of surface segregation of the magnetic bodies in the toner cross section observed using a transmission electron microscope (TEM).

The toner to be observed is first thoroughly dispersed in a normal temperature-curable epoxy resin.

A cured material is then obtained by curing for 2 days in an atmosphere having a temperature of 40° C.; this cured material, either as such or after freezing, is converted into thin section samples using a microtome equipped with diamond blade; and observation is carried out. For the toner particle cross section that is the observation target, the circle-equivalent diameter is determined from the projected area of the cross section in the TEM image (projected area circle-equivalent diameter), and the toner particle cross section is used when this value is contained in the window that is ±10% of the number-average particle diameter (D1) (μm) of the toner.

A transmission electron microscope (Model H-600, Hitachi, Ltd.) is used as the instrument; observation is performed at an acceleration voltage of 100 kV; and the measurement is carried out using a micrograph for which the magnification is 10,000×.

The magnetic bodies in the observed image are binarized as follows using "ImageJ" image processing software (available from https://imagej.nih.gov/ij/).

At this point, the observed image is binarized by selecting "Image-Adjust-Threshold" and setting the threshold, using the displayed dialog box, so the entire toner particle cross section is extracted. Using the same procedure, the same image is binarized with only the threshold changed so only the magnetic bodies are extracted.

Using the binarized image, a line is drawn from the geometric center of the toner particle cross section to a point on the contour (toner particle surface) of the toner particle cross section. The location on this line that is 10% of the distance from the contour to the geometric center is identified. This operation is carried out on the contour of the toner particle cross section over one circuit to specify the region not more than 10% of the distance from the toner particle contour to the geometric center of the cross section.

The percentage is calculated for the area of the magnetic bodies that are present in the region that is not more than 10% of the distance from the toner particle contour to the geometric center of the cross section, with reference to the total area of the magnetic bodies that are present in the toner particle cross section. 100 toner particles are observed and the arithmetic average value thereof is used.

Method for Observing Cross Section of Ruthenium-Stained Toner by Transmission Electron Microscope (TEM)

Cross-sectional observation of the toner with a transmission electron microscope (TEM) can be performed as follows. The cross section of the toner is observed by staining with ruthenium. For example, a crystalline resin or the like included in the toner is stained with ruthenium more than an amorphous resin such as a binder resin, so that the contrast becomes clear and observation is facilitated. Since the amount of ruthenium atoms differs depending on the intensity of the staining, the strongly stained portion includes many of these atoms, does not transmit the electron beam, and becomes black on the observed image, and the weakly stained portion easily transmits the electron beam and becomes white on the observed image.

First, a toner is sprayed on a cover glass (Matsunami Glass Co., Ltd., angular cover glass, Square Shape No. 1) so as to form a monolayer, and an Os film (5 nm) and a naphthalene film (20 nm) are coated as protective films by using an Osmium Plasma Coater (filgen, Inc., OPC80T).

Next, a PTFE tube (ϕ1.5 mm (inner diameter)×ϕ3 mm (outer diameter)×3 mm) is filled with a photocurable resin D800 (JEOL, Ltd.), and the cover glass is placed quietly on the tube in the orientation such that the toner contacts the photocurable resin D800. After curing the resin by irradiation with light in this state, the cover glass and the tube are removed to form a columnar resin in which the toner is embedded on the outermost surface.

The columnar resin is cut at a distance equal to the radius of the toner (4.0 μm when the weight-average particle diameter (D4) is 8.0 μm) from the outermost surface at a cutting speed of 0.6 mm/s by using an ULTRASONIC ULTRAMICROTOME (Leica Microsystems Inc., UC7) to open the cross section of the toner. Next, cutting is performed to obtain a film thickness of 250 nm and prepare a slice sample having the toner cross section. By cutting in such a manner, a cross section of the toner central portion is obtained.

The obtained slice sample is stained in a $RuO_4$ gas at a 500 Pa atmosphere for 15 min using a vacuum electron dyeing apparatus (filgen, Inc., VSC4R1H), and TEM observation is performed using a TEM (JEOL, Ltd., JEM2800).

An image with a TEM probe size of 1 nm and an image size of 1,024 pixels×1,024 pixels is acquired. Also, the Contrast of the Detector Control panel of the bright image field is adjusted to 1425, the Brightness to 3750, the Contrast of the Image Control panel to 0.0, the Brightness to 0.5, and the Gamma to 1.00.

Measurement of Area Percentages A1 and A2

A1 and A2 are measured as described in the following using the ruthenium-stained TEM image.

Next, the obtained TEM image is binarized using image processing software "ImageJ" (available from https://imagej.Nih.gov/ij/). Thereafter, a circle equivalent diameter (projected area circle equivalent diameter) is obtained from the binarized image of the cross section, and a cross section for which the value of the circle equivalent diameter is included in a range of ±5% of the number-average particle diameter (D1) (μm) of the toner is selected.

From the TEM image of the corresponding particles, regions other than those necessary for the measurement are masked using "ImageJ", and the area of the unmasked region inside the toner outline and the total area of the magnetic bodies present in the unmasked region are calculated. A method for obtaining the area ratio A1 using this method will be specifically described hereinbelow.

First, binarization is performed so that the contour and the inside of the obtained TEM image (hereinafter, referred to as image 1) of the contour of the cross section of the toner particle are white, and the other background portions are black (hereinafter, referred to as image 2).

Next, in order to calculate the magnification of the mask, the length per unit pixel in the image 1 is calculated. Next, from the calculated value, the number of pixels fit in 200 nm, which is the distance from the contour of the toner particle to the boundary line of the region A, is calculated (hereinafter referred to as x1). Similarly, the number of pixels fit in the toner particle diameter measured by using the above-described method is likewise calculated (hereinafter referred to as x2). Then, the magnification M of the mask is calculated from (x2−x1)/x2.

Next, the image 2 is reduced to the calculated magnification M (the reduced image is referred to as image 3). At this time, the settings are such that the toner particle contour and the inside are black, unlike the image 2, and other background portions are white (become transparent).

Next, the image 2 and the image 3 are added. At this time, the image 2 and the image 3 are added using "Image Calculator" which is a function of "ImageJ", and an image 4 is created, in which the region from the contour of the toner particle to 200 nm toward the geometric center of the toner particle is white, and the other parts are black. The area S1 of the white region in the image 4 is measured.

Next, the created image 4 and the aforementioned TEM image are similarly added using "Image Calculator" to create an image 5 in which the region outside the measurement segment is masked. The image 5 is binarized, and a magnetic body area S2 in the mask is measured.

Finally the area percentage A1 occupied by the magnetic bodies in the region A is calculated by S2/S1×100.

Regarding the area percentage A2, the calculation is performed by the same procedure except that the range of the region is changed to from 200 nm to 400 nm to the geometric center.

Measurement of E2/E1 Value Using X-ray Photoelectron Spectroscopic Analysis (ESCA)

The following method is used to measure the ratio (E2/E1) of the abundance (E2) of the element iron to the abundance (E1) of the element carbon present at the surface of the toner particle, as measured by photoelectron spectroscopic analysis (ESCA).

The external additive and so forth attached to the toner particle surface is removed from the toner and the toner particle is used for the measurement target.

1 g of the toner is suspended in 20 mL of methanol and the external additive is detached from the toner particle by ultrasound treatment for 30 minutes using an SC-103 ultrasound disperser (SMT Co., Ltd.), and standing at quiescence is carried out for 24 hours.

The sedimented toner particles and the external additive dispersed in the supernatant are separated and recovered; the toner particles are isolated by drying for 48 hours at 40° C.; and ESCA measurement is then performed.

The ESCA instrument and measurement conditions are as follows.

instrument used: Model 1600S x-ray photoelectron spectrometer, Ulvac-Phi, Incorporated measurement conditions: Mg Kα (400 W) x-ray source spectral region: 800 μmφ

The surface atomic concentrations are calculated, using the relative sensitivity factors provided by Ulvac-Phi, Incorporated, from the peak intensities measured for each element. The peak top ranges for each element are as follows.

C: 283 to 293 eV

Fe: 706 to 730 eV

Using the peak top ranges for the individual elements, the E1 value, i.e., the height where the peak range originating with the element carbon present at the toner particle surface corresponds to 283 to 293 eV, and the E2 value, i.e., the height where the peak range originating with the element iron corresponds to 706 to 730 eV, are calculated and their ratio E2/E1 is calculated.

Method for Measuring Particle Diameter of Toner (Toner Particle)

A "Multisizer (R) 3 Coulter Counter (product name)" precise particle size distribution analyzer (Beckman Coulter, Inc.) based on the pore electrical resistance method and a dedicated "Beckman Coulter Multisizer 3 Version 3.51 (product name)" software (Beckman Coulter, Inc.) are used. An aperture tube having diameter of 100 μm is used, and measurement is performed with 25000 effective measurement channels, and analyzing measurement data and calculating.

The aqueous electrolytic solution used in measurement may be a solution of special grade sodium chloride dissolved in ion-exchanged water to a concentration of about 1 mass %, such as "ISOTON II (product name)" (Beckman Coulter, Inc.) for example.

The following settings are performed on the dedicated software prior to measurement and analysis.

On the "Change standard measurement method (SOM)" screen of the dedicated software, the total count number in control mode is set to 50000 particles, the number of measurements to 1, and the Kd value to a value obtained with "Standard particles 10.0 μm" (Beckman Coulter, Inc.). The threshold noise level is set automatically by pushing the "Threshold/noise level measurement" button. The current is set to 1600 μA, the gain to 2, and the electrolyte solution to ISOTON II (product name), and a check is entered for "Aperture tube flush after measurement".

On the "Conversion settings from pulse to particle diameter" screen of the dedicated software, the bin interval is set to the logarithmic particle diameter, the particle diameter bins to 256, and the particle diameter range to 2 μm to 60 μm.

The specific measurement methods are as follows.

(1) About 200 ml of the aqueous electrolytic solution is added to a dedicated glass 250 ml round-bottomed beaker of the Multisizer 3, the beaker is set on the sample stand, and stirring is performed with a stirrer rod counter-clockwise at a rate of 24 rps. Contamination and bubbles in the aperture tube are then removed by the "Aperture flush" function of the dedicated software.

(2) 30 ml of the same aqueous electrolytic solution is placed in a glass 100 ml flat-bottomed beaker, and about 0.3 ml of a dilution of "Contaminon N (product name)" (a 10% by mass aqueous solution of a neutral detergent for washing precision instruments, manufactured by Wako Pure Chemical Industries, Ltd.) diluted 3-fold by mass with ion-exchange water is added.

(3) The prescribed amount of ion-exchange water is added to the water tank of an ultrasonic disperser "Ultrasonic Dispersion System Tetra150 (product name)" (Nikkaki Bios Co., Ltd.) is prepared with an electrical output of 120 W equipped with two built-in oscillators having an oscillating frequency of 50 kHz with their phases shifted by 180° from each other, and about 2 ml of Contaminon N (product name) is added to the tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as about 10 mg of toner particle is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner particle dispersed therein is dripped with a pipette into the round-bottomed beaker of (1) above set on the sample stand, and adjusted to a measurement concentration of about 5%. Measurement is then performed until the number of measured particles reaches 50000.

(7) The measurement data is analyzed with the dedicated software included with the apparatus, and the weight-average particle diameter (D4) and Number Average Particle Diameter (D1) are calculated. The weight-average particle diameter (D4) is the "Average diameter" on the "Analysis/volume statistical value (arithmetic mean)" screen when graph/volume % is set in the dedicated software. The Number Average Particle Diameter (D1) is the "Average diameter" on the "Analysis/number statistic value (arithmetic mean)" screen when graph/number % is set in the dedicated software.

The D4 obtained proceeding as indicated above is used in the present disclosure as the number-average particle diameter (Dt) of the toner.

Method for Measuring Weight-Average Molecular Weight (Mw) and Peak Molecular Weight (Mp) of, e.g., Resins The weight-average molecular weight (Mw) and the peak molecular weight (Mp) of the resins and other materials are measured using gel permeation chromatography (GPC) as follows.

(1) Preparation of Measurement Sample

The sample and tetrahydrofuran (THF) are mixed at a concentration of 5.0 mg/mL; standing is carried out for 5 to 6 hours at room temperature; and thorough shaking is then carried out and the THF and sample are well mixed until there is no sample aggregation. Additional standing at quiescence at room temperature for at least 12 hours is performed. During this process, the time from the sample+THF mixing starting point to the end point of standing at quiescence is brought to at least 72 hours, to obtain the tetrahydrofuran (THF) soluble matter of the sample.

A sample solution is then obtained by filtration across a solvent-resistant membrane filter (pore size from 0.45 to 0.50 μm, Sample Pretreatment Cartridge H-25-2 [Tosoh Corporation]).

(2) Measurement of Sample

Measurement is carried out under the following conditions using the obtained sample solution.

instrument: LC-GPC 150C high-performance GPC instrument (Waters Corporation)

column: 7-column train of Shodex GPC KF-801, 802, 803, 804, 805, 806, and 807

(Showa Denko Kabushiki Kaisha)

mobile phase: THF flow rate: 1.0 mL/min column temperature: 40° C.

sample injection amount: 100 μL detector: RI (refractive index) detector

With regard to measurement of the sample molecular weight, the molecular weight distribution possessed by the sample is calculated from the relationship between the logarithmic value and number of counts in a calibration curve constructed using multiple monodisperse polystyrene reference samples.

The molecular weights of the polystyrene reference samples used to construct the calibration curve are as follows (from Pressure Chemical Co. or Tosoh Corporation): $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$.

Method for Measuring the Glass Transition Temperature (Tg)

The glass transition temperature (Tg) of, e.g., the toner, is measured using a "Q2000" differential scanning calorimeter (TA Instruments) in accordance with ASTM D 3418-82.

A 2 mg measurement sample is precisely weighed out and introduced into an aluminum pan; an empty aluminum pan is used for reference.

From 30° C. to 200° C. is used as the measurement temperature range. The temperature is raised from 30° C. to 200° C. at a ramp rate of 10° C./min; cooling is then carried out from 200° C. to 30° C. at a ramp down rate of 10° C./min; and the temperature is subsequently raised again to 200° C. at a ramp rate of 10° C./min.

Using the DSC curve obtained in this second ramp up step, the glass transition temperature (Tg) is taken to be the point at the intersection between the differential heat curve and the line for the midpoint for the baselines for prior to and subsequent to the appearance of the change in the specific heat.

Method for Measuring Dielectric Loss Tangent tan δ and Relative Permittivity εr

Preparation of Toner Pellet

The toner is placed in a 25 mm-diameter tool for pellet preparation, and a pellet having a thickness of approximately 1.5 mm is then prepared by the application of pressure for one minute using a Newton press and a pressure condition of 20 MPa. The weighed out amount of the toner is adjusted to provide a pellet thickness of from 1.5 mm to 1.8 mm. The resulting pellet is held for at least 24 hours in a normal-temperature, normal-humidity (temperature=23° C., relative humidity=50% RH) environment to yield the measurement sample. The average value of the pellet thickness measured at 10 points with calipers is used as the sample thickness.

Measurement of Dielectric Loss Tangent tan δ and Relative Permittivity εr

The measurement is run using a Model 1260 frequency response analyzer (Solartron), a Model 1296 dielectric constant measurement interface (Solartron), and a Model 12962 sample holder for dielectric constant measurements (Solartron).

The fabricated toner pellet is placed in the sample holder and an AC voltage is applied and the impedance is measured. The AC voltage application condition is 0.1 V pp, and the set frequency is 1 Hz to 1 MHz.

Analysis is carried out using ZView impedance analysis software (ZPlot and ZView for Windows from Scribner Associates). The dielectric loss tangent tan δ and relative permittivity εr are calculated as follows from the values of Z' and Z" obtained from the analysis. The values for the dielectric loss tangent tan δ and relative permittivity εr in both instances are the values when the measurement frequency is $1.0\times10^3$ Hz.

$$\tan\delta = Z'/Z'' \quad \text{formula (1)}$$

$$\varepsilon r = \varepsilon/\varepsilon_0 \quad \text{formula (2)}$$

(In formula (2), ε is the permittivity determined according to formula (3) and $\varepsilon_0$ is the vacuum permittivity ($=8.85\times10^{-12}$ F/m).)

$$\varepsilon = \{Z''/(-\omega\times(Z'^2+Z''^2))\}\times D/S \quad \text{formula (3)}$$

(In formula (3), ω is determined by formula (4), D is the thickness of the fabricated toner pellet, and S is the electrode area of the sample holder.)

$$\omega = 2\times\pi\times f \quad \text{formula (4)}$$

(In formula (4), f is the measurement frequency.)

Method for Measuring Volume Resistivity of Particle A

The volume resistivity of the particle A is measured proceeding as follows. A Model 6517 Electrometer (Keithley Instruments, Inc.)/high-resistance system is used for the instrumentation. 25 mm-diameter electrodes are connected, the particle A is placed between the electrodes to provide a thickness of 0.5 mm, and the gap between the electrodes is measured while applying a load of approximately 2.0 N (approximately 204 gf).

The resistance is measured after the application of a voltage of 1,000 V for 1 minute to the particle A, and the volume resistivity is calculated using the following formula.

volume resistivity (Ω·cm)=R×L

R: resistance value (Ω)

L: distance between electrodes (cm)

Method for Isolation from Toner when Particle a is Magnetic Body

When particle A is a magnetic body, the volume resistivity can also be measured using the magnetic bodies separated from the toner using the following method.

1 g of the toner is first added to a 50-mL vial.

20 g tetrahydrofuran (THF) is then added and thorough stirring is performed. A neodymium magnet is subsequently applied to the bottom of the vial from the outside, and the THF solution in the vial is discarded while retaining the magnetic bodies.

The process of adding THF, stirring, and discarding the THF solution is carried out 100 times, and, after isolation of the magnetic bodies, vacuum drying is carried out for 48 hours at 40° C. to obtain the magnetic bodies.

Method for Measuring Wettability of Magnetic Body Versus Methanol/Water Mixed Solvent A "WET-100P" powder wettability tester (Rhesca Co., Ltd.) is used in the wettability test of the magnetic body versus a methanol/water mixed solvent; the measurement is performed using the following conditions and procedures; and the obtained methanol addition/transmittance curve is used for the calculation.

A fluororesin-coated spindle-shaped stirring bar having a length of 25 mm and a maximum diameter of 8 mm is introduced into a cylindrical glass container having a thickness of 1.75 mm and a diameter of 5 cm.

60.0 mL of distilled water is introduced into this cylindrical glass container and treatment is performed for 5 minutes with an ultrasound disperser in order to remove the air bubbles and so forth. Into this is exactly weighed 1.0 g of the magnetic body that is the specimen, to prepare the measurement sample solution.

While stirring is carried out in the cylindrical glass container with the spindle-shaped stirring bar at a rate of 300 rpm using a magnetic stirrer, methanol is continuously added at a dropwise addition rate of 0.8 mL/min through the powder wettability tester into the measurement sample solution.

The transmittance for light with a wavelength of 780 nm is measured and a methanol addition/transmittance curve is constructed. The methanol concentration a (volume %) and b (volume %) when a transmittance of 50% is exhibited is read from the obtained methanol addition/transmittance curve.

This methanol concentration is the value calculated from (volume of methanol present in the cylindrical glass container/volume of the methanol+water mixture present in the cylindrical glass container)×100.

Magnetic Body 1 Production Example 1.0 equivalent, with reference to the iron ion, of a sodium hydroxide solution (contained sodium hexametaphosphate at 1 mass % as P with reference to Fe) was mixed into an aqueous ferrous sulfate solution to prepare an aqueous solution that contained ferrous hydroxide. While maintaining the aqueous solution at pH 9, air was bubbled in and an oxidation reaction was run at 80° C. to prepare a slurry in which seed crystals were produced.

An aqueous ferrous sulfate solution was then added to the slurry so as to provide 1.0 equivalents with reference to the initial amount of alkali (sodium component in the sodium hydroxide). The slurry was held at pH 8 and an oxidation reaction was run while bubbling in air; the pH was adjusted to 6 at the end of the oxidation reaction; and washing with water and drying yielded a magnetic iron oxide 1, which was a spherical magnetite particle and had a number-average primary particle diameter of 200 nm.

10.0 kg of the magnetic iron oxide 1 was introduced into a Simpson Mix Muller (Model MSG-0L, SINTOKOGIO, Ltd.) and milling was performed for 30 minutes.

This was followed by the addition to this same device of 110 g of n-decyltrimethoxysilane as a silane coupling agent and operation for 1 hour to hydrophobically treat the particle surface of the magnetic iron oxide 1 with the indicated silane coupling agent, thus yielding magnetic body 1.

The resulting magnetic body 1 had a spherical particle shape and a number-average primary particle diameter of 200 nm. Its volume resistivity was $6.8\times10^{8}$ Ω·cm.

The content of the hydrophobic treatment agent and the results of measurement of the hydrophobicity are given in Table 7 for the obtained magnetic body.

Magnetic Body 2 Production Example

By changing the production conditions for the magnetic iron oxide 1 in the Magnetic Body 1 Production Example, a magnetic iron oxide 2 was obtained that was a spherical magnetite particle and had a number-average primary particle diameter of 280 nm.

10.0 kg of the magnetic iron oxide 2 was introduced into a Simpson Mix Muller (Model MSG-0L, SINTOKOGIO, Ltd.) and milling was performed for 30 minutes.

This was followed by the addition to this same device of 85 g of n-decyltrimethoxysilane as a silane coupling agent and operation for 1 hour to hydrophobically treat the particle surface of the magnetic iron oxide 2 with the indicated silane coupling agent, thus yielding magnetic body 2.

The resulting magnetic body 2 had a spherical particle shape and a number-average primary particle diameter of 280 nm.

The content of the hydrophobic treatment agent and the results of measurement of the hydrophobicity are given in Table 7 for the obtained magnetic body.

Magnetic Body 3 Production Example 1.0 equivalent, with reference to the iron ion, of a sodium hydroxide solution (contained sodium hexametaphosphate at 1 mass % as P with reference to Fe) was mixed into an aqueous ferrous sulfate solution to prepare an aqueous solution that contained ferrous hydroxide. While maintaining the aqueous solution at pH 9, air was bubbled in and an oxidation reaction was run at 80° C. to prepare a slurry in which seed crystals were produced.

An aqueous ferrous sulfate solution was then added to the slurry so as to provide 1.0 equivalents with reference to the initial amount of alkali (sodium component in the sodium hydroxide). The slurry was held at pH 8 and an oxidation reaction was run while bubbling in air, and the pH was adjusted to 6 at the end of the oxidation reaction to obtain a magnetic iron oxide 3.

1.25 parts, per 100 parts of the obtained magnetic iron oxide 3, of isobutyltrimethoxysilane (number of carbons=4) was added as silane coupling agent and a wet-method hydrophobic treatment was performed with thorough stirring.

The thusly obtained hydrophobically treated magnetic iron oxide particles were washed, filtered, and dried using the usual procedures; the aggregated particles were then broken up; and a heat treatment was subsequently run for 5 hours at a temperature of 70° C. to obtain magnetic body 3. The properties are given in Table 7.

Magnetic Body 4 Production Example

A magnetic body 4 was obtained proceeding as in the Magnetic Body 1 Production Example, but adjusting the amount of addition of the hydrophobic treatment agent in the Magnetic Body 1 Production Example to provide the values in Table 7 for the resulting magnetic body for the content of the hydrophobic treatment agent and the hydrophobicity. The properties are given in Table 7.

Production Example for Magnetic Bodies 5 and 6

Magnetic bodies 5 and 6 were obtained proceeding as in the Magnetic Body 3 Production Example, but adjusting the amount of addition of the hydrophobic treatment agent in the Magnetic Body 3 Production Example to provide the values in Table 7 for the resulting magnetic bodies for the content of the hydrophobic treatment agent and the hydrophobicity. The properties are given in Table 7.

Magnetic Body 7 Production Example

A magnetic iron oxide 4 was obtained proceeding as in the Magnetic Body 1 Production Example, but adjusting the production conditions in the Magnetic Body 1 Production Example so as to provide the desired value for the number-average primary particle diameter of the resulting magnetic iron oxide.

10.0 kg of the magnetic iron oxide 4 was introduced into a Simpson Mix Muller (Model MSG-0L, SINTOKOGIO, Ltd.) and milling was performed for 30 minutes to obtain magnetic body 7. The properties are given in Table 7.

Magnetic Body 8 Production Example

A magnetic iron oxide 5 was obtained proceeding as in the Magnetic Body 1 Production Example, but adjusting the production conditions in the Magnetic Body 1 Production Example so as to provide the desired value for the number-average primary particle diameter of the resulting magnetic iron oxide.

10.0 kg of the magnetic iron oxide 5 was introduced into a Simpson Mix Muller (Model MSG-0L, SINTOKOGIO, Ltd.) and milling was performed for 30 minutes to obtain magnetic body 8. The properties are given in Table 7.

TABLE 7

| Particle A | Base material in magnetic body | Surface treatment apparatus | hydrophobic treatment agent | Dmg (nm) | Amount of hydrophobic treatment agent (mass %) | Hydrophobicity by methanol wettability | Volume resistivity (Ω · cm) |
|---|---|---|---|---|---|---|---|
| Magnetic body 1 | Mmagnetic iron oxide 1 | Mix Muller | n-decyltrimethoxysilane | 200 | 1.10 | 66 | 6.8 × 10^8 |
| Magnetic body 2 | Mmagnetic iron oxide 2 | Mix Muller | n-decyltrimethoxysilane | 280 | 0.85 | 65 | 8.5 × 10^8 |
| Magnetic body 3 | Mmagnetic iron oxide 3 | Wet method | isobutyltrimethoxysilane | 280 | 1.25 | 63 | 5.3 × 10^4 |
| Magnetic body 4 | Mmagnetic iron oxide 1 | Mix Muller | n-decyltrimethoxysilane | 200 | 0.50 | 51 | 4.3 × 10^8 |
| Magnetic body 5 | Mmagnetic iron oxide 3 | Wet method | isobutyltrimethoxysilane | 280 | 1.50 | 71 | 3.1 × 10^4 |
| Magnetic body 6 | Mmagnetic iron oxide 3 | Wet method | isobutyltrimethoxysilane | 280 | 2.00 | 75 | 1.3 × 10^4 |
| Magnetic body 7 | Mmagnetic iron oxide 4 | none | none | 320 | — | 30 | 3.4 × 10^4 |
| Magnetic body 8 | Mmagnetic iron oxide 5 | none | none | 150 | — | 31 | 2.3 × 10^4 |

In the table, terms such as, for example, 10^8, indicate $10^8$.

Polyester Resin 1 Production Example

| | |
|---|---|
| terephthalic acid | 30.0 parts |
| trimellitic acid | 5.0 parts |
| propylene oxide (2 mol) adduct on bisphenol A | 170.0 parts |
| dibutyltin oxide | 0.1 parts |

These materials were introduced into a heat-dried two-neck flask, nitrogen gas was introduced into the container, and the temperature was raised while stirring and maintaining the inert atmosphere. After this, a condensation polymerization reaction was run while raising the temperature from 140° C. to 220° C. over approximately 12 hours; this was followed by running the polycondensation reaction in the 210° C. to 240° C. range while reducing the pressure to obtain a polyester resin 1.

Polyester resin 1 had a number-average molecular weight (Mn) of 21200, a weight-average molecular weight (Mw) of 84500, and a glass transition temperature (Tg) of 79.5° C.

Toner 1 Production Example

An aqueous medium containing a dispersion stabilizer was obtained by introducing 450 parts of a 0.1 mon aqueous $Na_3PO_4$ solution into 720 parts of deionized water and heating to a temperature of 60° C. and then adding 67.7 parts of a 1.0 mon aqueous $CaCl_2$ solution.

| | |
|---|---|
| styrene | 75.00 parts |
| n-butyl acrylate | 25.00 parts |
| polypropylene glycol #400 diacrylate (APG400) | 1.70 parts |
| polyester resin 1 | 5.00 parts |
| magnetic body 1 | 65.00 parts |

This formulation was dispersed and mixed to uniformity using an attritor (Nippon Coke & Engineering Co., Ltd.).

The resulting monomer composition was heated to a temperature of 60° C. and the following materials were mixed and dissolved into it to obtain a polymerizable monomer composition.

| | |
|---|---|
| negative charge control agent T-77 (Hodogaya Chemical Co., Ltd.) | 1.00 parts |
| release agent (Fischer-Tropsch wax (HNP-51: Nippon Seiro Co., Ltd.)) | 8.00 parts |
| polymerization initiator (t-butyl peroxypivalate (25% toluene solution)) | 9.00 parts |

The polymerizable monomer composition was introduced into the aqueous medium and granulation was performed by stirring for 15 minutes at 22,000 rpm using a TK Homomixer (Tokushu Kika Kogyo Co., Ltd.) at a temperature of 60° C. under a nitrogen atmosphere. This was followed by stirring with a paddle stirring blade, and a polymerization reaction was run for 300 minutes at a reaction temperature of 70° C.

The resulting suspension was then cooled to room temperature at 3° C./minute; hydrochloric acid was added and the dispersion stabilizer was dissolved; filtration, washing with water, and drying were performed; and classification was carried out using a Coanda effect-based multi-grade classifier to obtain toner particle 1.

0.3 parts of sol-gel silica fine particles having a number-average primary particle diameter of 100 nm was then added to 100 parts of the obtained toner particle 1 and mixing was carried out using an FM mixer (Nippon Coke & Engineering Co., Ltd.). This was followed by the addition of 0.7 parts of hydrophobic silica fine particles and mixing again using the FM mixer (Nippon Coke & Engineering Co., Ltd.) to provide a toner 1. The hydrophobic silica fine particles used here were provided by the treatment of silica fine particles having a number-average primary particle diameter of 12 nm with hexamethyldisilazane followed by treatment with silicone oil; the hydrophobic silica fine particles had a post-treatment BET specific surface area value of 120 $m^2/g$.

The formulation and properties of the obtained toner 1 are given in Table 8 and Table 9.

Toners 2 to 10, 14, and 17 Production Example

Toners 2 to 10, 14, and 17 were obtained proceeding as in the Toner 1 Production Example, but changing the type and number of parts of addition of the particle A in the Toner 1 Production Example as shown in Table 8. The formulations and properties are given in Table 8.

Toner 11 Production Example

Polyester Resin 2 Production Example

| | |
|---|---|
| terephthalic acid | 48.0 parts |
| dodecenylsuccinic acid | 17.0 parts |
| trimellitic acid | 10.2 parts |
| ethylene oxide (2 mol) adduct on bisphenol A | 80.0 parts |
| propylene oxide (2 mol) adduct on bisphenol A | 74.0 parts |
| dibutyltin oxide | 0.1 parts |

These materials were introduced into a heat-dried two-neck flask, nitrogen gas was introduced into the container, and the temperature was raised while stirring and maintaining the inert atmosphere. A condensation polymerization reaction was then run for approximately 13 hours at 150° C. to 230° C.; this was followed by gradually reducing the pressure at 210° C. to 250° C. to obtain polyester resin 2.

Polyester resin 2 had a number-average molecular weight (Mn) of 21200, a weight-average molecular weight (Mw) of 98000, and a glass transition temperature (Tg) of 58.3° C.

Resin Particle Dispersion 1 Production Example 100.0 parts of ethyl acetate, 30.0 parts of polyester resin 2, 0.3 parts of 0.1 mol/L sodium hydroxide, and 0.2 parts of an anionic surfactant (Neogen RK, Dai-ichi Kogyo Seiyaku Co., Ltd.) were introduced into a stirrer-equipped beaker, and heated to 60.0° C., and stirring was continued until complete dissolution to prepare a resin solution 1.

While further stirring the resin solution 1, 90.0 parts of deionized water was gradually added to induce phase inversion emulsification, and resin particle dispersion 1 (solids fraction concentration: 25.0 mass %) was obtained by solvent removal.

The volume-average particle diameter of the resin particles in resin particle dispersion 1 was 0.19 μm.

Wax Dispersion 1 Production Example

| | |
|---|---|
| behenyl behenate | 50.0 parts |
| anionic surfactant (Neogen RK, Dai-ichi Kogyo Seiyaku Co., Ltd) | 0.3 parts |
| deionized water | 150.0 parts |

The preceding were mixed and heated to 95° C. and dispersion was carried out using a homogenizer (Ultra-Turrax T50, IKA). This was followed by dispersion processing with a Manton-Gaulin high-pressure homogenizer (Gaulin Company) to prepare wax dispersion 1 (solids fraction concentration: 25 mass %) in which wax particles were dispersed. The volume-average particle diameter of the obtained wax particles was 0.22 μm.

Magnetic Body Dispersion 1 Production Example

| | |
|---|---|
| magnetic body 7 | 25.0 parts |
| deionized water | 75.0 parts |

These materials were mixed and were dispersed for 10 minutes at 8000 rpm using a homogenizer (Ultra-Turrax T50, IKA) to obtain a magnetic body dispersion 1. The volume-average particle diameter of the magnetic bodies in magnetic body dispersion 1 was 0.32 μm.

Toner Particle 11 Production Example

| | |
|---|---|
| resin particle dispersion 1 (solids fraction = 25.0 mass %) | 195.0 parts |
| wax dispersion 1 (solids fraction = 25.0 mass %) | 15.0 parts |
| magnetic body dispersion 1 (solids fraction = 25.0 mass %) | 117.0 parts |

These materials were introduced into a beaker; the total number of parts of water was adjusted to 250 parts; and the temperature was then regulated to 30.0° C. This was followed by mixing by stirring for 1 minute at 5000 rpm using a homogenizer (Ultra-Turrax T50, IKA).

A 2.0 mass % aqueous solution of 10.0 parts of magnesium sulfate was then gradually added as an aggregating agent.

The starting dispersion was transferred to a polymerization kettle equipped with a stirring device and a thermometer, and the growth of aggregated particles was promoted by heating to 50.0° C. with a mantle heater and stirring.

200.0 parts of a 5.0 mass % aqueous solution of ethylenediaminetetraacetic acid (EDTA) was added at the stage after the elapse of 60 minutes to prepare an aggregated particle dispersion 1.

The pH of the aggregated particle dispersion 1 was subsequently adjusted to 8.0 using a 0.1 mon aqueous sodium hydroxide solution; aggregated particle dispersion 1 was then heated to 80.0° C. and standing was carried out for 180 minutes to carry out aggregated particle coalescence.

Toner particle dispersion 1, in which toner particles were dispersed, was obtained after the elapse of the 180 minutes. Cooling was carried out to 40° C. or below at a ramp down rate of 300° C./min Toner particle dispersion 1 was then filtered and through-washed with deionized water until the conductivity of the filtrate was 50 mS or less, at which point the toner particles were recovered in cake form.

The toner particle cake was introduced into 20-fold deionized water on a mass basis with respect to the toner particles; stirring was performed with a Three-One motor; and, once the toner particles had been thoroughly broken up, solid-liquid separation was carried out by another filtration and through-wash with water. The resulting toner particle cake was broken up with a sand mill and drying was performed for 24 hours in a 40° C. oven. The resulting powder was further milled with a sand mill followed by an additional vacuum drying for 5 hours in a 50° C. oven to obtain toner particle 11.

0.3 parts of sol-gel silica fine particles having a number-average primary particle diameter of 100 nm was then added to 100 parts of the obtained toner particle 11 and mixing was carried out using an FM mixer (Nippon Coke & Engineering Co., Ltd.). This was followed by the addition of 0.7 parts of hydrophobic silica fine particles and mixing again using an FM mixer (Nippon Coke & Engineering Co., Ltd.) to provide a toner 11. The hydrophobic silica fine particles used here were provided by the treatment of silica fine particles having a number-average primary particle diameter of 12 nm with hexamethyldisilazane followed by treatment with silicone oil; the hydrophobic silica fine particles had a post-treatment BET specific surface area value of 120 $m^2/g$.

The formulation and properties of the obtained toner 11 are given in Table 8.

Toner 12 Production Example

Production of Masterbatch 1

A carbon black-containing masterbatch 1 was produced using the materials and production method described in the following.

polyester resin 2: 75.0 parts
carbon black: 25.0 parts
(Nipex 35, Degussa Japan Co., Ltd.)

These materials were mixed using an FM mixer (Nippon Coke & Engineering Co., Ltd.) followed by melt-kneading using a twin-screw extruder (Model PCM-30, Ikegai Seisakusho Co., Ltd.) set to a temperature of 130° C. The resulting kneaded material was cooled and was coarsely pulverized to 1 mm and below using a hammer mill to obtain a masterbatch 1.

Production of Masterbatch Dispersion 1

100.0 parts of ethyl acetate, 30.0 parts of masterbatch 1, 0.3 parts of 0.1 mon sodium hydroxide, and 0.2 parts of an anionic surfactant (Neogen RK, Dai-ichi Kogyo Seiyaku Co., Ltd.) were introduced into a stirrer-equipped beaker, heating to 60.0° C. was carried out, and stirring was continued until complete dissolution to prepare a masterbatch solution 1.

While further stirring the masterbatch solution 1, 90.0 parts of deionized water was gradually added to induce phase inversion emulsification, and masterbatch dispersion 1 (solids fraction concentration: 25.0 mass %) was obtained by solvent removal.

The volume-average particle diameter of the resin particles in masterbatch dispersion 1 was 0.22 μm.

Toner Particle 12 Production Example

| | |
|---|---|
| resin particle dispersion 1 (solids fraction = 25.0 mass %) | 225.9 parts |
| wax dispersion 1 (solids fraction = 25.0 mass %) | 28.1 parts |
| masterbatch dispersion 1 (solids fraction = 25.0 mass %) | 73.0 parts |

These materials were introduced into a beaker; the total number of parts of water was adjusted to 250 parts; and the temperature was then regulated to 30.0° C. This was followed by mixing by stirring for 1 minute at 5000 rpm using a homogenizer (Ultra-Turrax T50, IKA).

A 2.0 mass % aqueous solution of 10.0 parts of magnesium sulfate was then gradually added as an aggregating agent.

The starting dispersion was transferred to a polymerization kettle equipped with a stirring device and a thermometer, and the growth of aggregated particles was promoted by heating to 50.0° C. with a mantle heater and stirring.

200.0 parts of a 5.0 mass % aqueous solution of ethylenediaminetetraacetic acid (EDTA) was added at the stage after the elapse of 60 minutes to prepare an aggregated particle dispersion 2.

The pH of the aggregated particle dispersion 2 was subsequently adjusted to 8.0 using a 0.1 mon aqueous sodium hydroxide solution; aggregated particle dispersion 2 was then heated to 80.0° C. and standing was carried out for 180 minutes to carry out aggregated particle coalescence.

Toner particle dispersion 2, in which toner particles were dispersed, was obtained after the elapse of the 180 minutes. Cooling was carried out to 40° C. or below at a ramp down rate of 300° C./min Toner particle dispersion 2 was then filtered and through-washed with deionized water until the conductivity of the filtrate was not more than 50 mS, at which point the toner particles were recovered in cake form.

The toner particle cake was introduced into 20-fold deionized water on a mass basis with respect to the toner particles; stirring was performed with a Three-One motor; and, once the toner particles had been thoroughly broken up, solid-liquid separation was carried out by another filtration and through-wash with water. The resulting toner particle cake was broken up with a sand mill and drying was performed for 24 hours in a 40° C. oven. The resulting powder was further milled with a sand mill followed by an additional vacuum drying for 5 hours in a 50° C. oven to obtain toner particle 12.

0.3 parts of sol-gel silica fine particles having a number-average primary particle diameter of 100 nm was then added to 100 parts of the obtained toner particle 12 and mixing was carried out using an FM mixer (Nippon Coke & Engineering Co., Ltd.). This was followed by the addition of 0.7 parts of hydrophobic silica fine particles and mixing again using an FM mixer (Nippon Coke & Engineering Co., Ltd.) to provide a toner 12. The hydrophobic silica fine particles used here were provided by the treatment of silica fine particles having a number-average primary particle diameter of 12 nm with hexamethyldisilazane followed by treatment with silicone oil; the hydrophobic silica fine particles had a post-treatment BET specific surface area value of 120 $m^2/g$.

The formulation and properties of the obtained toner 12 are given in Table 8.

Toner 13 Production Example

The following materials were introduced into an attritor (Mitsui Miike Chemical Engineering Machinery Co., Ltd.), and a pigment masterbatch was prepared by carrying out dispersion for 5 hours at 220 rpm using zirconia particles having a diameter of 1.7 mm

| | |
|---|---|
| styrene | 60.0 parts |
| carbon black | 7.0 parts |
| (Nipex 35, Degussa Japan Co., Ltd.) | |
| charge control agent | 0.10 parts |
| (Bontron E-89, Orient Chemical Industries Co., Ltd.) | |

An aqueous medium containing a dispersion stabilizer was obtained by introducing 450 parts of a 0.1 mon aqueous $Na_3PO_4$ solution into 720 parts of deionized water and heating to 60° C. and then adding 67.7 parts of a 1.0 mon aqueous $CaCl_2$ solution.

(Preparation of a Polymerizable Monomer Composition)

| | |
|---|---|
| styrene | 12.0 parts |
| n-butyl acrylate | 28.0 parts |
| 1,6-hexanediol diacrylate | 1.0 parts |
| pigment masterbatch | 67.1 parts |
| polyester resin 1 | 4.0 parts |

These materials were dispersed and mixed to uniformity using an attritor (Mitsui Miike Chemical Engineering Machinery Co., Ltd.). The resulting monomer composition was heated to a temperature of 60° C. and the following materials were mixed and dissolved into it to obtain a polymerizable monomer composition.

| | |
|---|---|
| negative charge control agent T-77 | 1.00 parts |
| (Hodogaya Chemical Co., Ltd.) | |
| release agent | 8.00 parts |
| (Fischer-Tropsch wax (HNP-51: Nippon Seiro Co., Ltd.)) | |
| polymerization initiator | 9.00 parts |
| (t-butyl peroxypivalate (25% toluene solution)) | |

The ensuing steps were carried out using the same procedures as in the Toner 1 Production Example to obtain toner 13. The properties of the obtained toner are given in Table 8.

Toner 15 Production Example

A toner 15 was obtained proceeding as for toner 1, but adjusting the amount of the dispersion stabilizer in the Toner 1 Production Example so as to provide a volume average particle diameter for the toner of 5.3 μm. The properties are given in Table 8.

Toner 16 Production Example

| | |
|---|---|
| polyester resin 1 | 100.0 parts |
| magnetic body 8 | 60 parts |
| release agent | 5.0 parts |
| (Fischer-Tropsch wax (HNP-51: Nippon Seiro Co., Ltd.)) | |
| charge control agent | 2.0 parts |
| (T-77: Hodogaya Chemical Co., Ltd.) | |

These materials were pre-mixed using an FM mixer (Nippon Coke & Engineering Co., Ltd.) followed by melt-kneading with a twin-screw kneading extruder (Model PCM-30, Ikegai Ironworks Corporation).

The resulting kneaded material was cooled and coarsely pulverized using a hammer mill and was then pulverized using a mechanical pulverizer (T-250, Turbo Kogyo Co., Ltd.). The resulting finely pulverized powder was classified using a Coanda effect-based multi-grade classifier to yield a toner particle 16 having a Dn (μm) of 6.5 μm. Toner particle 16 had a Tg of 60.0° C.

Toner 16 was obtained by carrying out external addition on toner particle 16 proceeding as described in the Toner 1 Production Example. The properties of the obtained toner are given in Table 8.

Toner 18 Production Example

| | |
|---|---|
| polyester resin 1 | 100.0 parts |
| carbon black | 7.0 parts |
| (Nipex 35, Degussa Japan Co., Ltd.) | |
| release agent | 5.0 parts |
| (Fischer-Tropsch wax (HNP-51: Nippon Seiro Co., Ltd.)) | |
| charge control agent | 2.0 parts |
| (T-77: Hodogaya Chemical Co., Ltd.) | |

These materials were pre-mixed using an FM mixer (Nippon Coke & Engineering Co., Ltd.) followed by melt-kneading with a twin-screw kneading extruder (Model PCM-30, Ikegai Ironworks Corporation).

The resulting kneaded material was cooled and coarsely pulverized using a hammer mill and was then pulverized using a mechanical pulverizer (T-250, Turbo Kogyo Co., Ltd.). The resulting finely pulverized powder was classified using a Coanda effect-based multi-grade classifier to yield a toner particle 18 having a Dn (μm) of 6.5 μm. Toner particle 18 had a Tg of 59.0° C.

Toner 18 was obtained by carrying out external addition on toner particle 18 proceeding as described in the Toner 1 Production Example. The properties of the obtained toner are given in Table 8.

TABLE 8

| Toner No. | Particle A | Amount of particle A | Dielectric loss tangent (tan δ) | Relative permittivity (εr) | E2/E1 | Magnetic body area % | A1 (%) | A2 (%) | A2/A1 | Particle diameter |
|---|---|---|---|---|---|---|---|---|---|---|
| 1 | magnetic body 1 | 65 | 0.0064 | 2.35 | 0.000010 | 98 | 52 | 22 | 0.42 | 6.5 |
| 2 | magnetic body 2 | 55 | 0.0043 | 2.16 | 0.000010 | 98 | 37 | 23 | 0.62 | 6.5 |
| 3 | magnetic body 1 | 45 | 0.0027 | 2.05 | 0.000010 | 98 | 35 | 26 | 0.74 | 6.5 |
| 4 | magnetic body 3 | 90 | 0.0048 | 2.49 | 0.000070 | 88 | 44 | 46 | 1.05 | 6.5 |
| 5 | magnetic body 1 | 95 | 0.0064 | 2.73 | 0.000500 | 95 | 84 | 32 | 0.38 | 6.5 |
| 6 | magnetic body 1 | 105 | 0.0064 | 2.89 | 0.001300 | 90 | 85 | 33 | 0.39 | 6.5 |
| 7 | magnetic body 4 | 65 | 0.0064 | 2.30 | 0.002000 | 99 | 75 | 16 | 0.21 | 6.5 |
| 8 | magnetic body 3 | 65 | 0.0038 | 2.25 | 0.000010 | 85 | 38 | 34 | 0.89 | 6.5 |
| 9 | magnetic body 5 | 65 | 0.0034 | 2.21 | 0.000010 | 72 | 34 | 37 | 1.09 | 6.5 |
| 10 | magnetic body 6 | 65 | 0.0030 | 2.21 | 0.000010 | 62 | 30 | 39 | 1.30 | 6.5 |

TABLE 8-continued

| Toner No. | Particle A | Amount of particle A | Dielectric loss tangent (tan δ) | Relative permittivity (εr) | E2/E1 | Magnetic body area % | A1 (%) | A2 (%) | A2/A1 | Particle diameter |
|---|---|---|---|---|---|---|---|---|---|---|
| 11 | magnetic body 7 | 65 | 0.0058 | 2.78 | 0.001200 | 20 | 25 | 43 | 1.72 | 6.5 |
| 12 | CB | 7 | 0.0065 | 1.98 | — | — | — | — | — | 6.5 |
| 13 | CB | 7 | 0.0071 | 1.96 | — | — | — | — | — | 6.5 |
| 14 | magnetic body 2 | 65 | 0.0063 | 2.33 | 0.000010 | 95 | 50 | 23 | 0.46 | 6.5 |
| 15 | magnetic body 1 | 65 | 0.0063 | 2.36 | 0.000009 | 98 | 52 | 22 | 0.42 | 5.3 |
| 16 | magnetic body 8 | 60 | 0.0025 | 2.4 | 0.020000 | 21 | 33 | 30 | 0.91 | 6.5 |
| 17 | magnetic body 2 | 30 | 0.0019 | 1.9 | 0.000010 | 58 | 29 | 30 | 1.03 | 6.5 |
| 18 | CB | 7 | 0.0022 | 1.88 | — | — | — | — | — | 6.5 |

In the table, the amount of particle A is the number of parts per 100 parts of the binder resin. The "magnetic body area %" refers to the magnetic body occurrence percentage in the 10% region. The particle diameter is the weight-average particle diameter Dt (μm) of the toner. CB refers to carbon black.

TABLE 9

Table of Properties

| Example No. | | Properties of the conductive members: Dms [μm] | Dm [μm] | Toner | Relationships: Dt − Dms | Dms − Dmg |
|---|---|---|---|---|---|---|
| 1 | conductive member 1 | 0.25 | 0.22 | Toner 1 | 6.25 | 0.050 |
| 2 | conductive member 1 | 0.25 | 0.22 | Toner 2 | 6.25 | −0.030 |
| 3 | conductive member 1 | 0.25 | 0.22 | Toner 3 | 6.25 | 0.050 |
| 4 | conductive member 1 | 0.25 | 0.22 | Toner 4 | 6.25 | −0.030 |
| 5 | conductive member 1 | 0.25 | 0.22 | Toner 5 | 6.25 | 0.050 |
| 6 | conductive member 1 | 0.25 | 0.22 | Toner 6 | 6.25 | 0.050 |
| 7 | conductive member 1 | 0.25 | 0.22 | Toner 7 | 6.25 | 0.050 |
| 8 | conductive member 1 | 0.25 | 0.22 | Toner 8 | 6.25 | −0.030 |
| 9 | conductive member 1 | 0.25 | 0.22 | Toner 9 | 6.25 | −0.030 |
| 10 | conductive member 1 | 0.25 | 0.22 | Toner 10 | 6.25 | −0.030 |
| 11 | conductive member 1 | 0.25 | 0.22 | Toner 11 | 6.25 | −0.070 |
| 12 | conductive member 1 | 0.25 | 0.22 | Toner 12 | 6.25 | 0.230 |
| 13 | conductive member 1 | 0.25 | 0.22 | Toner 13 | 6.25 | 0.230 |
| 14 | conductive member 2 | 1.33 | 1.22 | Toner 1 | 5.17 | 1.130 |
| 15 | conductive member 2 | 1.33 | 1.22 | Toner 3 | 5.17 | 1.130 |
| 16 | conductive member 3 | 0.26 | 0.44 | Toner 1 | 6.24 | 0.060 |
| 17 | conductive member 4 | 0.26 | 0.44 | Toner 1 | 6.24 | 0.060 |
| 18 | conductive member 4 | 0.26 | 0.44 | Toner 3 | 6.24 | 0.060 |
| 19 | conductive member 5 | 1.23 | 1.12 | Toner 14 | 5.27 | 0.950 |
| 20 | conductive member 6 | 2.15 | 2.35 | Toner 1 | 4.35 | 1.950 |
| 21 | conductive member 7 | 4.69 | 4.55 | Toner 1 | 1.81 | 4.490 |
| 22 | conductive member 8 | 7.40 | 6.80 | Toner 1 | −0.90 | 7.200 |
| 23 | conductive member 7 | 4.69 | 4.55 | Toner 15 | 0.61 | 4.490 |
| 24 | conductive member 9 | 0.10 | 0.10 | Toner 1 | 6.4 | −0.100 |
| Comparative 1 | conductive member 10 | — | — | Toner 1 | — | — |
| Comparative 2 | conductive member 11 | 0.24 | 0.23 | Toner 1 | 6.26 | 0.040 |
| Comparative 3 | conductive member 12 | 2.40 | 2.20 | Toner 1 | 4.10 | 2.200 |
| Comparative 4 | conductive member 13 | 0.26 | 0.24 | Toner 1 | 6.24 | 0.060 |
| Comparative 5 | conductive member 11 | 0.25 | 0.23 | Toner 16 | 6.25 | 0.100 |
| Comparative 6 | conductive member 11 | 0.25 | 0.23 | Toner 17 | 6.25 | −0.030 |
| Comparative 7 | conductive member 11 | 0.25 | 0.23 | Toner 18 | 6.25 | 0.230 |

TABLE 10

| Example No. | Conductive member No. | Toner | Halftone density uniformity in low-temperature, low-humidity environment | | Halftone density uniformity in very low-temperature, low-humidity environment | | Halftone density retention percentage in high-temperature, high-humidity environment | | Fogging after long-term standing in high-temperature, high-humidity environment | | Rubbing fixing performance of halftone in low-temperature, low-humidity environment | |
|---|---|---|---|---|---|---|---|---|---|---|---|---|
| 1 | 1 | Toner 1 | A | 0.01 | A | 0.02 | A | 99 | A | 0.1 | A | 97 |
| 2 | 1 | Toner 2 | A | 0.03 | B | 0.06 | A | 98 | A | 0.2 | A | 98 |
| 3 | 1 | Toner 3 | B | 0.06 | B | 0.07 | A | 93 | B | 1.0 | A | 98 |

TABLE 10-continued

| Example No. | Conductive member No. | Toner | Halftone density uniformity in low-temperature, low-humidity environment | | Halftone density uniformity in very low-temperature, low-humidity environment | | Halftone density retention percentage in high-temperature, high-humidity environment | | Fogging after long-term standing in high-temperature, high-humidity environment | | Rubbing fixing performance of halftone in low-temperature, low-humidity environment | |
|---|---|---|---|---|---|---|---|---|---|---|---|---|
| 4 | 1 | Toner 4 | A | 0.03 | B | 0.06 | A | 98 | A | 0.5 | C | 82 |
| 5 | 1 | Toner 5 | A | 0.02 | A | 0.03 | A | 97 | B | 1.0 | A | 95 |
| 6 | 1 | Toner 6 | A | 0.02 | A | 0.03 | A | 97 | C | 1.5 | A | 95 |
| 7 | 1 | Toner 7 | A | 0.02 | A | 0.03 | A | 98 | C | 1.5 | A | 95 |
| 8 | 1 | Toner 8 | A | 0.04 | B | 0.06 | A | 95 | A | 0.6 | B | 89 |
| 9 | 1 | Toner 9 | B | 0.07 | C | 0.10 | B | 88 | A | 0.7 | B | 85 |
| 10 | 1 | Toner 10 | B | 0.07 | C | 0.10 | B | 86 | A | 0.8 | C | 81 |
| 11 | 1 | Toner 11 | B | 0.05 | C | 0.11 | C | 81 | C | 1.5 | C | 80 |
| 12 | 1 | Toner 12 | B | 0.08 | C | 0.14 | C | 81 | C | 1.8 | C | 84 |
| 13 | 1 | Toner 13 | B | 0.08 | C | 0.14 | C | 81 | C | 1.8 | C | 84 |
| 14 | 2 | Toner 1 | A | 0.04 | B | 0.05 | A | 98 | A | 0.5 | A | 97 |
| 15 | 2 | Toner 3 | B | 0.08 | C | 0.10 | A | 93 | B | 1.2 | A | 97 |
| 16 | 3 | Toner 1 | A | 0.03 | A | 0.03 | A | 98 | A | 0.6 | A | 97 |
| 17 | 4 | Toner 1 | B | 0.08 | B | 0.06 | A | 98 | A | 0.7 | A | 97 |
| 18 | 4 | Toner 3 | C | 0.13 | C | 0.12 | A | 93 | B | 1.3 | A | 97 |
| 19 | 5 | Toner 14 | A | 0.03 | A | 0.04 | A | 98 | A | 0.5 | A | 96 |
| 20 | 6 | Toner 1 | B | 0.08 | B | 0.09 | A | 98 | A | 0.5 | A | 97 |
| 21 | 7 | Toner 1 | B | 0.07 | B | 0.08 | A | 98 | A | 0.5 | A | 97 |
| 22 | 8 | Toner 1 | B | 0.09 | C | 0.13 | A | 97 | A | 0.5 | A | 97 |
| 23 | 7 | Toner 15 | B | 0.09 | C | 0.14 | A | 95 | A | 0.7 | A | 98 |
| 24 | 9 | Toner 1 | B | 0.09 | C | 0.13 | A | 97 | A | 0.5 | A | 97 |
| C.E. 1 | 10 | Toner 1 | D | 0.15 | E | 0.20 | C | 80 | C | 1.7 | C | 81 |
| C.E. 2 | 11 | Toner 1 | D | 0.15 | E | 0.20 | C | 80 | C | 1.8 | C | 82 |
| C.E. 3 | 12 | Toner 1 | D | 0.16 | E | 0.21 | C | 80 | C | 1.8 | C | 81 |
| C.E. 4 | 13 | Toner 1 | D | 0.16 | E | 0.22 | C | 80 | C | 1.8 | C | 82 |
| C.E. 5 | 11 | Toner 16 | D | 0.19 | E | 0.27 | E | 70 | D | 2.3 | D | 75 |
| C.E. 6 | 11 | Toner 17 | D | 0.19 | E | 0.28 | D | 75 | D | 2.5 | D | 76 |
| C.E. 7 | 11 | Toner 18 | D | 0.19 | E | 0.28 | E | 70 | D | 2.6 | E | 77 |

In the Table, "C.E." denotes "Comparative Example".

Example 1

An HP printer (HP LaserJet Enterprise Color M553dn) was modified to have a 1.3-time higher process speed and this was used as the electrophotographic apparatus used in the evaluations.

In addition, the process cartridge was provided by changing the conductive member in the charging unit of a CF360X to the conductive member 1 and was filled with 350 g of toner 1, and the following evaluations were performed. The combination of this printer and process cartridge corresponds to the structure given in FIG. 5.

The results of the evaluations are given in Table 10.

Examples 2 to 24 and Comparative Examples 1 to 7

The evaluations of Examples 2 to 24 and Comparative Examples 1 to 7 were carried out as in Example 1, but changing the conductive member+toner combination to the combinations in Table 9. The results are given in Table 10.

Evaluation 1. Halftone Density Uniformity in Low-Temperature, Low-Humidity Environment The halftone density uniformity was evaluated in a low-temperature, low-humidity environment (temperature=15.0° C., relative humidity=10.0%), which, due to the toner cleaning performance and charge up behavior, is a severe environment with regard to the generation of white spots in halftone images.

In addition, evaluation was performed assuming that a long-term durability test is severe in terms of toner attachment to the conductive member.

Specifically, a durability test of a total of 10000 prints, using 2 prints per 1 job, of a horizontal line pattern of 2-dot horizontal lines that provided a print percentage of 3%, was carried out.

Cotton Bond Light Cockle (letter, areal weight of 75 g, length 279 mm, width 216 mm), a rough paper, was used as the evaluation paper.

After the 10000-print durability test, five prints were continuously output, beginning with print 10001, of a halftone image having 5 mm margins on the left and right and at the top edge and bottom edge and having a length 269 mm×width 206 mm halftone portion with a dot print percentage of 20%. On the halftone portion of each of these five halftone images, the density was measured at 100 points using a MacBeth reflection densitometer (MacBeth Corporation), and the maximum value, the minimum value, and their difference were determined. Evaluation based on the following criteria was performed on the image that, among the five images, presented the largest density difference. A score of C or better was regarded as good.

Evaluation Criteria

A. the density difference is less than 0.05

B. the density difference is at least 0.05, but less than 0.10

C. the density difference is at least 0.10, but less than 0.15

D. the density difference is at least 0.15, but less than 0.20

E. the density difference is at least 0.20

Evaluation 2. Halftone Density Uniformity in Very Low-Temperature, Low-Humidity Environment The halftone density uniformity in a very low-temperature, low-humidity environment was evaluated as in Evaluation 1, except that the evaluation was performed in a very low-temperature, low-humidity environment (temperature=7.5° C., relative humidity=30.0%), which is a more demanding environment with regard to white spot generation than in Evaluation 1.

The evaluation was performed using the following criteria. A score of C or better was regarded as good.

Evaluation Criteria

A. the density difference is less than 0.05

B. the density difference is at least 0.05, but less than 0.10

C. the density difference is at least 0.10, but less than 0.15

D. the density difference is at least 0.15, but less than 0.20

E. the density difference is at least 0.20

Evaluation 3. Halftone Density Retention Percentage in High-Temperature, High-Humidity Environment The halftone density retention percentage was evaluated in a high-temperature, high-humidity environment (temperature=32.5° C., relative humidity=85.0%), which is an environment in which, in a long-term durability test, burial of the external additive on the toner is facilitated and the toner charging performance readily becomes unfavorable.

The evaluation was carried out in a mode demanding with regard to toner deterioration, presumed to be a long-term durability test with a lower print percentage than the usual print.

Specifically, a durability test of a total of 15000 prints, using 2 prints per 1 job, of a horizontal line pattern of 2-dot horizontal lines that provided a print percentage of 2%, was carried out.

Cotton Bond Light Cockle (letter, areal weight of 75 g, length 279 mm, width 216 mm), a rough paper, was used as the evaluation paper.

A halftone image, having 5 mm margins on the left and right and at the top edge and bottom edge and having a length 269 mm×width 206 mm halftone portion with a dot print percentage of 20%, was output as a first print and continuously for five prints from print 15001 after the 15000-print durability test.

For each of the first print of this image and the five prints of the image after the durability test, the density of the halftone portion was measured at 10 points using a MacBeth reflection densitometer (MacBeth Corporation), and the average value was used as the halftone density for each particular image.

The halftone density for each of the five images after the durability test was divided by the halftone density of the first print and then multiplied by 100 to give the halftone density retention percentage, and the evaluation was carried out using the evaluation criteria given below. The largest value, smallest value, and their difference were determined. The evaluation using the following criteria was carried out using the image that, among the five images, presented the largest density difference.

A score of C or better was regarded as good.

Evaluation Criteria

A. the halftone density retention percentage is at least 90%

B. the halftone density retention percentage is at least 85%, but less than 90%

C. the halftone density retention percentage is at least 80%, but less than 85%

D. the halftone density retention percentage is at least 75%, but less than 80%

E. the halftone density retention percentage is less than 75%

Evaluation 4. Fogging after Long-Term Standing in High-Temperature, High-Humidity Environment The evaluation of fogging after long-term standing was carried out by evaluating the fogging on an image output in a high-temperature, high-humidity environment (temperature=32.5° C., relative humidity=85.0%) after standing for 30 days in the same environment.

Long-term standing in a high-temperature, high-humidity environment serves to facilitate a decline in the charging performance of the toner, and to facilitate the occurrence of image fogging, more than in an ordinary evaluation in a high-temperature, high-humidity environment. In addition, by carrying out the evaluation without removing or inserting the process cartridge during the long-term standing and with the main body power remaining on, the pre-printing rotation time related to toner charging is made short, which as a consequence provides a severe condition for charge retention by the toner.

Cotton Bond Light Cockle (letter, areal weight of 75 g, length 279 mm, width 216 mm), a rough paper, was used as the evaluation paper.

First, an entirely white image (white image 1) was output in the high-temperature, high-humidity environment using paper on which a sticky note had been applied in order to mask a portion of the printed surface of the image.

Standing was then carried out for 30 days in the high-temperature, high-humidity environment with the process cartridge continuing to be inserted in the main body and without turning off the power supply to the main body. This was followed by the output of an entirely white image (white image 2) using paper on which a sticky note had been applied in order to mask a portion of the printed surface of the image.

With white image 2, the sticky note was peeled off and the reflectance (%) was then measured at five points in the area where the sticky note had been placed and at five points in the area where the sticky note had not been applied. The average values were calculated, the difference between the average values was then calculated, and this was used as the fogging after long-term standing.

The reflectance was measured using a digital white photometer (Model TC-6D, Tokyo Denshoku Co., Ltd., a green filter was used). Lower values indicate a better fogging behavior, and the evaluation was performed using the following criteria.

A score of C or better was regarded as good.

Evaluation Criteria

A. the post-standing fogging is less than 1.0%

B. the post-standing fogging is at least 1.0%, but less than 1.5%

C. the post-standing fogging is at least 1.5%, but less than 2.0%

D. the post-standing fogging is at least 2.0%

Evaluation 5. Rubbing Fixing Performance in Low-Temperature, Low-Humidity Environment The fixing performance versus rubbing was evaluated in a low-temperature, low-humidity environment (temperature=15.0° C., relative humidity=10.0%), which is a demanding environment with regard to the toner fixing performance. In addition, a halftone image presents many elements in which the toner is formed as an isolated dot, and due to this the toner is easily detached from the paper when the image is rubbed and a rigorous evaluation can then be performed. Moreover, when a rough paper is used, the toner in the depressed portions in the paper is difficult to melt, and due to this the toner is easily detached from the paper when the image is rubbed and a rigorous evaluation can then be performed.

Cotton Bond Light Cockle (letter, areal weight of 75 g, length 279 mm, width 216 mm), a rough paper, was used as the evaluation paper.

Temperature control of the fixing unit in the image-forming apparatus was adjusted to provide 200° C. in the low-temperature, low-humidity environment.

First, an image was output that had 5 mm for the leading edge margin and the right and left margins and that had a 5 mm×5 mm halftone patch region at three locations, i.e., the left, right, and center, and this at three locations on a 30-mm interval in the longitudinal direction, for a total of nine locations.

The density of the nine halftone patch regions was measured with a MacBeth reflection densitometer (MacBeth Corporation), and density adjustment of the image-forming apparatus was performed so as to adjust the average value of the halftone patch region densities to from 0.70 to 0.80.

Three prints were then output of the image that had 5 mm for the leading edge margin and the right and left margins and that had a 5 mm×5 mm halftone patch region at three locations, i.e., the left, right, and center, and this at three locations on a 30-mm interval in the longitudinal direction, for a total of nine locations. The halftone density retention percentage pre-rubbing versus post-rubbing was evaluated using the second print of the image.

Specifically, using a MacBeth reflection densitometer (MacBeth Corporation), the density was measured at the nine halftone patch regions on the image before rubbing, and the average value was calculated (initial density).

Each of the nine halftone patch regions on this image was rubbed ten times with lens-cleaning paper carrying a load of 55 g/cm$^2$; the density of each of the halftone patches was then measured with a MacBeth reflection densitometer (MacBeth Corporation); and the average value was calculated (post-rubbing density). The post-rubbing density was divided by the initial density and this was multiplied by 100 to calculate the post-rubbing density retention percentage, and the evaluation was performed using the following criteria. A score of C or better was regarded as good.

Evaluation Criteria

A. the post-rubbing density retention percentage is at least 90%

B. the post-rubbing density retention percentage is at least 85%, but less than 90%

C. the post-rubbing density retention percentage is at least 80%, but less than 85%

D. the post-rubbing density retention percentage is at least 75%, but less than 80%

E. the post-rubbing density retention percentage is less than 75%

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191584, filed Oct. 18, 2019, which is hereby incorporated by reference herein in its entirety.

What is claimed is:

1. An electrophotographic apparatus comprising:

an electrophotographic photosensitive member, a charging unit for charging a surface of the electrophotographic photosensitive member, and a developing unit for developing an electrostatic latent image formed on the surface of the electrophotographic photosensitive member with a toner to form a toner image on the surface of the electrophotographic photosensitive member, wherein the charging unit comprises a conductive member arranged to be capable of contacting the electrophotographic photosensitive member, the conductive member comprises a support having a conductive outer surface, and a conductive layer disposed on the outer surface of the support, the conductive layer comprises a matrix and a plurality of domains dispersed in the matrix, the matrix contains a first rubber, each of the domains contains a second rubber and an electronic conductive agent, at least some of the domains is exposed at the outer surface of the conductive member, the outer surface of the conductive member is composed of at least the matrix and the domains exposed at the outer surface of the conductive member, the matrix has a volume resistivity R1 of larger than $1.00\times10^{12}$ Ω·cm, the domains have a volume resistivity R2 of smaller than the volume resistivity R1 of the matrix, the developing unit comprises the toner, and the toner has a dielectric loss tangent of at least 0.0027.

2. The electrophotographic apparatus according to claim 1, wherein the volume resistivity R1 of the matrix is at least $1.0\times10^5$-times the volume resistivity R2 of the domains.

3. The electrophotographic apparatus according to claim 1, wherein the toner has a relative permittivity εr of at least 2.00.

4. The electrophotographic apparatus according to claim 1, wherein the toner comprises a toner particle containing a magnetic body.

5. The electrophotographic apparatus according to claim 4, wherein, as measured by x-ray photoelectron spectroscopic analysis, a ratio (E2/E1) of an abundance (E2) of iron element to an abundance (E1) of carbon element present at the surface of the toner particle is not more than 0.00100.

6. The electrophotographic apparatus according to claim 4, wherein, in observation of a cross section of the toner by a transmission electron microscope, within a distance from a contour of the cross section of the toner particle to a geometric center of the cross section, in a region not more than 10% of a distance from the contour, from 60 area % to 100 area % of the magnetic bodies is present.

7. The electrophotographic apparatus according to claim 4, wherein, in observation of the cross section of the toner by a transmission electron microscope, when A1 is an area percentage occupied by the magnetic bodies in the region not more than 200 nm from the contour of the cross section of the toner particle toward the geometric center of the cross section, the area percentage A1 is from 35 to 85%.

8. The electrophotographic apparatus according to claim 4, wherein, in observation of the cross section of the toner by a transmission electron microscope, when A1 is an area percentage occupied by the magnetic bodies in a region not more than 200 nm from the contour of the cross section of the toner particle toward the geometric center of the cross section and A2 is an area percentage occupied by the magnetic bodies in a region from 200 to 400 nm from the contour of the cross section of the toner particle toward the geometric center of the cross section, a ratio (A2/A1) of the area percentage A2 to the area percentage A1 is from 0 to 0.75.

9. The electrophotographic apparatus according to claim 4, wherein, in observation of the outer surface of the conductive member, an arithmetic average value Dms (μm) of distances between adjacent walls of the domains in the conductive layer and a number-average primary particle diameter Dmg (μm) of the magnetic bodies are in a relationship Dms>Dmg.

10. The electrophotographic apparatus according to claim 1, wherein, in observation of the outer surface of the conductive member, an arithmetic average value Dms (μm)

of distances between adjacent walls of the domains in the conductive layer and a weight-average particle diameter Dt (μm) of the toner are in a relationship Dt>Dms.

11. The electrophotographic apparatus according to claim 1, wherein, in observation of the cross section of the conductive member, an arithmetic average value Dm of distances between adjacent walls of the domains in the conductive layer is from 0.15 to 2.00 μm.

12. The electrophotographic apparatus according to claim 1, wherein a circle-equivalent diameter D of the domains is from 0.10 to 2.00 μm.

13. The electrophotographic apparatus according to claim 1, wherein the first rubber is at least one selected from the group consisting of butyl rubber, styrene-butadiene rubber, and ethylene-propylene-diene rubber, and the second rubber is at least one selected from the group consisting of styrene-butadiene rubber, butyl rubber, and acrylonitrile-butadiene rubber.

14. A process cartridge detachably provided to a main body of an electrophotographic apparatus, wherein the process cartridge comprises a charging unit for charging a surface of an electrophotographic photosensitive member, and a developing unit for developing an electrostatic latent image formed on the surface of the electrophotographic photosensitive member with a toner to form a toner image on the surface of the electrophotographic photosensitive member, the charging unit comprises a conductive member arranged to be capable of contacting the electrophotographic photosensitive member, the conductive member comprises a support having a conductive outer surface, and a conductive layer disposed on the outer surface of the support, the conductive layer comprises a matrix and a plurality of domains dispersed in the matrix, the matrix contains a first rubber, each of the domains contains a second rubber and an electronic conductive agent, at least some of the domains is exposed at the outer surface of the conductive member, the outer surface of the conductive member is composed of at least the matrix and the domains exposed at the outer surface of the conductive member, the matrix has a volume resistivity R1 of larger than $1.00\times10^{12}$ Ω·cm, the domains have a volume resistivity R2 of smaller than the volume resistivity R1 of the matrix, the developing unit has the toner, and the toner has a dielectric loss tangent of at least 0.0027.

15. A cartridge set having a first cartridge and a second cartridge detachably provided to a main body of an electrophotographic apparatus, wherein the first cartridge comprises a charging unit for charging a surface of an electrophotographic photosensitive member, and comprises a first frame for supporting the charging unit, the second cartridge comprises a toner container that accommodates a toner for forming a toner image on the surface of the electrophotographic photosensitive member by developing an electrostatic latent image formed on the surface of the electrophotographic photosensitive member, the charging unit comprises a conductive member arranged to be capable of contacting the electrophotographic photosensitive member, the conductive member comprises a support having a conductive outer surface and, a conductive layer disposed on the outer surface of the support, the conductive layer comprises a matrix and a plurality of domains dispersed in the matrix, the matrix contains a first rubber;

each of the domains contains a second rubber and an electronic conductive agent, at least some of the domains is exposed at the outer surface of the conductive member;

the outer surface of the conductive member is composed of at least the matrix and the domains exposed at the outer surface of the conductive member, the matrix has a volume resistivity R1 of larger than $1.00\times10^{12}$ Ω·cm, the domains have a volume resistivity R2 of smaller than the volume resistivity R1 of the matrix; and the toner has a dielectric loss tangent of at least 0.0027.

* * * * *